US007540603B2

(12) United States Patent
Otsuki

(10) Patent No.: US 7,540,603 B2
(45) Date of Patent: Jun. 2, 2009

(54) PRINTED BODY, ELEMENT PROVIDED ON PRINTED BODY, PRINTER, AND COMPUTER SYSTEM

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/415,932

(22) PCT Filed: Nov. 21, 2002

(86) PCT No.: PCT/JP02/12191

§ 371 (c)(1),
(2), (4) Date: May 5, 2003

(87) PCT Pub. No.: WO03/043828

PCT Pub. Date: May 30, 2003

(65) Prior Publication Data

US 2004/0239744 A1 Dec. 2, 2004

(30) Foreign Application Priority Data

| | | |
|---|---|---|
| Nov. 21, 2001 | (JP) | 2001-356189 |
| Nov. 30, 2001 | (JP) | 2001-367073 |
| Feb. 4, 2002 | (JP) | 2002-027115 |

(51) Int. Cl.
*B41J 2/01* (2006.01)

(52) U.S. Cl. ..... 347/105; 347/101; 428/32.1

(58) Field of Classification Search ..... 347/101, 347/105.5, 16, 19, 9, 100, 96, 95, 14; 425/32.1, 425/195; 428/195, 32.1; 235/492, 487, 494, 235/495; 355/40; 358/1.15; 348/552
See application file for complete search history.

(56) References Cited

U.S. PATENT DOCUMENTS

| | | | | |
|---|---|---|---|---|
| 4,659,213 | A | 4/1987 | Matsumoto | |
| 4,904,853 | A * | 2/1990 | Yokokawa | 235/487 |
| 5,085,529 | A | 2/1992 | McGourty et al. | |
| 5,198,652 | A * | 3/1993 | Rose | 235/492 |
| 5,371,561 | A * | 12/1994 | Sato et al. | 355/40 |
| 6,311,214 | B1 | 10/2001 | Rhoads | |
| 6,808,118 | B2 * | 10/2004 | Field | 235/494 |
| 6,827,418 | B2 * | 12/2004 | Otokita | 347/19 |
| 6,910,627 | B1 * | 6/2005 | Simpson-Young et al. | 235/381 |
| 2001/0022848 | A1 | 9/2001 | Rhoads | |

FOREIGN PATENT DOCUMENTS

| | | | |
|---|---|---|---|
| EP | 0 884 195 | A1 | 12/1998 |
| JP | 01-262176 | | 10/1989 |
| JP | 03-223741 | | 10/1991 |
| JP | 06-305166 | * | 11/1994 |
| JP | 2001-305166 | | 11/1994 |
| JP | 11-291682 | * | 10/1999 |

(Continued)

*Primary Examiner*—Manish S Shah
(74) *Attorney, Agent, or Firm*—Sughrue Mion, PLLC

(57) ABSTRACT

A printing medium with which various kinds of information relating to the printing medium can be held on the printing medium itself, an element provided in or on that printing medium, a printing apparatus for printing on that printing medium, and a computer system having such a printing apparatus and a computer main unit connected to that printing apparatus are realized. The printing medium has an element on which information can be written by the printing apparatus.

20 Claims, 31 Drawing Sheets

FOREIGN PATENT DOCUMENTS

| | | | |
|---|---|---|---|
| JP | 2001-291682 | | 10/1999 |
| JP | 2000-244856 | | 9/2000 |
| JP | 2000-296652 | | 10/2000 |
| JP | 2001-096814 | * | 4/2001 |
| JP | 2001-272734 | | 10/2001 |

* cited by examiner

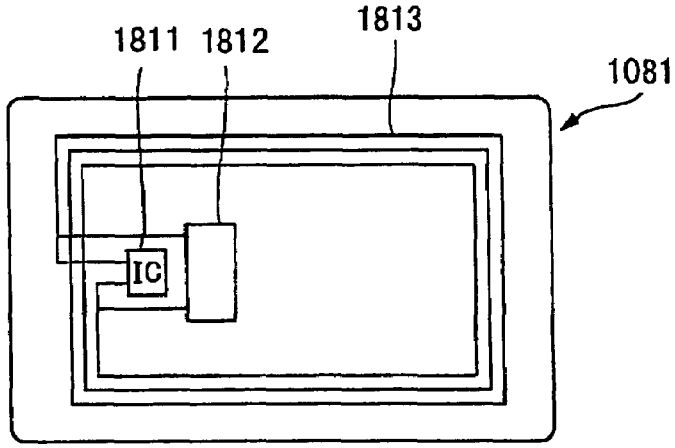
(a)
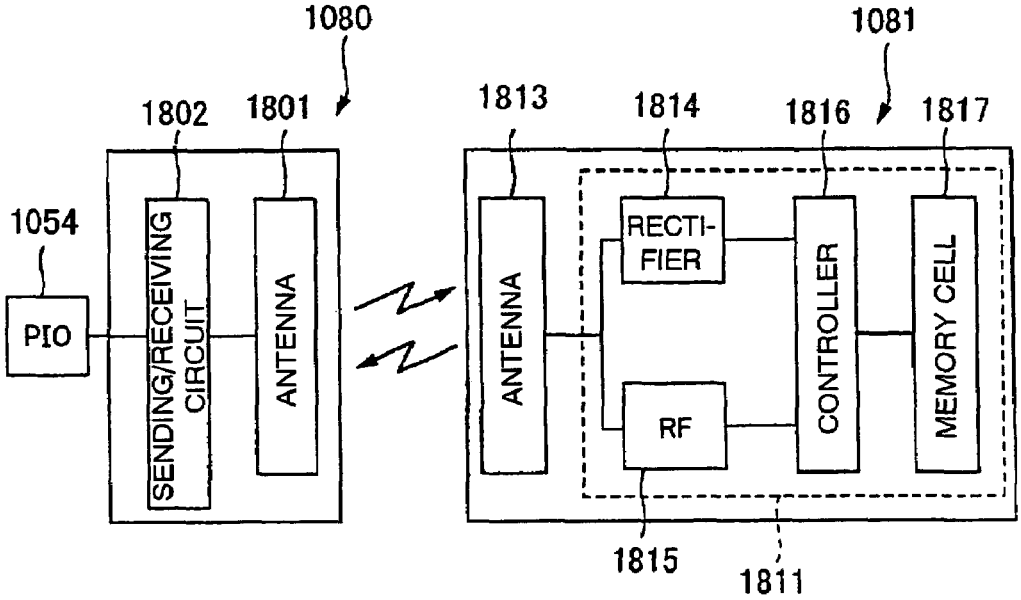
(b)
FIG.4

1817

| address | information contents (8 bits of information) |
|---|---|
| 00H | printing medium type |
| 01H | printing medium thickness |
| 02H | printing medium width |
| 03H | printing medium manufacturing date |
| 04H | printing medium LUT |
| 05H | printing apparatus information |
| 06H | digital camera information |
| 07H | printing date information |
| 08H | image data information |
| 09H ~ | image data |

1817R

1817W

FIG.5

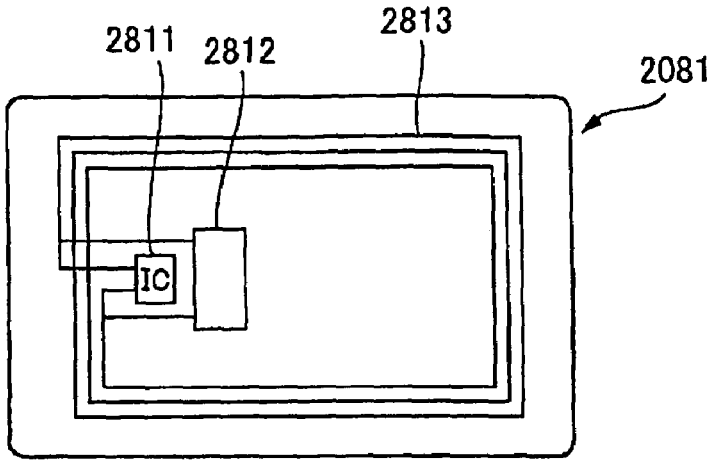
(a)
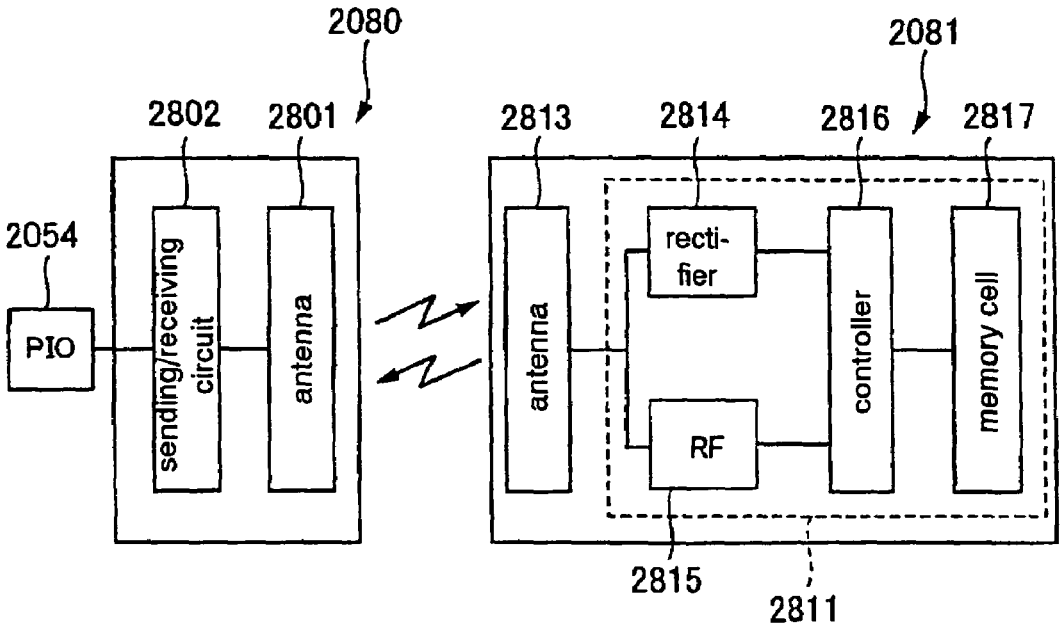
(b)
FIG.13

| address | information contents (8 bits of information) |
|---|---|
| 00H | printing medium type |
| 01H | printing medium thickness |
| 02H | printing medium width |
| 03H | printing medium manufacturing date |
| 04H | printing medium LUT |

FIG.14

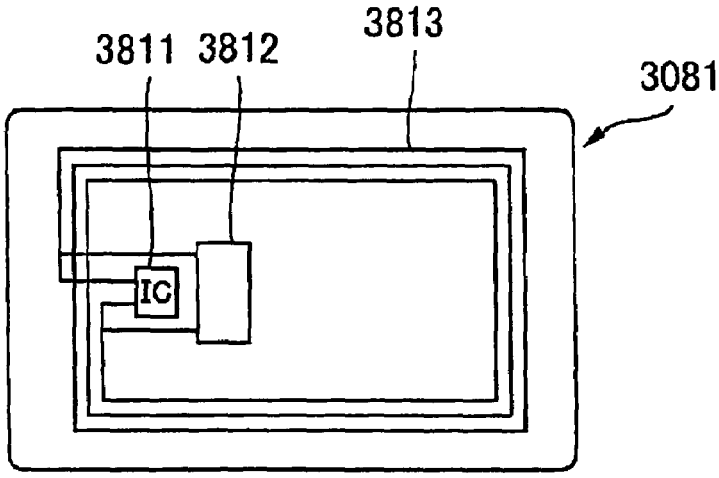
(a)
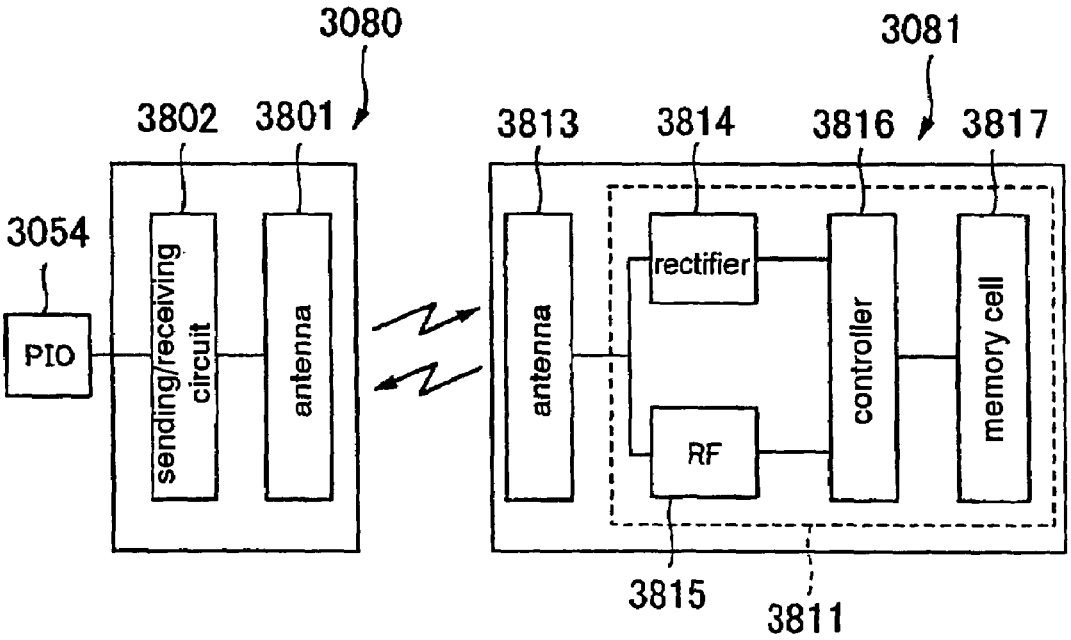
(b)
FIG.22

3817

| address | information contents (8 bits of information) |
|---|---|
| 00H | printing medium type |
| 01H | printing medium thickness |
| 02H | printing medium width |
| 03H | printing medium manufacturing date |
| 04H | printing medium LUT |
| 05H | date of image capture |
| 06H | model name of digital camera |
| 07H | shutter speed |
| 08H | aperture value |
| 09H | ISO sensitivity equivalent |
| 0AH | flash ON/OFF |
| 0BH ~ | image data |

3817R

3817W

FIG.23

(a)

| offset | meaning of information |
|---|---|
| 0 | manufacturer name 00x0 |
| 6 | reserve |
| 8 | entry number of local tag |
| 10 | local tag 1 |
| 22 | PrintMatching |
| ~ | ~ |
| 10+12*(N-1) | local tag N |

4114

4113 Makernote data storage region (b)

| offset | meaning of information |
|---|---|
| 0 | PrintMatching identifier |
| 8 | PIM Version information |
| 12 | Reserve |
| 14 | parameter designation number |
| 16 | first parameter number |
| 18 | first parameter setting value |
| 22 | second parameter number |
| 24 | second parameter setting value |
| 28 | third parameter number |
| 30 | third parameter setting value |
| ~ | ~ |
| n-2 | n-th parameter setting value |
| n | n-th parameter number |

4114 PrintMatching data storage region

FIG.30

PRINTED BODY, ELEMENT PROVIDED ON PRINTED BODY, PRINTER, AND COMPUTER SYSTEM

TECHNICAL FIELD

The present invention relates to a printing medium, an element provided in or on a printing medium, a printing apparatus and a computer system.

BACKGROUND ART (1) Information relating to a printing medium, that is, to printing media such as roll paper, can be held in a storage element provided in a portion of the roll paper unit or the like (for example the core portion of the roll paper), and can be read in by a printing apparatus. By automatically reflecting attribute information relating, for example, to the remaining amount of roll paper, the type of paper, its thickness, width or the like in the printing control, a high-quality printing result may easily be achieved.

However, in particular in the case of single-sheet media such as cut paper, instead of handling a large number of sheets together as a unit, individual sheets with differing attributes are often printed sheet by sheet. In those cases, ordinarily, the user must perform individual settings using a driver software of the printing apparatus on a screen of a personal computer or the like, which is extremely bothersome.

In recent years, many kinds of very small and thin memory elements have been developed that are configured of a planar antenna coil and capacitor and a miniature IC chip.

These are used for IC cards or the like and, provided with a semiconductor memory and a computer circuit, the elements themselves have a calculation processing function, and can send or receive data with a contact/noncontact read-write sensor. The information amount that they can hold is by far larger than that of printed information such as bar codes, and also the manufacturing costs are becoming inexpensive.

Now, it is conceivable to store various kinds of media attribute information beforehand in the printing media themselves, using such a compact memory element.

Furthermore, not only the attribute information of the printing media themselves as described above, but also information relating to the printing result may become important afterwards. Information relating to the printing result may be, for example, information about what kind of printing apparatus the printing was performed with, or information on what kind of data were printed and where they were stored on the hard disk of the computer. This information is important when it is necessary to obtain a printing result of the same image with the same quality at a later date. Now, relying merely on one's memory, one often tends to forget this information. Furthermore, even when the driver software of the printing apparatus has a function of storing this information, it cannot be utilized when printing with a different computer at a different place.

(2) Furthermore, as mentioned above, information relating to a printing medium, that is, to printing media such as roll paper, can be held in a storage element provided in a portion of the roll paper unit or the like (for example the core portion of the roll paper), and can be read in by a printing apparatus. By automatically reflecting attribute information relating, for example, to the remaining amount of roll paper, the type of paper, its thickness, width or the like in the printing control, it is easy to achieve a high-quality printing result.

However, in particular in the case of single-sheet media such as cut paper, individual sheets with differing attributes are often printed sheet by sheet. In those cases, ordinarily, the user must perform individual settings using the driver software of the printing apparatus on a screen of a personal computer or the like, which is extremely bothersome.

To address this problem, also for single-sheet media, the type of the printing medium (regular paper, glossy paper, OHP paper, etc.) can be read in by an optical sensor provided on the printing apparatus, and suitable printing control may be carried out. Furthermore, it is also known to provide information about the printing medium itself by printing a bar code or the like beforehand on the media themselves.

However, only extremely limited information, such as the glossiness or the transparence (in the case of OHP paper or the like), can be read out with an optical sensor from the light reflected by the media. Furthermore, the information amount that can be held by information printed as a bar code or the like is extremely small, and can be used only for very limited printing control. Furthermore, the reading process by an optical sensor largely varies, and inaccurate attribute information is often obtained.

In recent years, many kinds of very small and thin memory elements have been developed that are configured of a planar antenna coil and capacitor and a miniature IC chip.

These are used for IC cards or the like and, provided with a semiconductor memory and a computer circuit, the elements themselves have a calculation processing function, and can send or receive data with a contact/noncontact read-write sensor. The information amount that they can hold is by far larger than that of printed information such as bar codes, and also the manufacturing costs are becoming inexpensive.

(3) Furthermore, it is possible to take a picture with any of a variety of image-capturing devices, such as digital cameras, digital video cameras, or mobile phones equipped with a digital camera, and to print it onto a printing medium such as paper, with any kind of printing apparatus such as inkjet printer or laser beam printer, based on the image data obtained when taking the picture.

The image data obtained when taking the picture in some cases are sent to the printing apparatus and printed after reading them into a personal computer and correcting or editing them, and in other cases they are sent to the printing apparatus and printed not through a personal computer, but directly from the image-capturing device or via recording media.

In recent years, many kinds of very small and thin memory elements have been developed that are configured of a planar antenna coil and capacitor and a miniature IC chip. These are used for IC cards or the like and, provided with a semiconductor memory and a computer circuit, the elements themselves have a calculation processing function, and can send or receive data with a contact/noncontact read-write sensor. The information amount that they can hold is by far larger than that of printed information such as bar codes, and also the manufacturing costs are becoming inexpensive.

Sometimes, when viewing at a later date the printing medium that was printed based on the image data generated with the image-capturing device, one may want to know the image-capturing conditions used when taking the picture. For example, if one has taken a picture of Mt. Fuji with a digital camera and printed it on paper with an inkjet printer, and one views this paper print of Mt. Fuji at a later date, one may want to know the image-capturing conditions, such as on what day of what month of what year, using which model of digital camera, and what shutter speed the picture was taken.

In this respect, it is possible to print the image-capturing conditions, such as the date the picture was taken, together with the image when printing it onto the printing surface of a printing medium.

However, it is not preferable that the image-capturing conditions are printed overlapping the image.

Furthermore, when printing the image-capturing conditions such that they do not overlap with the image, then a region for printing the image-capturing conditions has to be reserved on the printing medium separately from the image printing region.

The present invention has been conceived in view of these issues (the issues stated under (1) to (3) above), and its object is to realize a printing medium with which various kinds of information relating to the printing medium can be held on the printing medium itself, an element provided in or on that printing medium, a printing apparatus for printing on that printing medium, and a computer system having such a printing apparatus and a computer main unit connected to that printing apparatus.

Furthermore, the present invention realizes a printing medium with which image-capturing conditions and output control information or the like can be suitably held on the printing medium itself, an element provided in or on such a printing medium, a printing apparatus for printing on that printing medium, and a computer system.

DISCLOSURE OF THE INVENTION

To solve the above-stated issues, a main aspect of the present invention is a printing medium having an element into which information can be written by a printing apparatus.

Furthermore, to solve the above-stated issues, another main aspect of the present invention is a printing medium that has an element into which information can be written and that is printed on by a printing apparatus, based on image data generated with an image-capturing device, wherein an image-capturing condition used when the image data were generated by the image-capturing device is written by the printing apparatus into the element.

Furthermore, to solve the above-stated issues, another main aspect of the present invention is a printing medium that has an element into which information can be written and that is printed on by a printing apparatus, wherein output control information controlling an output state of the image data in the printing apparatus is written by the printing apparatus into the element.

Features and objects of the present invention other than the above will become clear by reading the description of the present specification with reference to the accompanying drawings.

BRIEF DESCRIPTION OF DRAWINGS

FIG. 4 relates to the first embodiment; FIG. 4(*a*) is a top transparent view illustrating the configuration of the storage element, and FIG. 4(*b*) is a block diagram showing the internal configuration of the storage element and the sending/receiving section.

FIG. 5 relates to the first embodiment and is a diagram visualizing the information stored in the storage element.

FIG. 13 relates to the second embodiment; FIG. 13(*a*) is a top transparent view illustrating the configuration of the storage element, and FIG. 13(*b*) is a block diagram showing the internal configuration of the storage element and a reading sensor.

FIG. 14 relates to the second embodiment and is a diagram visualizing the information stored in the storage element.

FIG. 22 relates to the third embodiment; FIG. 22(*a*) is a top transparent view illustrating the configuration of the storage element, and FIG. 22(*b*) is a block diagram showing the internal configuration of the storage element and the sending/receiving section.

FIG. 23 relates to the third embodiment and is a diagram visualizing the information stored in the storage element.

FIG. 30 is a diagram illustrating the detailed hierarchical structure of an image file GF according to another embodiment.

Figure 1:
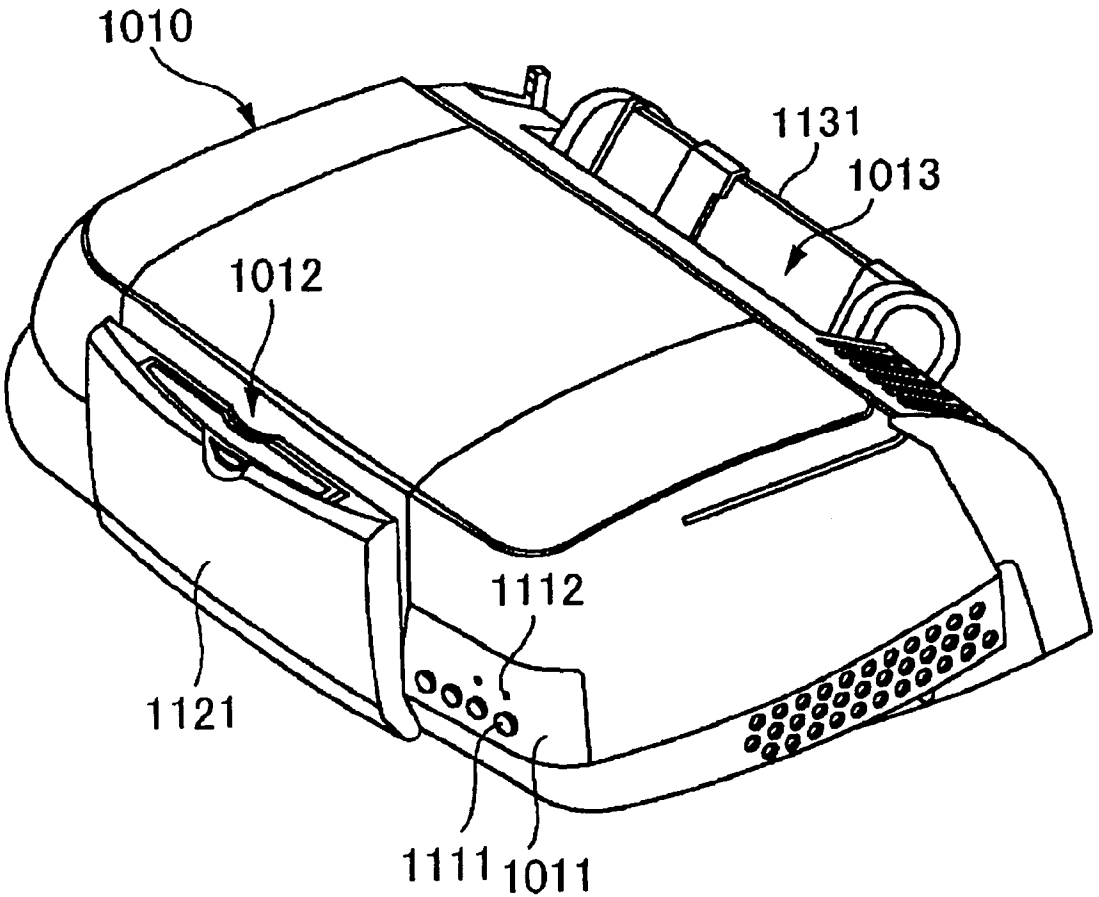
FIG. 1 relates to a first embodiment and diagrammatically shows the outer appearance of an inkjet printer.

The following is an index to the main numerals used in the figures:

1010 . . . printer main unit
1011 . . . operation panel
1012 . . . paper discharge section
1013 . . . paper supply section
1025 . . . capping device
1026 . . . pump unit
1027 . . . cap
1040 . . . carriage
1042 . . . platen
1043 . . . paper-feed motor
1044 . . . slide shaft
1045 . . . drive belt
1046 . . . pulley
1047 . . . encoder
1048 . . . gear mechanism
1050 . . . control circuit
1051 . . . CPU
1052 . . . PROM
1053 . . . RAM
1054 . . . peripheral input/output section (PIO)
1055 . . . timer
1056 . . . drive buffer
1057 . . . bus
1058 . . . oscillator
1059 . . . output distributor
1061 . . . carry driving roller
1062 . . . carry driven roller
1063 . . . paper detector
1064 . . . paper discharge driving roller
1065 . . . paper discharge driven roller
1080 . . . sending/receiving section
1081 . . . storage element
1082 . . . printing medium
1111 . . . control buttons
1112 . . . display lamp
1121 . . . paper discharge tray
1131 . . . paper supply holder
1621 . . . carry driven roller holder
1631 . . . lever
1801 . . . coil antenna
1802 . . . sending/receiving circuit
1811 . . . IC chip
1813 . . . antenna coil
1814 . . . rectifier
1815 . . . signal analyzer
1816 . . . controller
1817 . . . memory cell
1817R . . . read region
1817W . . . write region
PC . . . personal computer
INC 1, INC 2 . . . ink cartridges
ME . . . storage element
MEC . . . contact
IH1, IH2, IH3, IH4 . . . print heads
2010 . . . printer main unit
2011 . . . operation panel
2012 . . . paper discharge section
2013 . . . paper supply section
2025 . . . capping device
2026 . . . pump unit
2027 . . . cap
2040 . . . carriage
2042 . . . platen
2043 . . . paper-feed motor
2044 . . . slide shaft
2045 . . . drive belt
2046 . . . pulley
2047 . . . encoder
2048 . . . gear mechanism
2050 . . . control circuit
2051 . . . CPU
2052 . . . PROM
2053 . . . RAM
2054 . . . peripheral input/output section (PIO)
2055 . . . timer
2056 . . . drive buffer
2057 . . . bus
2058 . . . oscillator
2059 . . . output distributor
2061 . . . carry driving roller
2062 . . . carry driven roller
2063 . . . paper detector
2064 . . . paper discharge driving roller
2065 . . . paper discharge driven roller
2080 . . . reading sensor
2081 . . . storage element
2082 . . . printing medium
2111 . . . control buttons
2112 . . . display lamp
2121 . . . paper discharge tray
2131 . . . paper supply holder
2621 . . . carry driven roller holder
2631 . . . lever
2801 . . . coil antenna
2802 . . . sending/receiving circuit
2811 . . . IC chip
2813 . . . antenna coil
2814 . . . rectifier
2815 . . . signal analyzer
2816 . . . controller
2817 . . . memory cell
3010 . . . printer main unit
3011 . . . operation panel
3111 . . . control buttons
3112 . . . display lamp
3012 . . . paper discharge section
3121 . . . paper discharge tray
3013 . . . paper supply section
3131 . . . paper supply holder
3132 . . . paper supply roller
3025 . . . capping device
3026 . . . pump unit
3027 . . . cap
3040 . . . carriage
3042 . . . platen
3043 . . . paper-feed motor
3044 . . . slide shaft
3045 . . . drive belt
3046 . . . pulley

3047 . . . encoder
3048 . . . gear mechanism
3050 . . . control circuit
3051 . . . CPU
3052 . . . PROM
3053 . . . RAM
3054 . . . peripheral input/output section (PIO)
3055 . . . timer
3056 . . . drive buffer
3057 . . . bus
3058 . . . oscillator
3059 . . . output distributor
3061 . . . carry driving roller
3062 . . . carry driven roller
3621 . . . carry driven roller holder
3063 . . . paper detector
3631 . . . lever
3064 . . . paper discharge driving roller
3065 . . . paper discharge driven roller
3080 . . . sending/receiving section
3801 . . . coil antenna
3802 . . . sending/receiving circuit
3081 . . . storage element
3811 . . . IC chip
3813 . . . antenna coil
3814 . . . rectifier
3815 . . . signal analyzer
3816 . . . controller
3817 . . . memory cell
3817R . . . read region
3817W . . . write region
3082 . . . printing medium
4010 . . . image file
4101 . . . control information storage region
4102 . . . image data storage region
4011 . . . Exit file (image file)
4111 . . . JPEG image data storage region
4112 . . . extended information storage region
4113 . . . Makernote storage region
4114 . . . PrintPerfect tag
4022 . . . digital still camera

BEST MODE FOR CARRYING OUT THE INVENTION

===Overview of the Disclosure===

At least the following matters will be made clear by the disclosure below.

A printing medium has an element into which information can be written by a printing apparatus.

With such a printing medium various kinds of attribute information relating to the printing result, which is easy to forget or lose, can be stored by writing it into a writable element which is provided in or on the printing medium, so that it is possible to utilize this attribute information, which becomes important when printing the same data at a later date.

Furthermore, information for specifying a printing apparatus that has printed onto the printing medium may be written into the element.

Since some of the printing information, such as the color conversion information when printing, differs for each type of printing apparatus, it is difficult to reproduce the same printing result if one forgets which type of printing apparatus was used the previous time. To address this problem, with this printing medium, it is possible to write and store information for specifying the printing apparatus that was used for printing into the writable element which is provided in or on the printing medium, so that when printing the same data at a later date, it is easy to specify the same printing apparatus as the previous time, and it is easy to utilize its attribute information.

Furthermore, information for specifying a digital camera that has been used when recording image data that are printed onto the printing medium may be written into the element.

Information relating to image processing, such as color correction, differs for each digital camera, so that if one forgets the type of the digital camera with which the image data were recorded, then it becomes difficult to reproduce the same image processing result, and thus the same printing result. To address this problem, with this printing medium, it is possible to write and store information specifying the digital camera that recorded the image data into the writable element which is provided in or on the printing medium, so that when image processing and printing the same image data at a later date, it is easy to specify the same digital camera as the previous time, and it is easy to utilize its attribute information.

Furthermore, information for specifying a date on which printing was performed on the printing medium may be written into the element.

With such a printing medium, if one wants to determine, for example, how deterioration of image quality of the printed image depends on the passage of time, then it is easy to look up the printing date by reading out the printing date information written into the element.

Furthermore, information for specifying image data that are printed onto the printing medium may be written into the element.

With such a printing medium, it is possible to write and store information for specifying the image data that are printed (for example, the file name of the image file, or the path name of the file on the computer hard disk) into a writable element which is provided in or on the printing medium, so that the image data of the image printed onto the printing medium can be easily specified at a later date without relying on one's memory.

Furthermore, image data that are printed onto the printing medium may be written into the element.

If one wants to print the same image at a later date, then this can of course be done by outputting it again with a printing apparatus from the computer on which the original image is stored. However, if an additional print-out suddenly has become necessary at a remote location where that computer is not accessible, then it cannot be printed. If one carries the printing medium, which is the printing result, then it is possible to duplicate it by reading the image of the printed image using a copier or a scanner, but the image gradually deteriorates when repeatedly reading with a copier or a scanner and printing. To address this problem, with this printing medium, it is possible to write and store into the storage element the image data themselves that have been written onto the printing medium, so that if those image data are read with any kind of reading means and printed out, it is easy to obtain a printing result without image deterioration.

Furthermore, image data that are printed onto the printing medium may be stored in the element, and the stored image data may be read by a printing apparatus provided with image data reading means and into that printing apparatus.

With such a printing medium, it is easy to obtain a printing result without image deterioration, by reading the image data in the storage element in which the image data printed onto the printing medium have been stored and printing them.

Furthermore, a thickness of the printing medium may be at least 0.5 mm.

With such a printing medium having at least a certain thickness, such as thick paper, it is easy to embed the element. Moreover, even with a deformation-resistant storage element that does not have a flexible structure but a sturdy structure, it is possible to prevent deformations and damage of the element during the printing process by making the paper supply structure of the printing apparatus linear.

Furthermore, the printing medium may be printed on without being cut by the printing apparatus.

If it is a printing medium that can be printed on without being cut by the printing apparatus, then the above-noted effects can be displayed particularly effectively.

Furthermore, a thickness of a printing medium may be at least 0.5 mm, an element for storing information about the printing medium is provided, information for specifying a printing apparatus that has printed onto the printing medium, information for specifying a digital camera that has been used when recording image data that are printed onto the printing medium, information for specifying a date on which printing was performed on the printing medium, and image data that are printed onto the printing medium are written into the element, and the written image data are read by a printing apparatus provided with image data reading means and into that printing apparatus.

With this configuration, it is a printing medium with which it is easy to embed the element and with which it is possible to print without deformation or damage even if the storage element has a sturdy structure, and it is easy to obtain a printing result with the same quality as the previous printing result without image deterioration due to reading with a scanner, because it is possible to read and print the image data in the storage element storing the image data themselves that are printed on the printing medium, while making it easy to utilize printing attribute information that is different for each printing apparatus, such as color conversion information, image processing information that is different for each digital camera, such as color correction, and printing date information.

Furthermore, a printing medium provided with an element that can store information about the printing medium.

With such a printing medium, it is possible to store information relating to the printing medium that is more detailed and accurate than information that can be read from the printing medium itself using an optical sensor or the like, so that it is possible to perform a more detailed and accurate control of the print heads of the printing apparatus by acquiring this information. Moreover, the printing medium itself is provided with the storage element, so that the user does not need to enter detailed information relating to the printing medium one by one from a printer setting screen or the like on a personal computer, and the printing control can be easily carried out.

Furthermore, the element may be provided in or on a section of the printing medium that is at the front of the printing medium when the printing medium is being inserted into the printing apparatus.

With such a printing medium, the information written into the storage element of the printing medium can be read out at an early point in time, and there is no need to perform an operation of returning the printing medium in the opposite direction during the paper supply operation of the printing medium.

Furthermore, a thickness of the printing medium may be at least 0.5 mm.

Thus, with a printing medium having at least a certain thickness, such as thick paper, it is easy to embed the element. Moreover, even with a deformation-resistant storage element that does not have a flexible structure but a sturdy structure, it is possible to prevent deformations and damage of the element during the printing process by making the paper supply structure of the printing apparatus linear.

Furthermore, information for specifying a type of the printing medium, information for specifying a thickness of the printing medium, information for specifying a width of the printing medium, information for specifying a date of manufacture of the printing medium, or information that is referred to when performing a color conversion in accordance with the printing medium may be stored in the element.

With such a printing medium, it is possible to perform a more detailed and accurate printing control and to realize a high-quality printing result by storing information that is more detailed and accurate than information that can be read using an optical sensor or the like in the element.

Furthermore, the information stored in the element may be read into the printing apparatus with image data reading means provided on that printing apparatus.

With such a printing medium, detailed print settings that conventionally used to be performed by the user one by one on a personal computer screen can be reflected in the printing control by letting the printing apparatus read the printing information directly from the printing medium, so that accurate and detailed printing control becomes easy and high-quality printing results can be attained.

Furthermore, the reading means may be noncontact reading means.

With such a printing medium, there is no need to bring the element and the reading means into contact, so that the configuration becomes simple.

Furthermore, the printing medium may be printed on without being cut by the printing apparatus.

If it is a printing medium that can be printed on without being cut by the printing apparatus, then the above-noted effects can be displayed particularly effectively.

Furthermore, the printing apparatus may have a print head that can be moved to print on the printing medium, and carrying and positioning means for carrying the printing medium in a direction that intersects with a movement direction of the print head and for positioning the printing medium, and the information stored in the element may be read into the printing apparatus with reading means that are provided upstream from the carrying and positioning means with respect to a direction in which the printing medium is carried by the carrying and positioning means.

With such a printing medium, information stored in the storage element can be read out by the printing apparatus at an early time, so that accurate settings for the printing control can be performed.

Furthermore, the printing apparatus may have a print head that can be moved to print on the printing medium, and the information stored in the element may be read into the printing apparatus with reading means that move together with the print head.

With such a printing medium, even when shape and dimensions of the printing medium are changed, this can be made to read the information in the storage element, and sophisticated printing control can be performed.

Furthermore the element may be provided in or on a section of the printing medium that is at the front of the printing medium when the printing medium is being inserted into the printing apparatus, a thickness of the printing medium may be at least 0.5 mm, information for specifying a type of the printing medium, information for specifying a thickness of the printing medium, information for specifying a width of the printing medium, information for specifying a date of manufacture of the printing medium, and information that is referred to when performing a color conversion in accordance with the printing medium may be stored in the element, and the information stored in the element may be read into the printing apparatus with reading means of a noncontact type provided on that printing apparatus.

With such a printing medium, the information written into the storage element of the printing medium can be read out at an early point in time, and there is no need to perform an operation of returning the printing medium in the opposite direction during the paper supply operation of the printing medium. Moreover, since the printing medium has at least a certain thickness, such as thick paper, it is easy to embed the element, and even with a deformation-resistant storage element that does not have a flexible structure but a sturdy structure, it is possible to prevent deformations and damage of the element during the printing process by making the paper supply structure of the printing apparatus linear. Moreover, it is possible to perform a more detailed and accurate printing control and to realize a high-quality printing result by storing in the element, information that is more detailed and accurate than information that can be read using an optical sensor or the like. Moreover, reading with noncontact reading means of a simple configuration instead of manual entry by the user, the printing apparatus reads the printing information directly from the printing medium and reflects it in the printing control, so that accurate and detailed printing control can be easily carried out, and high-quality printing results can be attained.

A printing medium that has an element into which information can be written and that is printed on by a printing apparatus based on image data generated with an image-capturing device, wherein an image-capturing condition used when the image data were generated by the image-capturing device is written by the printing apparatus into the element.

With such a printing medium, an image-capturing condition used when the image data were generated with the image-capturing device can be stored by writing it into a writable element which is provided in or on the printing medium, so that even without printing the image-capturing condition onto the printing medium, the image-capturing condition can be easily determined at a later date.

Furthermore, the image-capturing device may be a digital camera.

With such a printing medium, an image-capturing condition used when the image data were generated by the digital camera can be stored by writing it into a writable element which is provided in or on the printing medium, so that even without printing the image-capturing condition onto the printing medium, the image-capturing condition used when taking the picture with the digital camera can be easily determined at a later date.

Furthermore, information for specifying the date when the image data have been generated by the image-capturing device may be written by the printing apparatus as the image-capturing condition into the element.

With such a printing medium, the date when the image data were generated by the image-capturing device can be stored by writing it into a writable element which is provided in or on the printing medium, so that even without printing the date the picture was taken onto the printing medium, the date the picture was taken can be easily determined at a later date.

Furthermore, information for specifying a model of a digital camera serving as the image-capturing device may be written by the printing apparatus as the image-capturing condition into the element.

With such a printing medium, the model of the digital camera serving as the image-capturing device can be stored by writing it into a writable element which is provided in or on the printing medium, so that even without printing the date the picture was taken onto the printing medium, the model of the digital camera can be easily determined at a later date.

Furthermore, information for specifying a shutter speed, when taking a picture, of a digital camera serving as the image-capturing device may be written by the printing apparatus as the image-capturing condition into the element.

With such a printing medium, the shutter speed, when taking a picture, of a digital camera serving as the image-capturing device can be stored by writing it into a writable element which is provided in or on the printing medium, so that even without printing the shutter speed onto the printing medium, the shutter speed can be easily determined at a later date.

Furthermore, information for specifying an aperture value of a digital camera serving as the image-capturing device, when taking a picture, may be written by the printing apparatus as the image-capturing condition into the element.

With such a printing medium, the aperture value of a digital camera serving as the image-capturing device, when taking a picture, can be stored by writing it into a writable element which is provided in or on the printing medium, so that even without printing the aperture value onto the printing medium, the aperture value can be easily determined at a later date.

Furthermore, information for specifying an ISO sensitivity equivalent of a digital camera serving as the image-capturing device may be written by the printing apparatus as the image-capturing condition into the element.

With such a printing medium, the ISO sensitivity equivalent of the digital camera serving as the image-capturing device can be stored by writing it into a writable element which is provided in or on the printing medium, so that even without printing the ISO sensitivity equivalent onto the printing medium, the ISO sensitivity equivalent can be easily determined at a later date.

Furthermore, information for specifying whether a flash has been used or not when taking a picture with a digital camera serving as the image-capturing device may be written by the printing apparatus as the image-capturing condition into the element.

With such a printing medium, whether a flash has been used or not when taking a picture with a digital camera serving as the image-capturing device can be stored by writing it into a writable element which is provided in or on the printing medium, so that even without printing flash information onto the printing medium, such flash information can be easily determined at a later date.

Furthermore, image data printed on the printing medium may be written into the element.

If one wants to reprint the same image at a later date, then this can of course be done by outputting it again with a printing apparatus from the computer on which the original image is stored. However, if an additional print-out suddenly has become necessary at a remote location where that computer is not accessible, then it cannot be printed. If one carries the printing medium, which is the printing result, then it is possible to duplicate it by reading the image of the printed image using a copier or a scanner, but the image gradually deteriorates when repeatedly reading with a copier or a scanner and printing. To address this problem, with this printing medium, it is possible to write and store into the element of the printing medium the image data themselves that have been written onto the printing medium, so that if those image data are read with any kind of reading means and printed out, it is easy to obtain a printing result without image deterioration.

Furthermore, an image-capturing condition used when the image data were generated with the image-capturing device may be written by the printing apparatus into the element in a noncontact state.

Furthermore, a thickness of the printing medium may be at least 0.5 mm.

Thus, with a printing medium having at least a certain thickness, such as thick paper, it is easy to embed the element. Moreover, even with a deformation-resistant storage element that does not have a flexible structure but a sturdy structure, it is possible to prevent deformations and damage of the element during the printing process by making the paper supply structure of the printing apparatus linear.

Furthermore, the printing medium may be printed on without being cut by the printing apparatus.

If it is a printing medium that can be printed on without being cut by the printing apparatus, then the above-noted effects can be displayed particularly effectively.

Furthermore, printing may be performed by the printing apparatus on the entire surface of the printing medium, based on the image data that have been generated with the image-capturing device.

If printing is performed on the entire surface of the printing medium, and if the printing conditions are printed onto the printing medium, then a problem may occur where the printing conditions and the image are printed to overlap. However, this problem can be prevented by writing and storing, into the writable element provided in or on the printing medium, the image-capturing conditions used when the image data were generated with the image-capturing device.

Furthermore, it is also possible to realize a printing medium that has an element into which information can be written and that is printed on by a printing apparatus based on image data generated with a digital camera, wherein: information for specifying a date when the image data have been generated by the digital camera as well as the image data are written by the printing apparatus into the element in a noncontact state, a thickness of the printing medium is at least 0.5 mm, and the entire surface of the printing medium is printed on by the printing apparatus based on the image data that have been generated by the image-capturing device, without the printing medium being cut by the printing apparatus.

Furthermore, a printing medium that has an element into which information can be written and that is printed on by a printing apparatus, wherein output control information for controlling an output state of an image data in the printing apparatus is written by the printing apparatus into the element.

Furthermore, the printing apparatus may read the output control information from an image file in which the image data are stored, and write the read output control information into the element.

Furthermore, the output control information may be data for controlling image processing with the printing apparatus by specifying gamma value, color space, contrast, color balance, sharpness, color correction, and accent color.

Furthermore, the output control information may be data for controlling image output processing with the printing apparatus by specifying print media, resolution, and operative direction of a print head.

Furthermore, the image file may be an image file that has been generated with a digital camera.

Furthermore, it is also possible to realize an element capable of being provided in or on a printing medium, wherein information can be written in the element with a printing apparatus.

Furthermore, it is also possible to realize an element capable of being provided in or on a printing medium, and in which information about the printing medium can be stored in the element.

Furthermore, it is also possible to realize an element capable of being provided in or on a printing medium, wherein, after the element has been provided in or on the printing medium, an image-capturing condition used when the image data were generated with the image-capturing device can be written in the element with the printing apparatus.

Furthermore, it is also possible to realize a printing apparatus for printing onto a printing medium, which has writing means for writing information into an element which is provided in or on the printing medium.

Furthermore, this printing apparatus may have an ink ejection head for ejecting ink onto the printing medium, and the writing means may be provided upstream from the ink ejection head with respect to a direction in which the printing medium is carried.

By providing the writing means upstream from the ink ejection head with respect to a direction in which the printing medium is carried, information can be written onto the element before printing by ejecting ink with the ink ejection head.

Furthermore, in this printing apparatus, when the printing medium is positioned in a predetermined position with respect to the printing apparatus, the writing means may write information into the element, and, in that position, information stored in that element can be read.

With such a printing apparatus, when the printing medium has been positioned in a certain position with respect to the printing apparatus, information can be written and read into or from the element.

Furthermore, this printing apparatus may have carrying means for carrying a printing medium that has been set in a horizontal orientation while maintaining it in that horizontal orientation.

With such a printing apparatus, information can be effectively written into the element which is provided in or on the printing medium, even when the sturdiness of the printing medium is high.

Furthermore, it is also possible to realize a printing apparatus for printing onto a printing medium, having writing means for writing image data into an element which is provided in or on the printing medium, and reading means for reading the image data that has been written into the element.

Furthermore, it is also possible to realize a printing apparatus for printing onto a printing medium, having reading means for reading information about the printing medium that has been stored in an element which is provided in or on the printing medium.

Furthermore, it is also possible to realize a printing apparatus having a print head that can be moved to print onto the printing medium, and carrying and positioning means for carrying the printing means in a direction that intersects with a movement direction of the print head and for positioning the printing medium, wherein reading means are provided upstream from the carrying and positioning means with respect to a direction in which the printing medium is carried by the carrying and positioning means.

Furthermore, it is also possible to realize a printing apparatus having a print head that can be moved to print on the printing medium, wherein the reading means moves together with the print head.

Furthermore, it is also possible to realize a printing apparatus wherein the reading means is reading means of a noncontact type.

Furthermore, it is also possible to realize a printing apparatus having carrying means for carrying a printing medium that has been set in a horizontal orientation while maintaining it in that horizontal orientation.

With such a printing apparatus, information can be effectively written into the element which is provided in or on the printing medium, even when the sturdiness of the printing medium is high.

Furthermore, it is also possible to realize a printing apparatus for printing onto a printing medium based on image data generated with an image-capturing device, wherein the printing apparatus is capable of writing an image-capturing condition used when the image data were generated by the image-capturing device into an element which is provided in or on the printing medium.

Furthermore, in this printing apparatus, the image-capturing device may be a digital camera.

Furthermore, in this printing apparatus, information for specifying a date when the image data were generated by the image-capturing device may be written into said element as the image-capturing condition.

Furthermore, in this printing apparatus, information for specifying a model of a digital camera serving as the image-capturing device may be written as the image-capturing condition into the element.

Furthermore, in this printing apparatus, information for specifying a shutter speed during picture taking of a digital camera serving as the image-capturing device may be written into the element as the image-capturing condition.

Furthermore, in this printing apparatus, information for specifying an aperture value during picture taking of a digital camera serving as the image-capturing device may be written into the element as the image-capturing condition.

Furthermore, in this printing apparatus, information for specifying an ISO sensitivity equivalent of a digital camera serving as the image-capturing device may be written into the element as the image-capturing condition.

Furthermore, in this printing apparatus, information for specifying whether a flash has been used or not when taking a picture with a digital camera serving as the image-capturing device may be written into the element as the image-capturing condition.

Furthermore, in this printing apparatus, image data printed on the printing medium may be written into the element.

Furthermore, in this printing apparatus, an image-capturing condition used when the image data were generated with the image-capturing device may be written in a noncontact state into said element.

Furthermore, in this printing apparatus, printing is performed without cutting the printing medium.

Furthermore, in this printing apparatus, printing may be performed on the entire surface of the printing medium based on the image data that have been generated with the image-capturing device.

Furthermore, this printing apparatus may have an ink ejection head for ejecting ink onto the printing medium, and writing means for writing the image-capturing condition into the element may be provided upstream from the ink ejection head with respect to a direction in which the printing medium is carried.

By providing the writing means upstream from the ink ejection head with respect to the direction in which the printing medium is carried, it becomes possible to write information into the element before printing by ejecting ink with the ink ejection head.

Furthermore, this printing apparatus may have carrying means for carrying a printing medium that has been set in a horizontal orientation while maintaining it in that horizontal orientation.

With such a printing apparatus, information can be effectively written into the element which is provided in or on the printing medium, even when the sturdiness of the printing medium is high.

Furthermore, a printing apparatus for printing on a printing medium based on image data, wherein the printing apparatus writes output control information for controlling an output state of an image data in the printing apparatus into an element which is provided in or on the printing medium.

Furthermore, the printing apparatus may read the output control information from an image file in which the image data are stored, and write the read output control information into the element.

Furthermore, the output control information may be data for controlling image processing with the printing apparatus by specifying gamma value, color space, contrast, color balance, sharpness, color correction, and accent color.

Furthermore, the output control information may be data for controlling image output processing with the printing apparatus by specifying print media, resolution, and operative direction of a print head.

Furthermore, the image file may be an image file that has been generated with a digital camera.

Furthermore, it is also possible to realize a computer system having a computer main unit and a printing apparatus that is capable of being connected to this computer main unit and printing on a printing medium, wherein the printing apparatus has writing means for writing information into an element which is provided in or on the printing medium.

Furthermore, it is also possible to realize a computer system having a computer main unit and a printing apparatus that is capable of being connected to this computer main unit and printing on a printing medium, wherein the printing apparatus has reading means for reading information about the printing medium that is stored in an element which is provided in or on the printing medium.

Furthermore, it is also possible to realize a computer system having a computer main unit and a printing apparatus that is capable of being connected to this computer main unit and printing on a printing medium based on image data that have been generated with an image-capturing device, wherein the printing apparatus is capable of writing an image-capturing condition used when the image data were generated with the image-capturing device into an element which is provided in or on the printing medium.

FIRST EMBODIMENT

===Overview of Inkjet Printer===

The following explains an overview of an inkjet printer serving as a printing apparatus, which is a main application object of the present invention. FIG. 1 diagrammatically shows the outer appearance of an inkjet printer.

Here, a color inkjet printer is shown. This color inkjet printer 1010 is an inkjet printer that can output color images, and forms images by ejecting four colors of color ink, for example cyan (C), magenta (M), yellow (Y), and black (K), onto a printing medium such as cut paper so as to form dots. It should be noted that in addition to these four colors it is also possible to use light cyan (LC), light magenta (LM), and dark yellow (DY) as color inks.

As shown in FIG. 1, the color printer 1010 has a paper supply structure by which cut paper that is supplied from above its rear side is discharged from its front side. The front side of the main printer unit 1010 is provided with an operation panel 1011 and a paper discharge section 1012, and its rear side is provided with a paper supply section 1013. The operation panel 1011 is provided with a variety of control buttons 1111 and display lamps 1112. The paper discharge section 1012 is provided with a paper discharge tray 1121 blocking the paper discharge opening when the printer is not in use.

The paper supply section 1013 is provided with a paper supply tray 1131 for holding cut paper, which is not shown in the drawings. It should be noted that cut paper refers to paper that has been cut in advance to predetermined dimensions, and is a single-sheet printing medium that is not cut by the color printer 1010.

===Configuration of the Paper Supply Mechanism===

Figure 2:
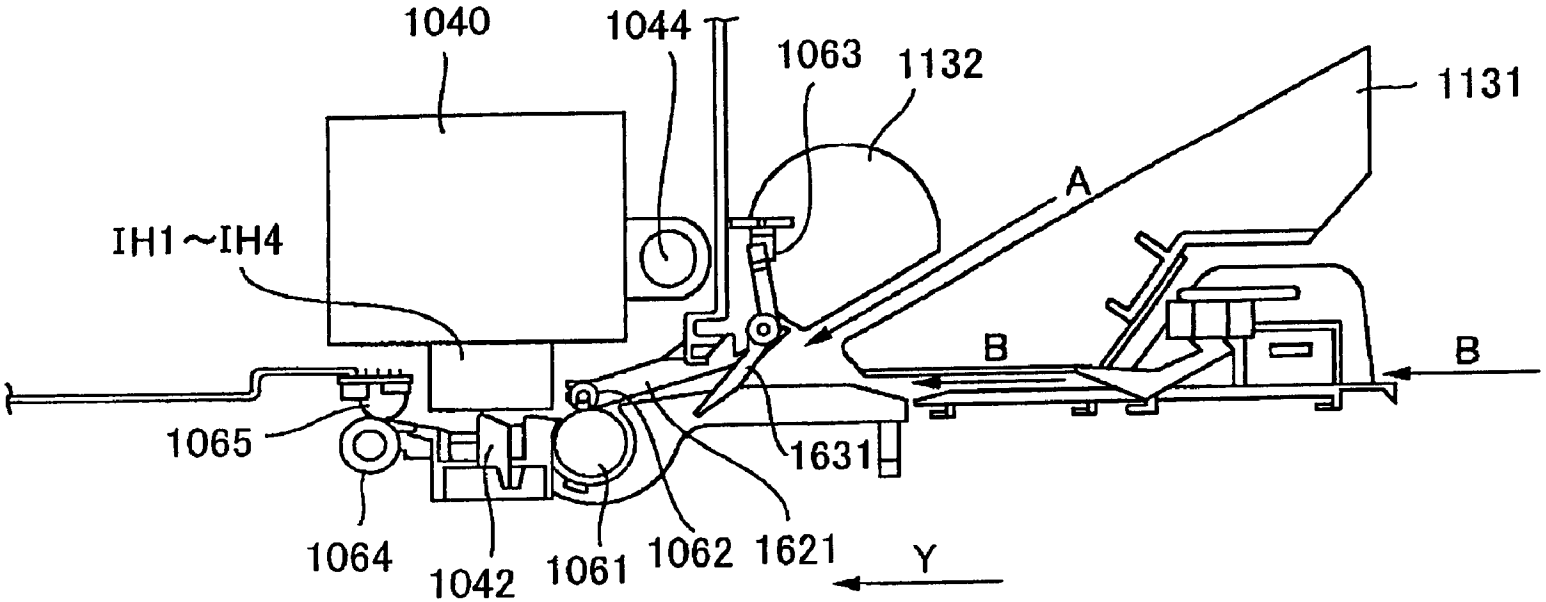
FIG. 2 relates to the first embodiment and is a cross-sectional view of an essential portion of an inkjet printer, illustrating two paper supply mechanisms.

The color printer 1010 of the present embodiment is configured to have, in particular, one more paper supply path (not shown in FIG. 1), which is also called a "straight path." This is a paper supply mechanism with which printing media having a certain thickness and hardness, such as thick paper, can be supplied manually. With this straight path mechanism, also printing media of irregular dimensions and shapes, such as CD-Rs, can be placed on a printing medium feeding tray (not shown in the drawings) and supplied, so that it is possible to print without cutting the printing media. FIG. 2 is a cross-sectional view of an essential portion of the printer 1010, illustrating these two paper supply mechanisms.

In the color printer 1010, a carriage 1040, which is supported by a slide shaft 1044 and moves in a slide shaft direction (main scanning direction), is provided as means for printing on a printing medium, and heads IH1 to IH4 that print by ejecting ink onto the printing medium are mounted to this carriage 1040. In opposition to the heads IH1 to IH4, a platen 1042 is provided that defines a gap between the head surfaces of the heads IH1 to IH4 and the printing medium. Moreover, the printing medium is printed on by letting the heads IH1 to IH4 eject ink onto the printing medium while carrying the carriage 1040 in the main scanning direction and intermittently carrying the printing medium between the carriage 1040 and the platen 1042 in a paper-feed direction Y.

The paper supply tray 1131 is configured such that it can supply printing media of cut paper, such as regular paper or photo paper, and it is provided with an ASF (auto sheet feeder) for automatically supplying the printing medium. The ASF is an automatic paper supply mechanism having a paper supply roller 1132 provided on the paper supply tray 1131 and a separation pad, which is not shown in the drawings. The paper supply roller 1132 has a substantially D-shaped cross section, and is rotated by the rotational driving force of a stepping motor or the like. Moreover, the rotational driving force of the paper supply roller 1132 and the friction resistance of the separation pad prevent a plurality of printing media from being supplied together.

Printing media that are automatically paper-fed by the ASF along the path indicated by the arrow A are intermittently carried for a predetermined paper feed amount towards the print execution area by printing medium carrying and positioning means disposed downstream in the paper-feed direction Y from the paper supply roller 1132.

A carry driving roller 1061 and carry driven rollers 1062 are provided as the carrying and positioning means for intermittently carrying and positioning the printing medium in the paper-feed direction Y. The carry driving roller 1061 is rotated by a paper feed motor, such as a stepping motor, and the printing medium is carried in the paper-feed direction Y by the rotation of the carry driving roller 1061. The carry driven rollers 1062 are axially supported on a plurality of carry driven roller holders 1621. When the printing medium is carried by the rotation of the carry driving roller 1061, the carry driven rollers 1062 follow this rotation.

A paper detector 1063 that is publicly known from the conventional art is disposed between the paper supply roller 1132 and the carry driving roller 1061. The paper detector 1063 has a lever 1631 provided with the property to restore itself to an upright position and pivotably supported such that it protrudes into the carrying path of the printing medium and such that it can turn only in the recording paper carrying direction. The paper detector 1063 has a configuration with which the lever 1631 turns when the tip of the lever 1631 is pushed by a printing medium, thus detecting the printing medium. The paper detector 1063 detects the leading edge position and the trailing edge position of the printing medium that has been supplied by the paper supply roller 1132. The printing region is decided and printing is executed in accordance with the detected positions.

A paper discharge driving roller 1064 and paper discharge driven rollers 1065 are provided as means for discharging printed printing media. The paper discharge driving roller 1064 is rotated by the rotation driving force of a stepping motor, for example, and rotation of the paper discharge driving roller 1064 discharges the recorded material in the paper-feed direction Y. The paper discharge driven rollers 1065 are teethed rollers that have a plurality of teeth on their circumferences, and the tips of these teeth are sharpened acutely such that they come in point contact with the recording surface of the printing medium. The paper discharge driven rollers 1065 are rotated by following when the printing medium is discharged due to the rotation of the discharge driving roller 1064.

In addition to the paper supply path (the path indicated by the arrow marked with the letter A) due to the above-described ASF, the printer 1010 is further equipped with a paper supply path for supplying printing media with little flexibility, such as thick paper in which a storage element is embedded. In the figure, this paper supply path is indicated by the arrow marked with the letter B. The printer 1010 can also print on printing media supplied from the paper supply path marked by the arrow B, just like it can print on printing media that are supplied from the ASF.

Furthermore, the printer 1010 is provided with a carry driven roller release mechanism, not shown in the drawings. When setting the printing medium in the set position, the carry driven roller 1062 is held in a state separated from the carry driving roller 1061 (in a released stated), and after the printing medium has been inserted into the paper supply path and the positioning in the printing set position has finished, this released state is cancelled, and the carry driven rollers 1062 return to a state in which they are forced to move by the carry driving roller 1061. Here, when the printing medium is being set in the printing set position, the printer is for a while in an operation-stop state, so that for printing media equipped with a storage element, information can be read from and/or written into a storage element using this temporary stopped state.

Although it is not shown in the figure, a sending/receiving section serving as reading/writing means for the storage element of the printing medium is disposed near the point where the paper supply path of arrow B merges with the paper supply path of arrow A, that is, above the vicinity of the paper detector 1063. This sending/receiving section, is arranged at a location in which it squarely faces the storage element at a position in which the printing medium is in a temporary stopped state. Details regarding the configuration and the arrangement of the sending/receiving section are explained further below.

It should be noted that the paper supply mechanism (carrying means) for carrying the printing medium over the path indicated by the arrow marked with the letter B carries a printing medium that is set in horizontal orientation while maintaining it in that horizontal orientation, so that it is possible to effectively write information on or read information from an element that is provided on the printing medium, even in cases in which the stiffness of the printing medium is high.

===Configuration of the Printing Medium===

Figure 3:
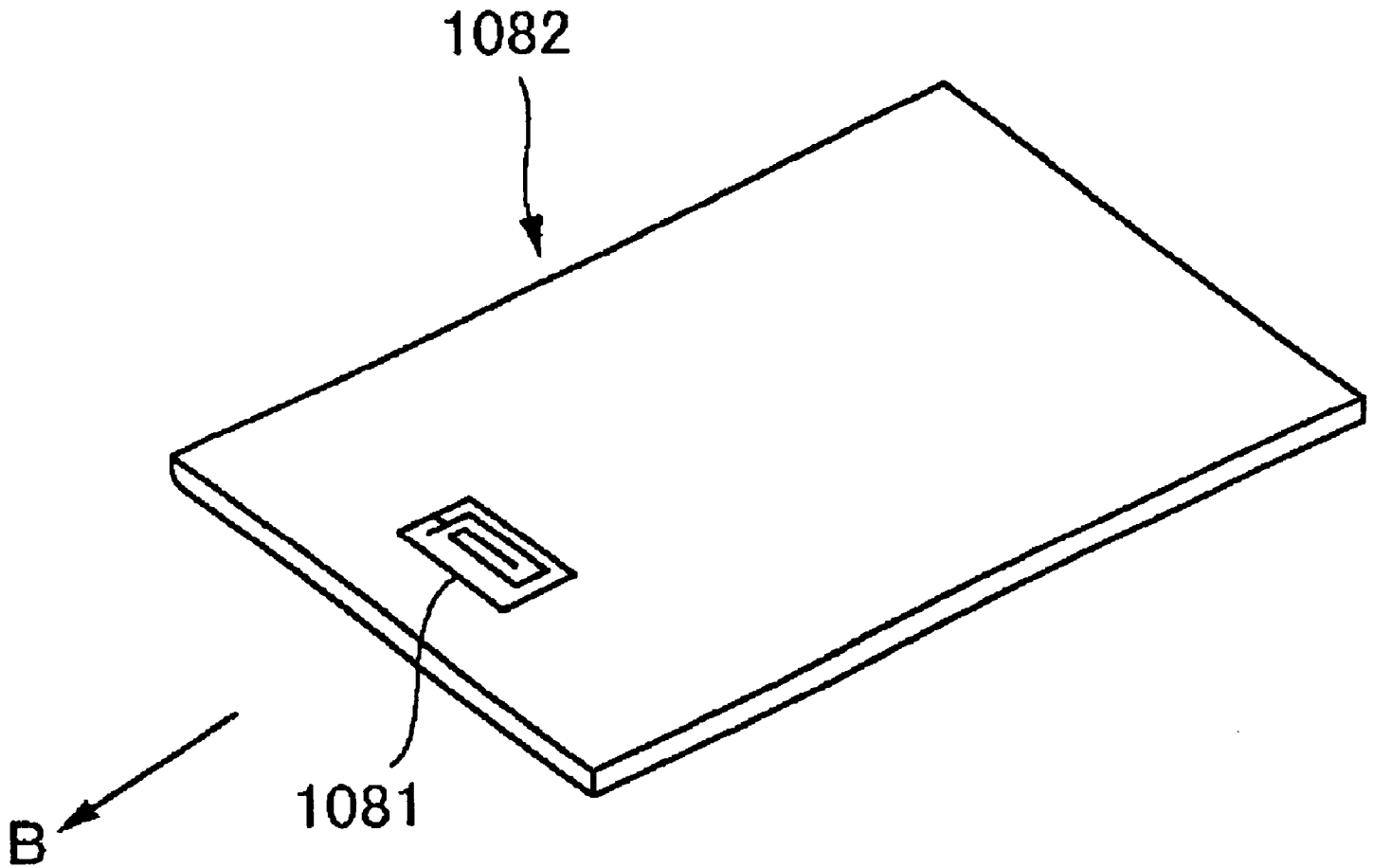
FIG. 3 relates to the first embodiment and is a perspective view of a thick paper, serving as a printing medium, in which a storage element has been embedded.

FIG. 3 is a perspective view of a printing medium according to the present embodiment. The main body of this printing medium 1082 is thick paper, and a storage element 1081 is embedded near the leading edge of the main body, taking the arrow B as the paper supply direction. As mentioned above, the storage element 1081 is positioned such that the storage element 1081 and the sending/receiving section 1080 (FIG. 4) provided in the printing apparatus face one another squarely at a position at which the printing medium is in a temporary stopped state midway in the paper supply path in Y direction. The position at which the storage element 1081 is embedded also depends on the position at which the sending/receiving section 1080 is provided, but if it is closer to the trailing edge of the thick paper, then it is necessary to perform the operation of returning the printing medium 1082 back to the above-mentioned set position after reading with the sending/receiving section 1080, so that preferably it is near the leading edge.

The storage element 1081 is a compact and thin element having a memory cell, such as a NAND flash ROM, and is made of a coil serving as an antenna and an IC chip having a controller and a storage section. If the thick paper has a thickness of about 0.5 mm, then it can be embedded easily. Moreover, the storage element 1081 is of the type allowing noncontact reading and/or writing. Consequently, there is no need for the sending/receiving section 1080 and the storage element 1081 to be in contact with one another, and there is a gap between the two. The storage element 1081 generates the necessary power by rectifying carrier waves sent from the sending/receiving section 1080.

===Configuration of the Storage Element and the Sending/Receiving Section ===

Referring to FIG. 4, the following is an explanation of the configuration of the storage element 1081 and the sending/receiving section 1080.

FIG. 4(*a*) is a top transparent view illustrating the configuration of the storage element 1081. The storage element 1081 is a near-range noncontact storage element, and the distance over which it can exchange data with the sending/receiving section is about 20 cm. Overall it is very small and thin, and it may also be adhered to an object as a seal that is made sticky on one side. It is also referred to as a memory tag, and many types are commercially available.

The storage element 1081 is made by arranging a noncontact IC chip 1811, and a resonance capacitor 1812 and a planar coil 1813 formed by etching a metal thin film on a plastic film, and coating it by a transparent cover sheet. On the other hand, although not shown in the plan view, the sending/receiving section 1080 is made of a coil antenna 1801 similar to that of the storage element and a sending/receiving circuit 1802, and is supplied with power from a power source unit of the printer main body 1010.

FIG. 4(*b*) is a block diagram showing the internal configuration of the storage element 1081 and the sending/receiving section 1080. The sending/receiving section 1080 is made of an antenna coil 1801 and a sending/receiving circuit 1802 that is connected to a peripheral input/output section (PIO) 1054 (FIG. 8) of a later-described printer main unit control circuit. The IC chip 1811 of the storage element 1081 is made of a rectifier 1814, a signal analyzer RF (radio frequency) 1815, a controller 1816, and a memory cell 1817. The memory cell 1817 is a memory that can be read/written electrically, such as a NAND flash ROM.

The antenna 1813 of the storage element 1081 and the antenna 1801 of the sending/receiving section 1080 are in communication with one another, and information stored in the memory cell 1817 is read or written. High-frequency signals generated with the sending/receiving circuit 1802 of the sending/receiving section 1080 are induced as a high-frequency magnetic field via the antenna 1801. This high-frequency magnetic field is absorbed via the antenna 1813 of the storage element 1081 and, rectified by the rectifier 1814, serves as a DC power source for driving the circuits inside the IC chip 1811.

===Data Stored in the Storage Element===

FIG. 5 is a diagram illustrating data strings in the memory cell 1817 of the storage element 1081. The regions of the memory cell 1817 include a read region 1817R in which attribute information about the printing medium is stored and a write region 1817W in which information relating to the printing result is stored.

The data in the read region 1817R (addresses 00H to 04H) represent the individual attributes of the thick paper in which the storage element 1081 is embedded. These data should be written when the storage element 1081 itself is manufactured at the factory or when it is embedded in the thick paper.

The data in the read region 1817R are 8 bits of information at each address, and include the type of printing medium, the thickness of the printing medium, the width of the printing medium, the manufacturing date of the printing medium and the printing medium LUT. "Type of the printing medium" is information relating to the material ingredients (paper, plastic, leather, OHP sheet, etc.) of the printing medium 1082, and if it is paper, then also its glossiness for example. "Thickness of the printing medium" is information indicating the thickness of the printing medium 1082. Utilizing this information, the separation (released state) distance between the carry driven rollers 1062 and the carry driving roller 1061 when the printing medium 1082 is in the printing set state may be controlled when printing on a thick printing medium 1082. "Width of the printing medium" is information indicating the width of the printing medium 1082.

With this information the printer can be controlled automatically without individually setting the width of the paper, such as A4 size or B5 size, with printer driver software. "Printing medium LUT" (look-up table) is a color correction table correlating an index number of index color format with numerical information of the actually displayed color. Since these differ for each printing medium, this information is important in order to achieve color image hues of high quality when printing. In addition to these data, it is also possible to include various other kinds of information relating to the attributes of the printing medium 1082 as appropriate.

Various kinds of information relating to the printing result can be written into the writing region 1817W (addresses: 05H and below), such as information specifying the printing apparatus with which the printing was carried out, information specifying the digital camera with which the image data printed onto the printing medium 1082 have been taken, the date on which printing was executed, information specifying the data printed on the printing medium 1082 (for example file names or path names of hard-disk directories), and the image data themselves that are printed on the printing medium 1082. With these information and data, the same printing result can be easily recreated when printing the same data at a later date.

It should be noted that the information stored in the addresses of the read region 1817R and the write region 1817W may also be larger than eight bits if necessary. Furthermore, the image data are ordinarily of considerable size, so that it is preferable to ensure in advance a considerable amount of addresses as appropriate.

===Arrangement of the Sending/Receiving Section===

In this embodiment, the sending/receiving section 1080 is disposed near the point where the paper supply path of arrow A merges with the paper supply path of arrow B, that is, above the vicinity of the paper detector 1063, however there is no limitation to this.

It is preferable that the sending/receiving section 1080 is arranged upstream from the print heads IH1 to 4 in the direction in which the printing medium is carried. The reason for this is that by arranging the sending/receiving section 1080 upstream from the sending/receiving section 1080 in the direction in which the printing medium is carried, it is possible to write information onto the element before printing is carried out by ejecting ink with the print heads IH1 to 4.

More preferably, the sending/receiving section 1080 is upstream on the paper supply side from the carrying and positioning means (carry driving roller 1061 and carry driven rollers 1062) that carry the printing medium 1082. This is because in this case the information stored in the storage element 1081 can be read at an early time when printing from the printer 1010 main unit side, so that it is possible to perform accurate settings of the printing control.

Moreover, also the process of writing onto the storage element 1081 may be performed subsequent to the reading process at the same position. That is to say, writing of information to the element is carried out when the printing medium is positioned at a predetermined position with respect to the printer 1010, and information stored in the element may be read out in that same position. With this configuration, the printing medium is positioned in a predetermined position with respect to the printer 1010, and both writing and reading of information with respect to the element are possible.

It should be noted that it is also possible to arrange the sending/receiving section 1080 below any of the print heads IH1 to 4, thus making it possible to move the sending/receiving section 1080 together with the print heads IH1 to 4. With this configuration, reliable sending and receiving regardless of the width of the printing medium 1082 becomes possible by moving the print heads IH1 to 4 to a suitable position in the scanning direction.

In any of the above cases, it is of course preferable that it is arranged at a position at which communication is possible within the range of distances over which sending and receiving with a near-range storage element 1081 is possible. Furthermore, in any case it is preferable that at the time of the reading operation, the operation of the printing medium 1082 is temporarily stopped in order to reliably perform communication.

===Configuration of the Carriage and its Surroundings===

Figure 6:
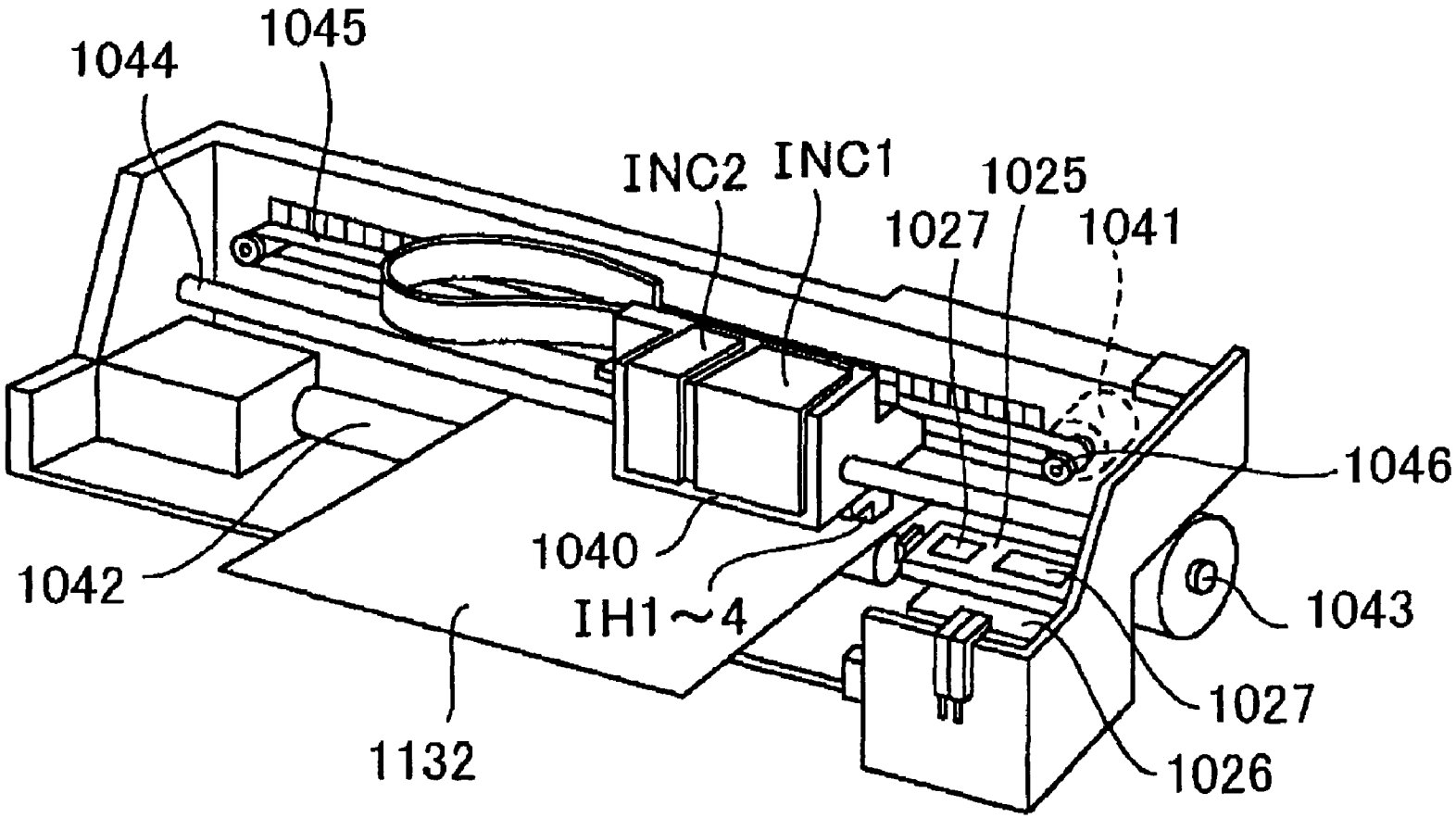
FIG. 6 relates to the first embodiment and is a perspective view showing the configuration of the surroundings of the carriage of an inkjet printer.

The following is an explanation of the configuration of the carriage 1040 and its surroundings within the inkjet printer 1010. FIG. 6 is a perspective view showing the configuration of the surroundings of the carriage 1040.

As shown in FIG. 6, the carriage 1040 is connected by a drive belt 1045 via a pulley 1046 to a carriage motor 1041, and is driven so that it moves parallel to the platen 1042, guided by the slide shaft 1044. The heads IH1 to IH4, which have a row of nozzles ejecting black ink and a row of nozzles ejecting color ink, are provided on the surface of the carriage 1040 that faces the printing paper. The nozzles receive a supply of ink from ink cartridges INC1 and INC2, and print text or images by ejecting ink drops onto the printing paper.

Furthermore, a capping device 1025 for sealing the nozzle apertures of the heads IH1 to IH4 when not printing and a pump unit 1026 including a pump motor that is not shown in the drawings are provided at a non-printing region of the carriage 1040. When the carriage 1040 is moved from the printing region to the non-printing region, the carriage 1040 abuts against a lever not shown in the drawings, whereby the capping device 1025 is shifted upward and seals the heads IH1 to IH4.

If the nozzle aperture rows of the heads IH1 to IH4 clog up, or if ink is forcibly ejected from the heads IH1 to IH4, for example when exchanging the ink cartridges INC1 and INC2, then the pump unit 1026 is operated while the heads IH1 to IH4 are in the sealed state, and the negative pressure from the pump unit 1026 sucks the ink out from the nozzle aperture rows. Thus, grime and paper dust adhering to the vicinity of the nozzle aperture rows are washed away, and moreover, air bubbles in the heads IH1 to IH4 are ejected together with the ink onto the cap 1027.

===Internal Configuration of the Inkjet Printer===

Figure 7:
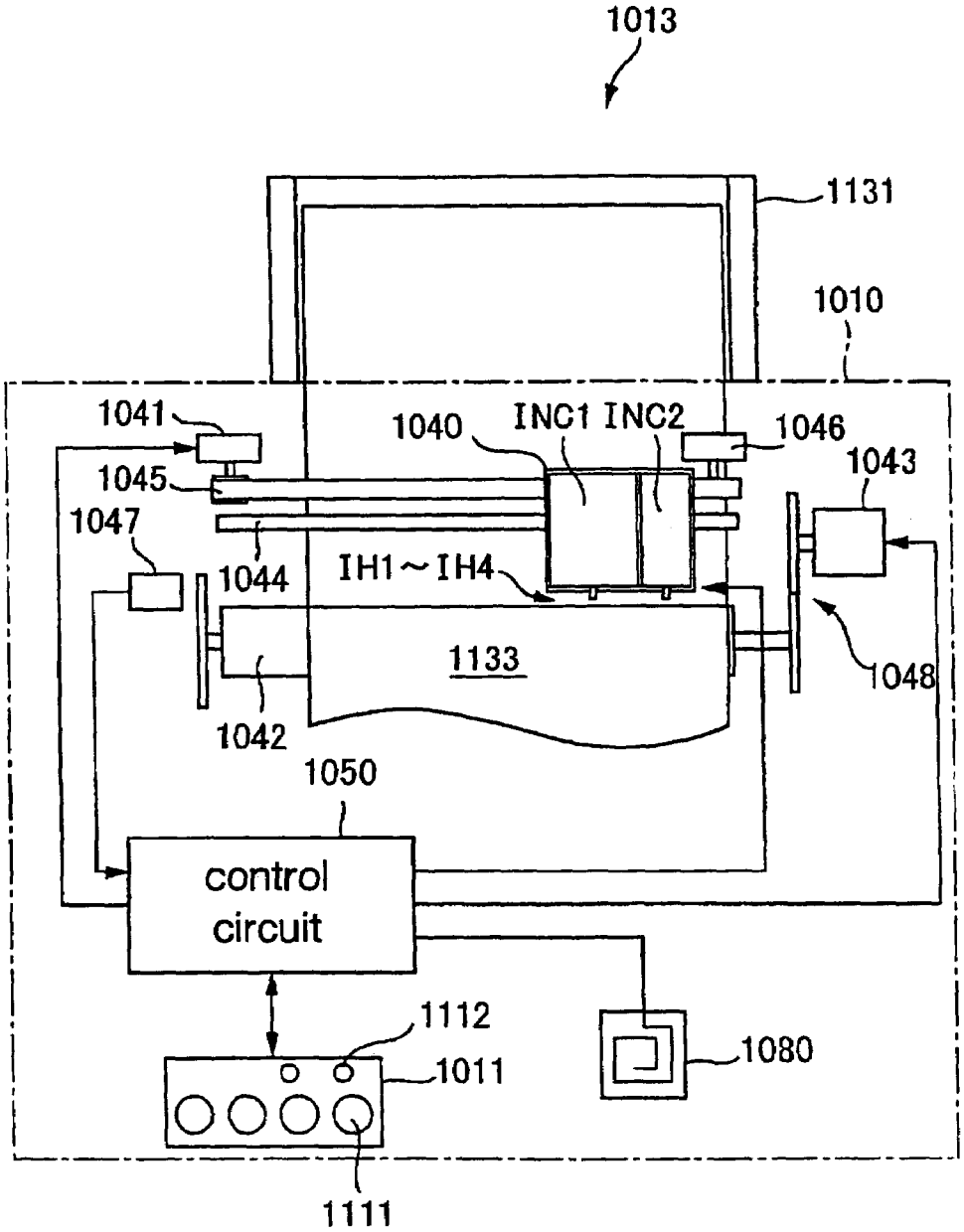
FIG. 7 relates to the first embodiment and shows the internal configuration of an inkjet printer.

Next, the internal configuration of the color inkjet printer 1010 is described with reference to FIG. 7. FIG. 7 shows the internal configuration of the printer 1010 according to this embodiment.

As shown in the figure, the printer 1010 has a mechanism for ejecting ink and forming dots by driving the print heads IH1 to IH4 mounted to the carriage 1040, a mechanism for moving the carriage 1040 back and forth in the axial direction of a platen 1042 with a carriage motor 1041, a mechanism for carrying with a paper feed motor 1043 the cut paper 1133 that is supplied from a paper supply unit 1131 and the printing medium that is supplied from the paper supply path marked by the arrow B, and a control circuit 1050.

The mechanism for moving the carriage 1040 back and forth in the axial direction of the platen 1042 includes a slide shaft 1044, which is provided parallel to the axis of the platen 1042 and which slidably holds the carriage 1040, and a pulley 1046 with an endless drive belt 1045 provided stretched between it and the carriage motor 1041.

The mechanism for carrying the printing medium includes the platen 1042, the paper-feed motor 1043 for rotating the platen 1042, the carry driving roller 1061 and the carry driven rollers 1062 (FIG. 2), a gear mechanism 1048 for transmitting the rotation of the paper-feed motor 1043 to the platen 1042 and the two rollers 1061 and 1062, an encoder 1047 for detecting the rotation angle of the platen 1042, and the paper detector 1063 (FIG. 2). Furthermore, the sending/receiving section 1080 is arranged near the paper detector 1063.

The control circuit 1050 appropriately controls the movement of the paper-feed motor 1043, the carriage motor 1041, and the print heads IH1 to IH4 while exchanging signals with an operation panel 1011 and the sending/receiving section 1080 of the printer, and a personal computer or the like connected on the outside. The printing medium supplied from the paper supply unit 1131 and the straight paper supply path marked by the arrow B is set so that it is sandwiched between the platen 1042 and the carry driven rollers 1062, and is carried by a predetermined amount corresponding to the rotation angle of the platen 1042.

An ink cartridge INC1 and an ink cartridge INC2 are mounted on the carriage 1040. Each ink cartridge INC1 and INC2 is provided with a storage element ME (FIG. 8) for storing the amount of ink remaining, for example. The ink cartridge INC1 holds black (K) ink, and the ink cartridge INC2 holds the other inks, that is, it holds three colors of ink: cyan (C), magenta (M), and yellow (Y). As has been mentioned already, it may also contain light cyan (LC), light magenta (LM), and dark yellow (DY) ink.

===Internal Structure of the Control Circuit===

Figure 8:
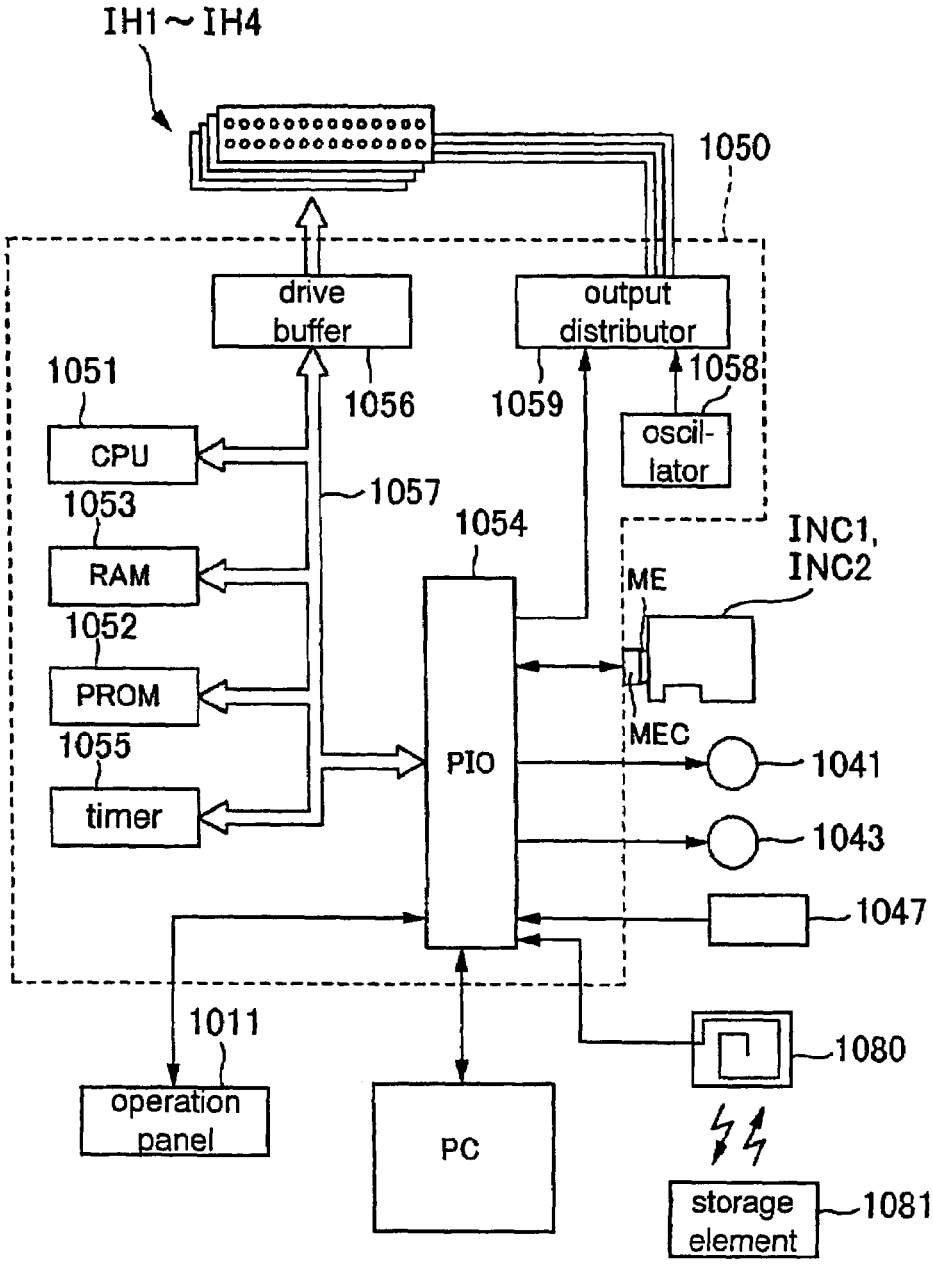
FIG. 8 relates to the first embodiment and is a block diagram showing the internal configuration of the control circuit of an inkjet printer.

Next, the internal configuration of the control circuit 1050 of the inkjet printer is described with reference to FIG. 8. FIG. 8 is a block diagram showing the internal configuration of the control circuit 1050 of the inkjet printer according to this embodiment.

As shown in FIG. 8, a CPU 1051, a PROM 1052, a RAM 1053, a peripheral device input/output section (PIO) 1054, a timer 1055, and a drive buffer 1056, for example, are provided inside the control circuit 1050.

The PIO 1054 is connected to the operation panel 1011, the personal computer PC, a connecter MEC connecting it with the memory elements ME of the ink cartridges, the carriage motor 1041, the paper-feed motor 1043, the encoder 1047, and the send/receive section 1080. The drive buffer 1056 is used as a buffer for supplying on/off signals for dot formation to the print heads IH1 to IH4. These are connected to one another by a bus 1057 and can exchange data between one another. The control circuit 1050 is also provided with an oscillator 1058 for outputting a drive waveform at a predetermined frequency, and an output distributor 1059 for distributing the output from the oscillator 1058 to the print heads IH1 to IH4 at a predetermined timing.

The control circuit 1050 accesses the storage element 1081 of the printing medium 1082 via the sending/receiving section 1080 when the printing medium 1082 is temporarily halted in the printing set position. Then, the control circuit 1050 controls the printing operation reflecting the information that has been obtained from the storage element 1081, and writes various kinds of information relating to the printing result into the storage element 1081.

While printing, the control circuit 1050 outputs dot data to the drive buffer 1056 at a predetermined timing while synchronizing with the movement of the carriage motor 1041 and the paper-feed motor 1043. The process of reading from the storage element 1081, the printing process utilizing the information obtained from the storage element 1081, and the process of writing information relating to the printing result are described in detail later.

===Operation of the Inkjet Printer===

Figure 9:
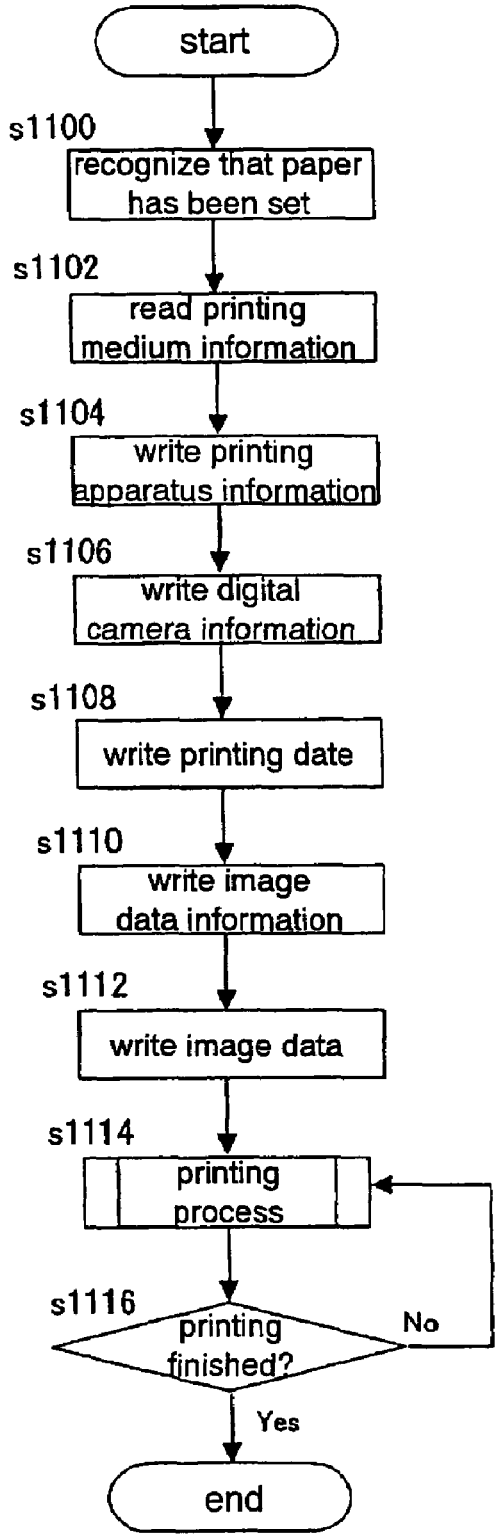
FIG. 9 relates to the first embodiment and is a flowchart of the procedure of the control circuit of the printer when printing.

Next, the operation of the inkjet printer 1010 in accordance with the present embodiment is explained with reference to FIG. 9. FIG. 9 is a flowchart of the procedure executed by the control circuit 1050 of the inkjet printer 1010 when printing image data. Here, it is assumed that the sending/receiving section 1080 is disposed above the paper supply path near the paper detector 1063.

First, the control circuit 1050 receives position information about the printing medium 1082 from the paper detector 1063, and confirms whether the printing medium 1082 has been set in the printing set position by the carrying and positioning means 1061 and 1062 (Step s1100).

The control circuit 1050 then executes a process of serially reading via the sending/receiving section 1080 the various kinds of information recorded in the read region 1817R of the memory cell 1817 of the storage element 1081, in order from the start of the addresses, and stores the obtained information temporarily in the RAM 1053 (Steps 1102). "Various kinds of information" means namely, the type, thickness, width, manufacturing date and LUT of the printing medium 1082.

The control circuit 1050 then performs a process of writing via the sending/receiving section 1080 various kinds of information relating to the printing result into the write region 1817W of the memory cell 1817. First, information for specifying the printing apparatus is written (Step s1104).

Then, information specifying the digital camera with which the image data to be printed have been taken (Step s1106), the printing date (Step s1108), information specifying the file name and the path name of the image data to be printed (Step s1110), and the image data themselves that are printed (Step s1112) are written.

By writing all this information into the storage element 1081, when attempting to print the same data at a later date and to attain the same printing result, it is possible to recreate the same print results without relying on the memory by reading print attribute information that differs for each printing apparatus, such as color conversion information, image processing information that differs for each digital camera, such as color correction, and information such as the storage place or file name of the image data, and utilizing this information for the print control. Furthermore, by reading the printing date information, it is possible to examine deterioration of image quality of the printed image depending on the passage of time.

Returning to the explanation of FIG. 9, the control circuit 1050 then performs a printing process (Step s1114). The printing process is basically carried out by a publicly known processing procedure. For this, the control information stored in the RAM 1053 is read out, and driving control of the carriage motor 1041, the paper feed motor 1043 and the print heads IH1 to 4 is performed.

Finally, the control circuit 1050 waits until printing is finished (Step s1116: No), and when it determines that printing has finished (Step s1116: Yes), the main routine is terminated.

It should be noted that if the image data themselves are written into the storage element 1081 of the printing medium 1082, as in the present embodiment, then they can be read by some other reading device and printed at a later date. In that case, even if the computer on which the image data were stored originally is not available, it is possible to output them in a simple manner using another computer and printing apparatus, because the printing medium itself holds the image data. For example, it is easy to compare print results for the same data without preparing the computer itself by reading the image data on the printing medium on which a certain image has been printed and outputting them on a variety of printers, to demo print a sample image at a store selling various models of printers, such as inkjet printers. For this, a reading device may be arranged midway in the paper supply path of the printing apparatus, in a similar manner as in the present embodiment, but it may also be a compact hand-held scanner with which noncontact reading is possible.

Furthermore, in the above embodiment, it has been explained that the process of printing on the printing medium 1082 with the inkjet printer 1010 and the process of writing image data or the like are carried out, and then the image data are read out with a different printing apparatus and reprinted at a later date, but since the inkjet printer 1010 is a printing apparatus that can both read and write from/on the storage element 1081, it is also possible to read the image data again from the printing medium 1082 with the inkjet printer 1010, and print them at a later date.

===Other Considerations===

The above has been an explanation of a printing apparatus in accordance with the present invention based on an embodiment, but the above-described embodiment of the present invention is merely to facilitate the understanding of the present invention, and the present invention is not limited thereto. The present invention may be altered and modified without deviating from its general idea, and it is needless to say that equivalents are to be included within the present invention.

The present invention can be applied effectively to cut paper, but is not limited to cut paper, and can also be applied to roll paper. In this case, an element may be provided in the paper that is rolled around the core portion of a roll paper unit.

The above-described embodiment was explained for an example in which thick paper serves as the overall printing medium, but it is also possible to use a plastic board, a metal thin sheet or the like.

It is also possible to realize a computer system including not only the inkjet printer in accordance with the above-described invention, but also a computer main unit, a display device such as a CRT, an input device such as a mouse and a keyboard, a flexible disk drive and a CD-ROM drive, and as an overall system, the computer system realized in this manner will be superior to conventional systems.

Furthermore, the inkjet printer in accordance with the present embodiment may also be provided with all or some of the functions of a computer main unit, a display device, an input device, a flexible disk drive and a CD-ROM disk drive. For example, the printer may also be configured to have an image processing section performing image processing, a display section performing various sorts of display, and a recording media insertion section into which removable recording media can be inserted on which image data taken with a digital camera or the like are stored.

In the above-described embodiments, an inkjet printer 1010 was used as a printing apparatus, but as long as it is a printing apparatus that can perform a printing process on single-sheet media such as cut paper, there is no limitation to this, and it may also be applied to a monochrome printer, a laser printer, a facsimile or the like.

Moreover, in the above-described embodiments, storage elements were used that are provided with a noncontact IC chip and a resonance capacitor and a planar antenna coil formed by etching a metal thin film, but there is no limitation to this configuration, and various modifications are also conceivable, such as configurations in which the resonance capacitor may be connected outside of the storage element, or the IC chip and the antenna coil are arranged at different locations and connected to one another.

SECOND EMBODIMENT

===Overview of Inkjet Printer===

Figure 10:
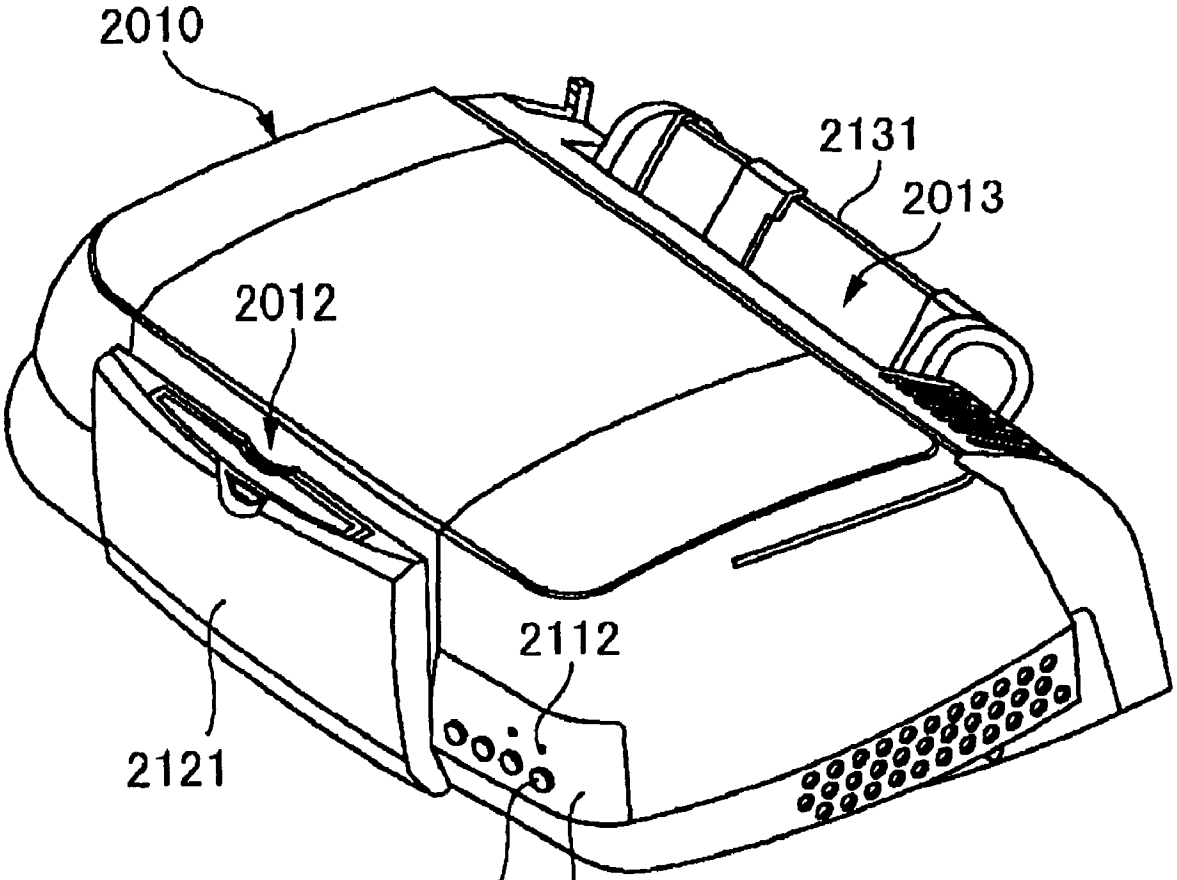
FIG. 10 relates to a second embodiment and diagrammatically shows the outer appearance of an inkjet printer.

The following explains an overview of an inkjet printer serving as a printing apparatus, which is a main application object of the present invention. FIG. 10 diagrammatically shows the outer appearance of an inkjet printer.

Here, a color inkjet printer is shown. This color inkjet printer 2010 is an inkjet printer that can output color images, and forms images by ejecting four colors of color ink, for example cyan (C), magenta (M), yellow (Y), and black (K), onto a printing medium such as cut paper so as to form dots. It should be noted that in addition to these four colors it is also possible to use light cyan (LC), light magenta (LM), and dark yellow (DY) as color inks.

As shown in FIG. 10, the color printer 2010 has a paper supply structure by which cut paper that is supplied from above its rear side is discharged from its front side. The front side of the main printer unit 2010 is provided with an operation panel 2011 and a paper discharge section 2012, and its rear side is provided with a paper supply section 2013. The operation panel 2011 is provided with a variety of control buttons 2111 and display lamps 2112. The paper discharge section 2012 is provided with a paper discharge tray 2121 blocking the paper discharge opening when the printer is not in use.

The paper supply section 2013 is provided with a paper supply tray 2131 for holding cut paper, which is not shown in the drawings. It should be noted that cut paper refers to paper that has been cut in advance to predetermined dimensions, and is a single-sheet printing medium that is not cut by the color printer 2010.

===Configuration of the Paper Supply Mechanism===

Figure 11:
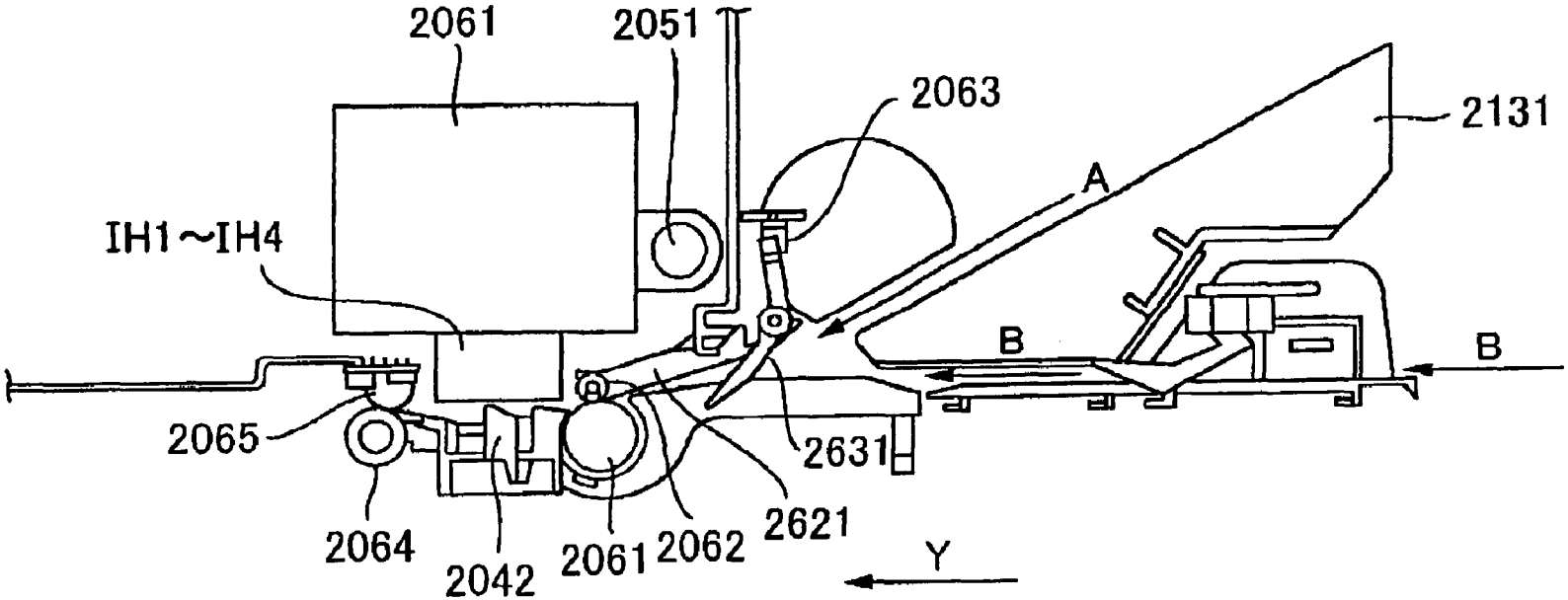
FIG. 11 relates to the second embodiment and is a cross-sectional view of an essential portion of an inkjet printer, illustrating two paper supply mechanisms.

The color printer 2010 of the present embodiment is configured to have, in particular, one more paper supply path (not shown in FIG. 10), which is also called a "straight path." This is a paper supply mechanism with which printing media having a certain thickness and hardness, such as thick paper, can be supplied manually. With this straight path mechanism, also printing media of irregular dimensions and shapes, such as CD-Rs, can be placed on a printing medium feeding tray (not shown in the drawings) and supplied, so that it is possible to print without cutting the printing media. FIG. 11 is a cross-sectional view of an essential portion of the printer 2010, illustrating these two paper supply mechanisms.

In the color printer 2010, a carriage 2040, which is supported by a slide shaft 2044 and moves in a slide shaft direction (main scanning direction), is provided as means for printing on a printing medium, and heads IH1 to IH4 that print by ejecting ink onto the printing medium are mounted to this carriage 2040. In opposition to the heads IH1 to IH4, a platen 2042 is provided that defines a gap between the head surfaces of the heads IH1 to IH4 and the printing medium. Moreover, the printing medium is printed on by letting the heads IH1 to IH4 eject ink onto the recording material while carrying the carriage 2040 in the main scanning direction and intermittently carrying the printing medium between the carriage 2040 and the platen 2042 in a paper-feed direction Y.

The paper supply tray 2131 is configured such that it can supply printing media of cut paper, such as regular paper or photo paper, and it is provided with an ASF (auto sheet feeder) for automatically supplying the printing medium. The ASF is an automatic paper supply mechanism having a paper supply roller 2132 provided on the paper supply tray 2131 and a separation pad, which is not shown in the drawings. The paper supply roller 2132 has a substantially D-shaped cross section, and is rotated by the rotational driving force of a stepping motor or the like. Moreover, the rotational driving force of the paper supply roller 2132 and the friction resistance of the separation pad prevent a plurality of printing media from being supplied together.

Printing media that are automatically paper-fed by the ASF along the path indicated by the arrow A are intermittently carried for a predetermined paper feed amount towards the print execution area by printing medium carrying and positioning means disposed downstream in the paper-feed direction Y from the paper supply roller 2132.

A carry driving roller 2061 and carry driven rollers 2062 are provided as carrying and positioning means for intermittently carrying and positioning the printing medium in the paper-feed direction Y. The carry driving roller 2061 is rotated by a paper feed motor, such as a stepping motor, and the printing medium is carried in the paper-feed direction Y by the rotation of the carry driving roller 2061. The carry driven rollers 2062 are axially supported on a plurality of carry driven roller holders 2621. When the printing medium is carried by the rotation of the carry driving roller 2061, the carry driven rollers 2062 follow this rotation.

A paper detector 2063 that is publicly known from the conventional art is disposed between the paper supply roller 2132 and the carry driving roller 2061. The paper detector 2063 has a lever 2631 provided with the property to restore itself to an upright position and pivotably supported such that it protrudes into the carrying path of the printing medium and such that it can turn only in the recording paper carrying direction. The paper detector 2063 has a configuration with which the lever 2631 turns when the tip of the lever 2631 is pushed by a printing medium, thus detecting the printing medium. The paper detector 2063 detects the leading edge position and the trailing edge position of the printing medium that has been supplied by the paper supply roller 2132. The printing region is decided and printing is executed in accordance with the detected positions.

A paper discharge driving roller 2064 and paper discharge driven rollers 2065 are provided as means for discharging printed printing media. The paper discharge driving roller 2064 is rotated by the rotation driving force of a stepping motor, for example, and rotation of the paper discharge driving roller 2064 discharges the printing medium in the paper-feed direction Y. The paper discharge driven rollers 2065 are teethed rollers that have a plurality of teeth on their circumferences, and the tips of these teeth are sharpened acutely such that they come in point contact with the recording surface of the printing medium. The paper discharge driven rollers 2065 are rotated by following when the printing medium is discharged due to the rotation of the discharge driving roller 2064.

In addition to the paper supply path (the path indicated by the arrow marked with the letter A) due to the above-described ASF, the printer 2010 is further equipped with a paper supply path for supplying printing media with little flexibility, such as thick paper in which a recording element is embedded. In the figure, this paper supply path is indicated by the arrow marked with the letter B. The printer 2010 can also print on printing media supplied from the paper supply path marked by the arrow B, just like it can print on printing media that are supplied from the ASF.

Furthermore, the printer 2010 is provided with a carry driven roller release mechanism, not shown in the drawings. When setting the printing medium in the set position, the carry driven rollers 2062 are held in a state separated from the carry driving roller 2061 (in a released stated), and after the printing medium has been inserted into the paper supply path and the positioning in the printing set position has finished, this released state is cancelled, and the carry driven rollers 2062 return to a state in which they are forced to move by the carry driving roller 2061. Here, when the printing medium is being set in the printing set position, the printer is for a while in an operation-stop state, so that for printing media equipped with a storage element, information can be read from a storage element using this temporary stopped state.

Although it is not shown in the figure, a reading sensor serving as reading means for reading information from the storage element of the printing medium is disposed near the point where the paper supply path of arrow B merges with the paper supply path of arrow A, that is, above the vicinity of the paper detector 2063. This reading sensor is arranged at a location in which it squarely faces the storage element at a position in which the printing medium is in a temporary stopped state. Details regarding the configuration and the arrangement of the reading sensor are explained further below.

It should be noted that the paper supply mechanism (carrying means) for carrying the printing medium over the path indicated by the arrow marked with the letter B carries a printing medium that is set in horizontal orientation while maintaining it in that horizontal orientation, so that it is possible to effectively read information from an element that is provided on the printing medium, even in cases in which the stiffness of the printing medium is high.

===Configuration of the Printing Medium===

Figure 12:
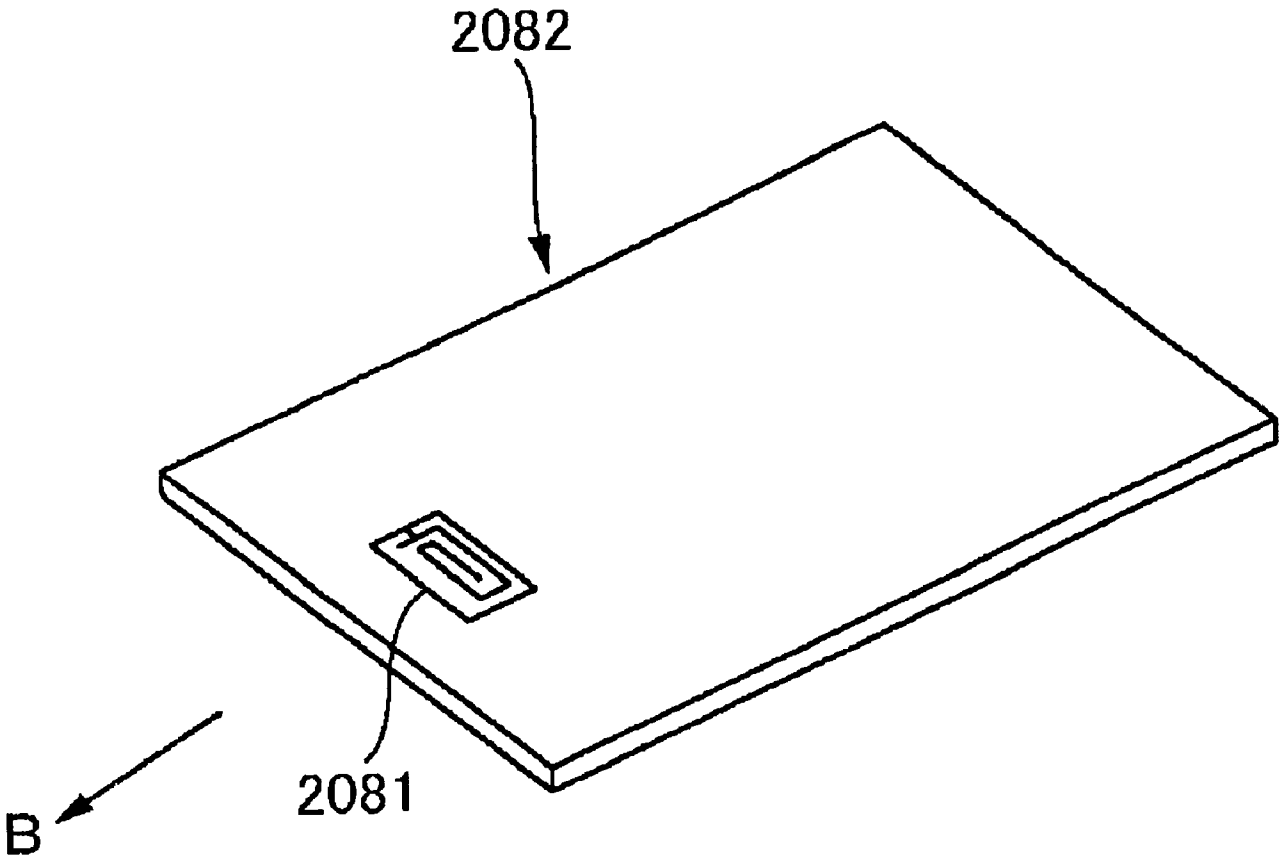
FIG. 12 relates to the second embodiment and is a perspective view of a thick paper, serving as a printing medium, in which a storage element has been embedded.

FIG. 12 is a perspective view of a printing medium according to the present embodiment. The main body of this printing medium 2082 is thick paper, and a storage element 2081 is embedded near the leading edge of the main body, taking the arrow B as the paper supply direction. As mentioned above, the storage element 2081 is positioned such that the storage element 2081 and the reading sensor 2080 (FIG. 13) face one another squarely at a position at which the printing medium is in a temporary stopped state midway in the paper supply path in Y direction. The position at which the storage element 2081 is embedded also depends on the position at which the reading sensor 2080 is provided, but if it is closer to the trailing edge of the thick paper, then it is necessary to perform the operation of returning the printing medium 2082 back to the above-mentioned set position after reading with the reading sensor 2080, so that preferably it is near the leading edge.

The storage element 2081 is a compact and thin element having a memory cell, such as a NAND flash ROM, and is made of a coil serving as an antenna and an IC chip having a controller and a storage section. If the thick paper has a thickness of about 0.5 mm, then it can be embedded easily. Moreover, the storage element 2081 is of the type allowing noncontact reading. Consequently, there is no need for the reading sensor 2080 and the storage element 2081 to be in contact with one another, and there is a gap between the two. The storage element 2081 generates the necessary power by rectifying carrier waves sent from the reading sensor 2080. It should be noted that if the reading sensor 2080 serves as sending/receiving means that is not only capable of reading information but also of writing it, then it is also possible to write various kinds of information onto the storage element 2081 from the printing apparatus 2010.

===Configuration of the Storage Element and the Reading Sensor===

Referring to FIG. 13, the following is an explanation of the configuration of the storage element 2081 and the reading sensor 2080. FIG. 13(*a*) is a top transparent view illustrating the configuration of the storage element 2081. The storage element 2081 is a near-range noncontact storage element, and the distance over which it can exchange data with the reading sensor 2080 is about 20 cm. Overall it is very small and thin, and it may also be adhered to an object as a seal that is made sticky on one side. It is also referred to as a memory tag, and many types are commercially available.

The storage element 2081 is made by arranging a noncontact IC chip 2811, and a resonance capacitor 2812 and a planar coil 2813 formed by etching a metal thin film on a plastic film, and coating it by a transparent cover sheet. On the other hand, although not shown in the plan view, the reading sensor 2080 is made of coil antenna 2801 similar to that of the storage element and a sending/receiving circuit 2802, and is supplied with power from a power source unit of the printer main body 2010.

FIG. 13(*b*) is a block diagram showing the internal configuration of the storage element 2081 and the reading sensor 2080. The reading sensor 2080 is made of an antenna coil 2801 and a sending/receiving circuit 2802 that is connected to a peripheral input/output section (PIO) 2054 (FIG. 17) of a later-described printer main unit control circuit. The IC chip 2811 of the storage element 2081 is made of a rectifier 2814, a signal analyzer RF (radio frequency) 2815, a controller 2816, and a memory cell 2817. The memory cell 2817 is a memory that can be read/written electrically, such as a NAND flash ROM.

The antenna 2813 of the storage element 2081 and the antenna 2801 of the reading sensor 2080 are in communication with one another, and information stored in the memory cell 2817 is read. High-frequency signals generated with the sending/receiving circuit 2802 of the reading sensor 2080 are induced as a high-frequency magnetic field via the antenna 2801. This high-frequency magnetic field is absorbed via the antenna 2813 of the storage element 2081 and, rectified by the rectifier 2814, serves as a DC power source for driving the circuits inside the IC chip 2811.

===Data Stored in the Storage Element===

FIG. 14 is a diagram illustrating data strings in the memory cell 2817 of the storage element 2081. All of these data represent the individual attributes of the thick paper, in which the storage element 2081 is embedded. These data should be written when the storage element itself is manufactured at the factory or when it is embedded in the thick paper.

The data that have been written are 8 bits of information at each address, and include the type of printing medium, the thickness of the printing medium, the width of the printing medium, the manufacturing date of the printing medium and the printing medium LUT. "Type of the printing medium" is information relating to the material ingredients (paper, plastic, leather, OHP sheet, etc.) of the printing medium 2082, and if it is paper, then also its glossiness for example. "Thickness of the printing medium" is information indicating the thickness of the printing medium 2082. Utilizing this information, the separation (released state) distance between the carry driven rollers 2062 and the carry driving roller 2061 when the printing medium 2082 is in the printing set state may be controlled when printing on a thick printing medium 2082. "Width of the printing medium" is information indicating the width of the printing medium 2082. With this information the printer can be controlled automatically without individually setting the width of the paper, such as A4 size or B5 size, with printer driver software. "Printing medium LUT" (look-up table) is a color correction table correlating an index number of index color format with numerical information of the actually displayed color. Since these differ for each printing medium, this information is important in order to achieve color image hues of high quality when printing. In addition to these data, it is also possible to include other information than the above in the storage element 2081 as appropriate.

===Arrangement of the Reading Sensor===

In this embodiment, the reading sensor 2080 is disposed near the point where the paper supply path of arrow A merges with the paper supply path of arrow B, above the vicinity of the paper detector 2063, however there is no limitation to this. However, it is preferable that it is upstream on the paper supply side from the carrying and positioning means (carry driving roller 2061 and carry driven rollers 2062) that carry the printing medium 1082 to the print heads IH1 to 4 on the downstream side. This is because in this case the information stored in the storage element 2081 can be read at an early time when printing from the printer 2010 main unit side, so that it is possible to perform accurate settings of the printing control.

It should be noted that it is also possible to arrange the reading sensor 2080 below any of the print heads IH1 to 4, thus making it possible to move the reading sensor 2080 together with the print heads IH1 to 4. With this configuration, reliable reading of data regardless of the width of the printing medium 2082 becomes possible by moving the print heads IH1 to 4 to a suitable position in the scanning direction.

In any of the above cases, it is of course preferable that it is arranged at a position at which reading is possible within the range of distances over which sending and receiving with a near-range storage element 2081 is possible. Furthermore, in any case it is preferable that at the time of the reading operation, the operation of the printing medium 2082 is temporarily stopped in order to read reliably.

===Configuration of the Carriage and its Surroundings===

Figure 15:
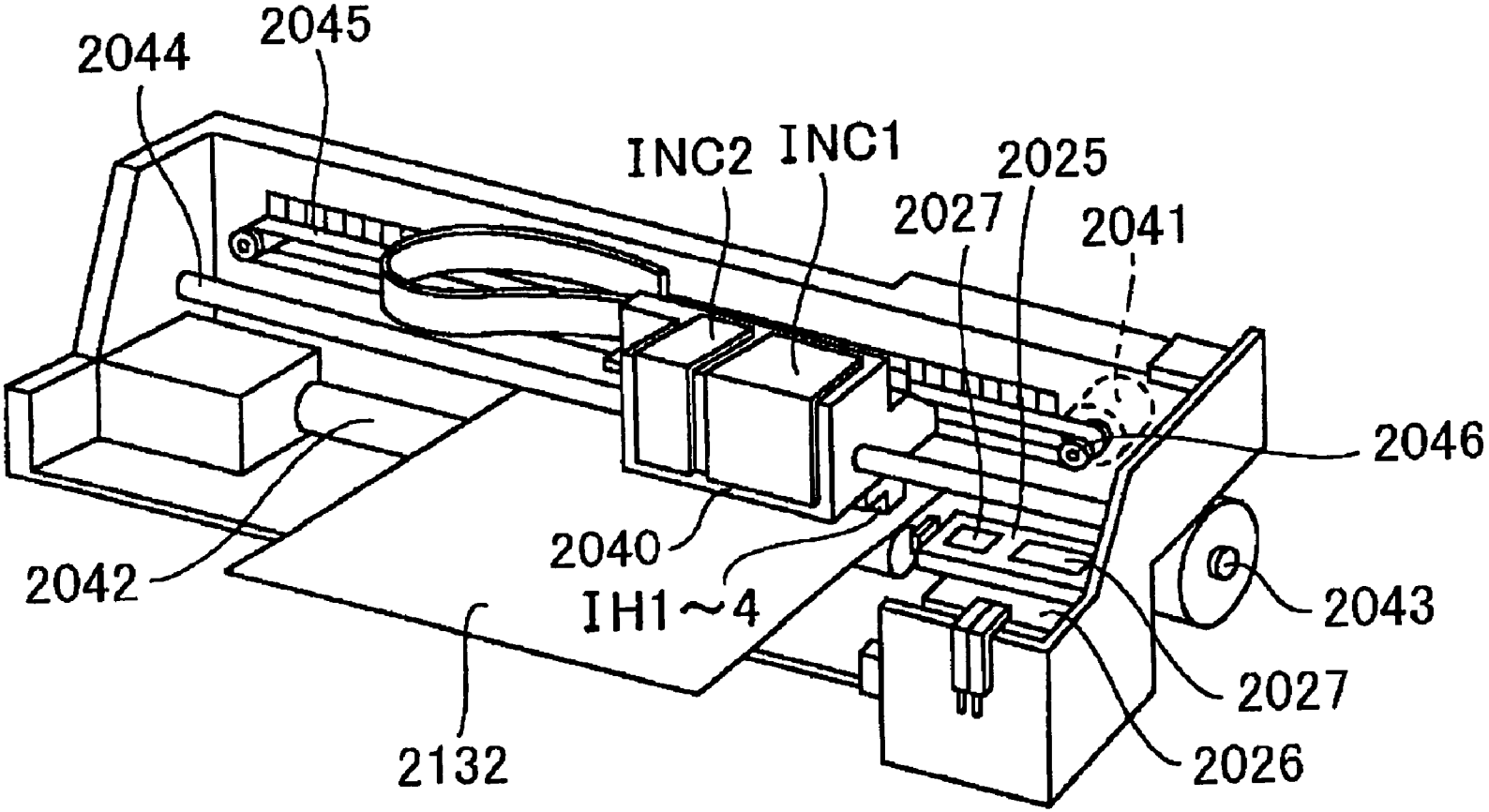
FIG. 15 relates to the second embodiment and is a perspective view showing the configuration of the surroundings of the carriage of an inkjet printer.

The following is an explanation of the configuration of the carriage 2040 and its surroundings within the inkjet printer 2010. FIG. 15 is a perspective view showing the configuration of the surroundings of the carriage 2040.

As shown in FIG. 15, the carriage 2040 is connected by a drive belt 2045 via a pulley 2046 to a carriage motor 2041, and is driven so that it moves parallel to the platen 2042, guided by the slide shaft 2044. The heads IH1 to IH4, which have a row of nozzles ejecting black ink and a row of nozzles ejecting color ink, are provided on the surface of the carriage 2040, which faces the printing paper. The nozzles receive a supply of ink from ink cartridges INC1 and INC2, and print text or images by ejecting ink drops onto the printing paper.

Furthermore, a capping device 2025 for sealing the nozzle apertures of the heads IH1 to IH4 when not printing and a pump unit 2026 including a pump motor that is not shown in the drawings are provided at a non-printing region of the carriage 2040. When the carriage 2040 is moved from the printing region to the non-printing region, the carriage 2040 abuts against a lever not shown in the drawings, whereby the capping device 2025 is shifted upward and seals the heads IH1 to IH4.

If the nozzle aperture rows of the heads IH1 to IH4 clog up, or if ink is forcibly ejected from the heads IH1 to IH4, for example when exchanging the ink cartridges INC1 and INC2, then the pump unit 2026 is operated while the heads IH1 to IH4 are in the sealed state, and the negative pressure from the pump unit 2026 sucks the ink out from the nozzle aperture rows. Thus, grime and paper dust adhering to the vicinity of the nozzle aperture rows are washed away, and moreover, air bubbles in the heads IH1 to IH4 are ejected together with the ink onto the cap 2027.

===Internal Configuration of the Inkjet Printer===

Figure 16:
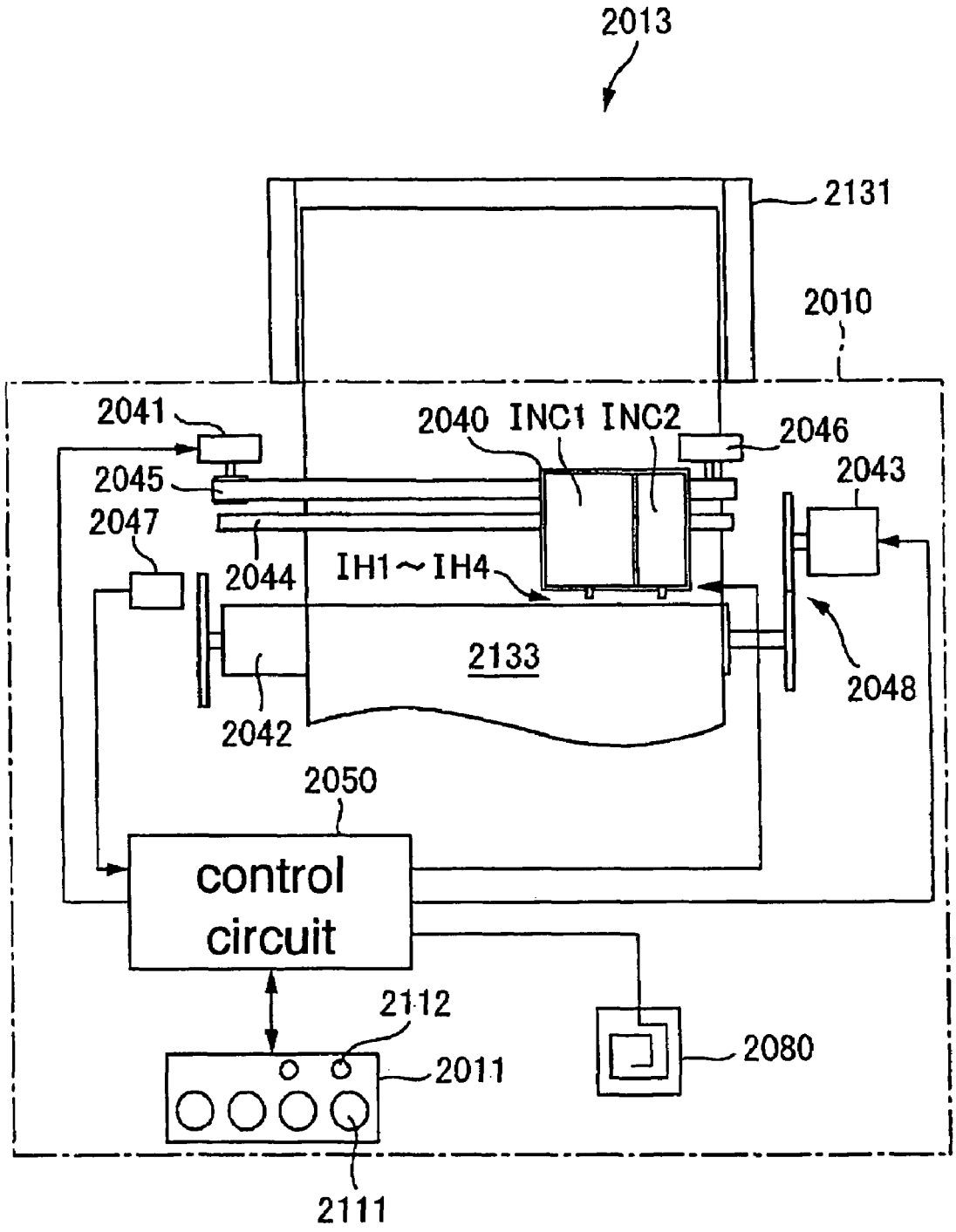
FIG. 16 relates to the second embodiment and shows the internal configuration of an inkjet printer.

Next, the internal configuration of the color inkjet printer 2010 is described with reference to FIG. 16. FIG. 16 shows the internal configuration of the printer 2010 according to this embodiment.

As shown in the figure, the printer 2010 has a mechanism for ejecting ink and forming dots by driving the print heads IH1 to IH4 mounted to the carriage 2040, a mechanism for moving the carriage 2040 back and forth in the axial direction of a platen 2042 with a carriage motor 2041, a mechanism for carrying with a paper feed motor 2043 the cut paper 2133 that is supplied from a paper supply unit 2131 and the printing medium that is supplied from the paper supply path marked by the arrow B, and a control circuit 2050.

The mechanism for moving the carriage 2040 back and forth in the axial direction of the platen 2042 includes a slide shaft 2044, which is provided parallel to the axis of the platen 2042 and which slidably holds the carriage 2040, and a pulley 2046 with an endless drive belt 2045 provided stretched between it and the carriage motor 2041.

The mechanism for carrying the printing medium includes the platen 2042, the paper-feed motor 2043 for rotating the platen 2042, the carry driving roller 2061 and the carry driven rollers 2062 (FIG. 11), a gear mechanism 2048 for transmitting the rotation of the paper-feed motor 2043 to the platen 2042 and the two rollers 2061 and 2062, an encoder 2047 for detecting the rotation angle of the platen 2042, and the paper detector 2063 (FIG. 11). Furthermore, the reading sensor 2080 is arranged near the paper detector 2063.

The control circuit 2050 appropriately controls the movement of the paper-feed motor 2043, the carriage motor 2041, and the print heads IH1 to IH4 while exchanging signals with an operation panel 2011 and the reading sensor 2080 of the printer, and a personal computer or the like connected on the outside. The printing medium supplied from the paper supply unit 2131 and the straight paper supply path marked by the arrow B is set so that it is sandwiched between the platen 2042 and the carry driven rollers 2062, and is carried by a predetermined amount corresponding to the rotation angle of the platen 2042.

An ink cartridge INC1 and an ink cartridge INC2 are mounted on the carriage 2040. Each ink cartridge INC1 and INC2 is provided with a storage element ME (FIG. 17) for storing the amount of ink remaining, for example. The ink cartridge INC1 holds black (K) ink, and the ink cartridge INC2 holds the other inks, that is, it holds three colors of ink: cyan (C), magenta (M), and yellow (Y). As has been mentioned already, it may also contain light cyan (LC), light magenta (LM), and dark yellow (DY) ink.

===Internal Structure of the Control Circuit===

Figure 17:
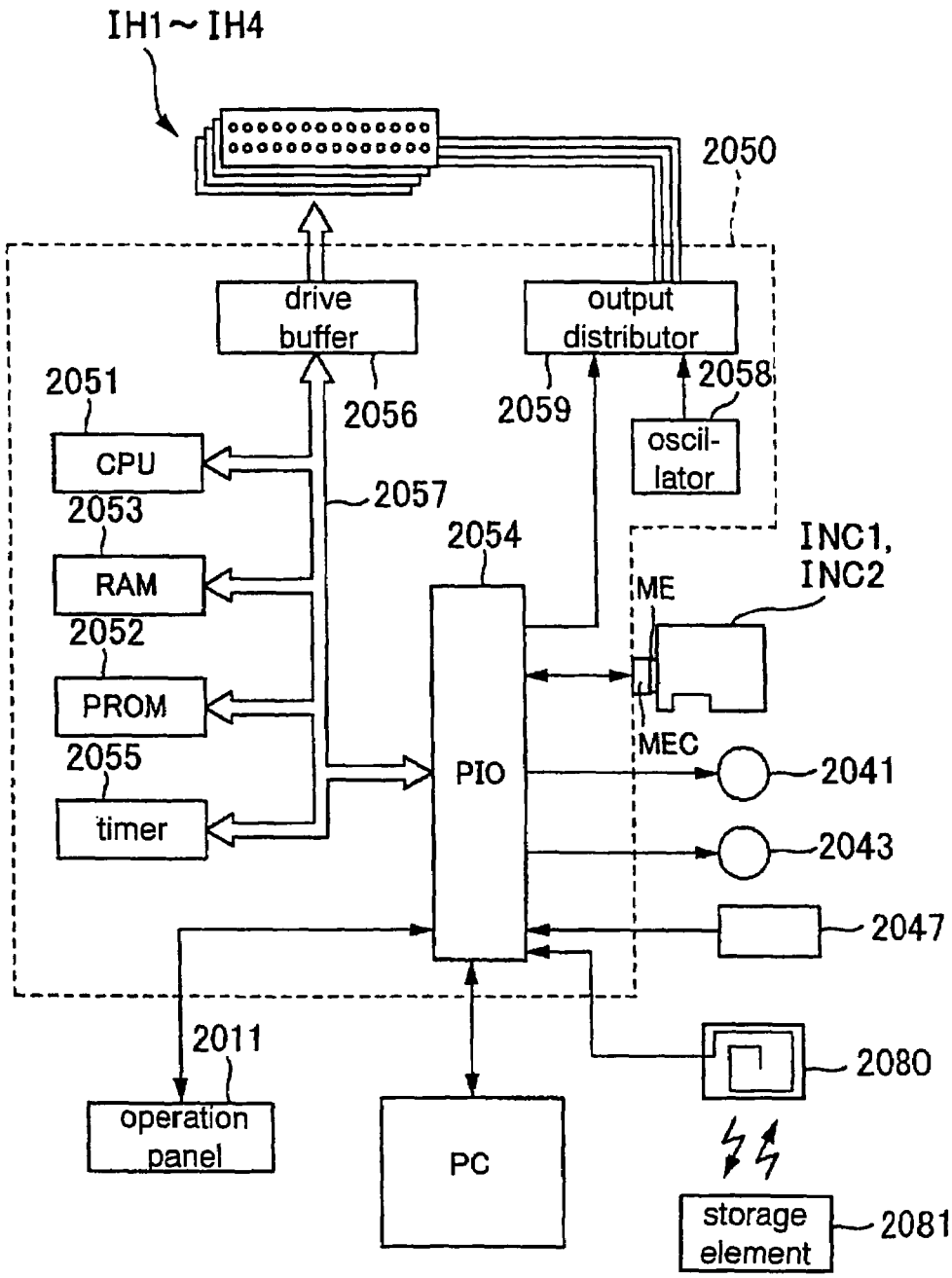
FIG. 17 relates to the second embodiment and is a block diagram showing the internal configuration of the control circuit of an inkjet printer.

Next, the internal configuration of the control circuit 2050 of the inkjet printer is described with reference to FIG. 17. FIG. 17 is a block diagram showing the internal configuration of the control circuit 2050 of the inkjet printer according to this embodiment.

As shown in the figure, a CPU 2051, a PROM 2052, a RAM 2053, a peripheral device input/output section (PIO) 2054, a timer 2055, and a drive buffer 2056, for example, are provided inside the control circuit 2050.

The PIO 2054 is connected to the operation panel 2011, the personal computer PC, a connecter MEC connecting it with the memory elements ME of the ink cartridges, the carriage motor 2041, the paper-feed motor 2043, the encoder 2047, and the reading sensor 2080. The drive buffer 2056 is used as a buffer for supplying on/off signals for dot formation to the print heads IH1 to IH4. These are connected to one another by a bus 2057 and can exchange data between one another. The control circuit 2050 is also provided with an oscillator 2058 for outputting a drive waveform at a predetermined frequency, and an output distributor 2059 for distributing the output from the oscillator 2058 to the print heads IH1 to IH4 at a predetermined timing.

The control circuit 2050 reads information from the storage element 2081 of the printing medium 2082 via the reading sensor 2080 while the printing medium 2082 is temporarily halted in the printing set position. Then, the control circuit 2050 controls the printing operation reflecting the information that has been obtained from the storage element 2081. While printing, the control circuit 2050 outputs dot data to the drive buffer 2056 at a predetermined timing while synchronizing with the movement of the carriage motor 2041 and the paper-feed motor 2043. The process of reading from the storage element 2081 and the printing process utilizing the information obtained from the storage element 2081 are described in detail later.

===Operation of the Inkjet Printer===

Figure 18:
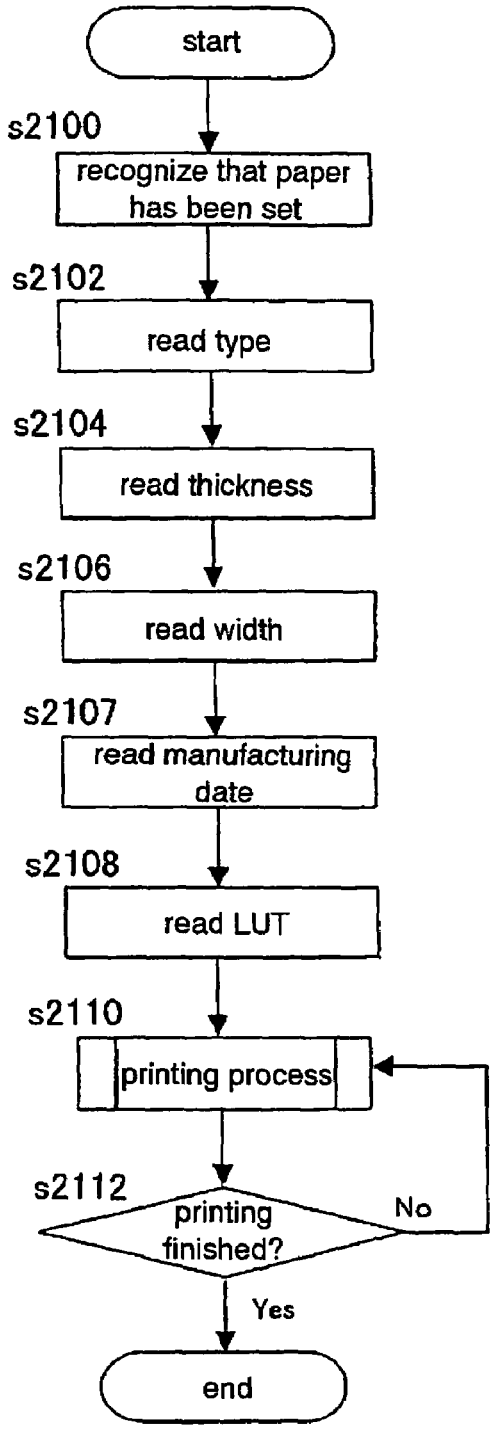
FIG. 18 relates to the second embodiment and is a flowchart of the procedure of the control circuit of the printer when printing.

Next, the operation of the inkjet printer 2010 in accordance with the present embodiment is explained with reference to FIG. 18. FIG. 18 is a flowchart of the procedure executed by the control circuit 2050 of the inkjet printer 2010 when printing. Here, it is assumed that the reading sensor 2080 is disposed above the paper supply path near the paper detector 2063.

First, the control circuit 2050 receives position information about the printing medium 2082 from the paper detector 2063, and confirms whether the printing medium 2082 has been set in the printing set position by the carrying and positioning means 2061 and 2062 (Step s2100).

The control circuit 2050 then executes a process of serially reading the various kinds of information recorded in the storage element 2081 of the printing medium 2082, in order from the start of the addresses, and stores the obtained information temporarily in the RAM 2053. First, it reads out the type of the recording medium (Step s2102). Thus, it obtains various kinds of information, such as whether the overall printing medium 2082 is thick paper or a plastic board, and if the overall printing medium 2082 is thick paper, then whether it is regular paper or glossy paper such as photo paper, and this information can be taken as control information in a later printing process step.

Next, the control circuit 2050 reads out, in order, the information about the thickness (Step s2104), the width (Step s2106), the manufacturing date (Step s2107), and the LUT (Step s2108) of the printing medium 2082. Of these, the information relating to the thickness can be taken as control information for the release mechanism of the carrying and positioning means (carry driving roller 2061 and carry driven rollers 2062). Furthermore, if the information relating to the manufacturing date is judged to be old, for example if there is a quality preservation period that depends on the type of the printing medium 2082, then it is also possible to display a warning screen alerting to this fact. The above information is stored in the RAM 2053.

The control circuit 2050 then performs a printing process (Step s2110). The printing process is basically carried out by a publicly known processing procedure. For this, the control information stored in the RAM 2053 is read out, and driving control of the carriage motor 2041, the paper feed motor 2043 and the print heads IH1 to 4 is performed.

Finally, the control circuit 2050 waits until printing is finished (Step s2112: No), and when it determines that printing has finished (Step s2112: Yes), the main routine is terminated.

===Other Considerations===

The above has been an explanation of a printing apparatus in accordance with the present invention based on an embodiment, but the above-described embodiment of the present invention is merely to facilitate the understanding of the present invention, and the present invention is not limited thereto. The present invention may be altered and modified without deviating from its general idea, and it is needless to say that equivalents are to be included within the present invention.

The present invention can be applied effectively to cut paper, but is not limited to cut paper, and can also be applied to roll paper. In this case, an element may be provided in the paper that is rolled around the core portion of a roll paper unit.

The above-described embodiment was explained for an example in which thick paper serves as the overall printing medium, but it is also possible to use a plastic board, a metal thin sheet or the like.

It is also possible to realize a computer system including not only the inkjet printer in accordance with the above-described invention, but also a computer main unit, a display device such as a CRT, an input device such as a mouse and a keyboard, a flexible disk drive and a CD-ROM drive, and as an overall system, the computer system realized in this manner will be superior to conventional systems.

Furthermore, the inkjet printer in accordance with the present embodiment may also be provided with all or some of the functions of a computer main unit, a display device, an input device, a flexible disk drive and a CD-ROM disk drive. For example, the printer may also be configured to have an image processing section performing image processing, a display section performing various sorts of display, and a recording media insertion section into which removable recording media can be inserted on which image data taken with a digital camera or the like are stored.

In the above-described embodiments, an inkjet printer 2010 was used as a printing apparatus, but as long as it is a printing apparatus that can perform a printing process on single-sheet media such as cut paper, there is no limitation to this, and it may also be applied to a monochrome printer, a laser printer, a facsimile or the like.

Moreover, in the above-described embodiments, storage elements were used that are provided with a noncontact IC chip, and a resonance capacitor and a planar antenna coil formed by etching a metal thin film, but there is no limitation to this configuration, and various modifications are also conceivable, such as configurations in which the resonance capacitor may be connected outside of the storage element, or the IC chip and the antenna coil are arranged at different locations and connected to one another.

THIRD EMBODIMENT

===Overview of Inkjet Printer===

Figure 19:
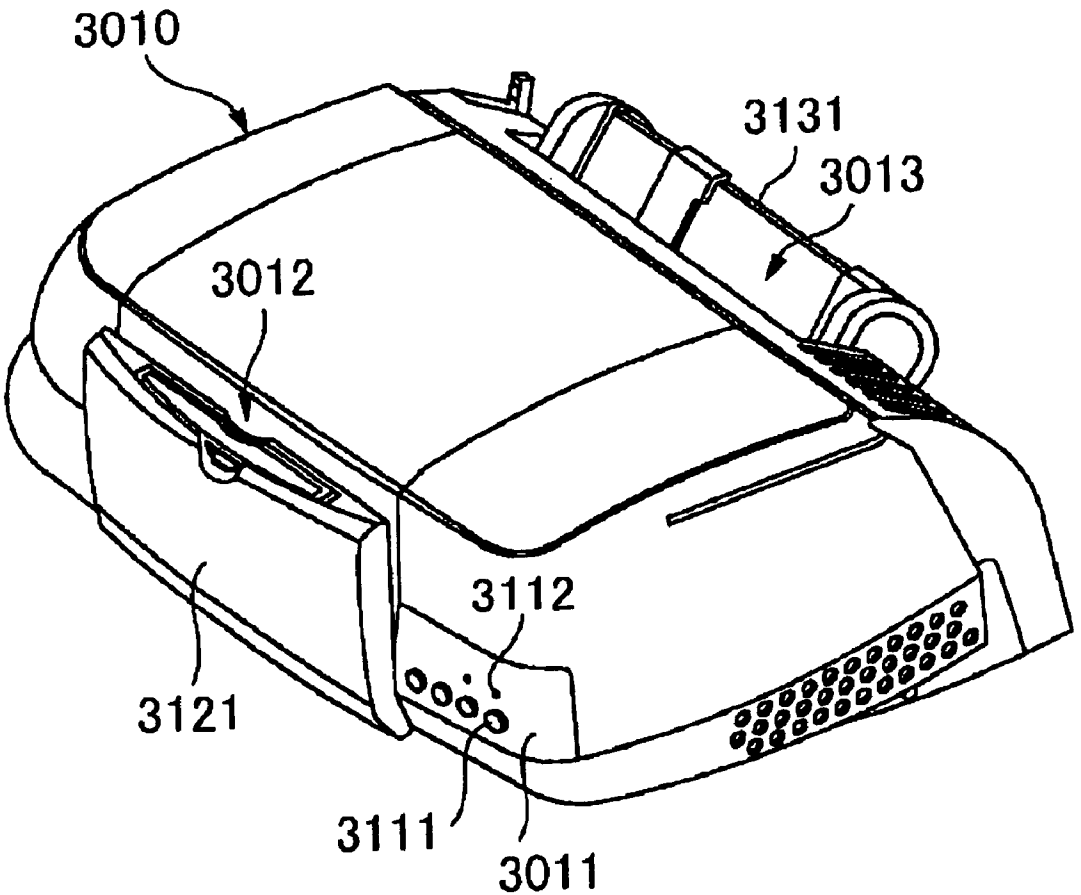
FIG. 19 relates to a third embodiment and diagrammatically shows the outer appearance of an inkjet printer.

The following explains an overview of an inkjet printer serving as a printing apparatus, which is a main application object of the present invention. FIG. 19 diagrammatically shows the outer appearance of an inkjet printer.

Here, a color inkjet printer is shown. This color inkjet printer 3010 is an inkjet printer that can output color images, and forms images by ejecting four colors of color ink, for example cyan (C), magenta (M), yellow (Y), and black (K), onto a printing medium such as cut paper so as to form dots. It should be noted that in addition to these four colors it is also possible to use light cyan (LC), light magenta (LM), and dark yellow (DY) as color inks.

As shown in FIG. 19, the color printer 3010 has a paper supply structure by which cut paper that is supplied from above its rear side is discharged from its front side. The front side of the main printer unit 3010 is provided with an operation panel 3011 and a paper discharge section 3012, and its rear side is provided with a paper supply section 3013. The operation panel 3011 is provided with a variety of control buttons 3111 and display lamps 3112. The paper discharge section 3012 is provided with a paper discharge tray 3121 blocking the paper discharge opening when the printer is not in use.

The paper supply section 3013 is provided with a paper supply tray 3131 for holding cut paper, which is not shown in the drawings. It should be noted that cut paper refers to paper that has been cut in advance to predetermined dimensions, and is a single-sheet printing medium that is not cut by the color printer 3010.

===Configuration of the Paper Supply Mechanism===

Figure 20:
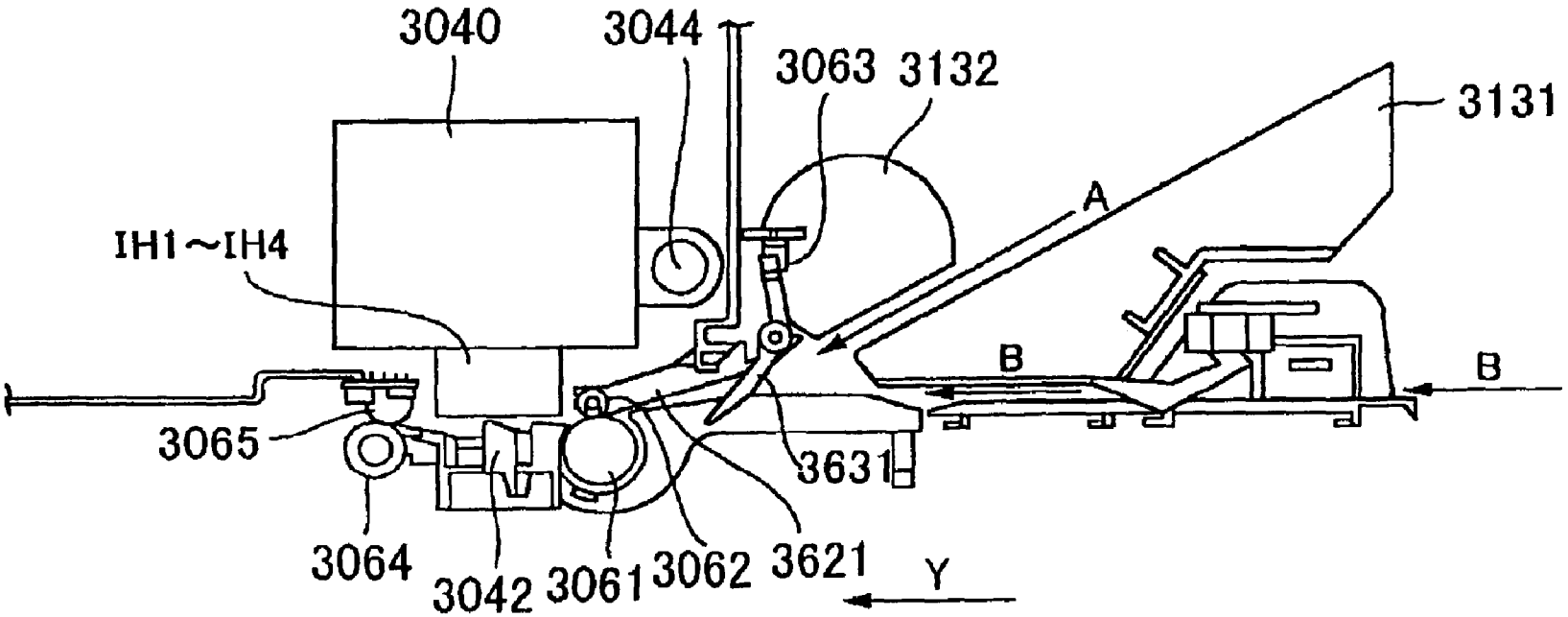
FIG. 20 relates to the third embodiment and is a cross-sectional view of an essential portion of an inkjet printer, illustrating two paper supply mechanisms.

The color printer 3010 of the present embodiment is configured to have, in particular, one more paper supply path (not shown in FIG. 19), which is also called a "straight path." This is a paper supply mechanism with which printing media having a certain thickness and hardness, such as thick paper, can be supplied manually. With this straight path mechanism, also printing media of irregular dimensions and shapes, such as CD-Rs, can be placed on a printing medium feeding tray (not shown in the drawings) and supplied, so that it is possible to print without cutting the printing media. FIG. 20 is a cross-sectional view of an essential portion of the printer 3010, illustrating these two paper supply mechanisms.

In the color printer 3010, a carriage 3040, which is supported by a slide shaft 3044 and moves in a slide shaft direction (main scanning direction), is provided as means for printing on a printing medium, and heads IH1 to IH4 that print by ejecting ink onto the printing medium are mounted to this carriage 3040. In opposition to the heads IH1 to IH4, a platen 3042 is provided that defines a gap between the head surfaces of the heads IH1 to IH4 and the printing medium. Moreover, the printing medium is printed on by letting the heads IH1 to IH4 eject ink onto the printing medium while carrying the carriage 3040 in the main scanning direction and intermittently carrying the printing medium between the carriage 3040 and the platen 3042 in a paper-feed direction Y.

The paper supply tray 3131 is configured such that it can supply printing media of cut paper, such as regular paper or photo paper, and it is provided with an ASF (auto sheet feeder) for automatically supplying the printing medium. The ASF is an automatic paper supply mechanism having a paper supply roller 3132 provided on the paper supply tray 3131 and a separation pad, which is not shown in the drawings. The paper supply roller 3132 has a substantially D-shaped cross section, and is rotated by the rotational driving force of a stepping motor or the like. Moreover, the rotational driving force of the paper supply roller 3132 and the friction resistance of the separation pad prevent a plurality of printing media from being supplied together.

Printing media that are automatically paper-fed by the ASF along the path indicated by the arrow A are intermittently carried for a predetermined paper feed amount towards the print execution area by printing medium carrying and positioning means disposed downstream in the paper-feed direction Y from the paper supply roller 3132.

A carry driving roller 3061 and carry driven rollers 3062 are provided as the printing medium carrying and positioning means for intermittently carrying and positioning the printing medium in the paper-feed direction Y. The carry driving roller 3061 is rotated by a paper feed motor, such as a stepping motor, and the printing medium is carried in the paper-feed direction Y by the rotation of the carry driving roller 3061. The carry driven rollers 3062 are axially supported on a plurality of carry driven roller holders 3621. When the printing medium is carried by the rotation of the carry driving roller 3061, the carry driven rollers 3062 follow this rotation.

A paper detector 3063 is disposed between the paper supply roller 3132 and the carry driving roller 3061. The paper detector 3063 has a lever 3631 provided with the property to restore itself to an upright position and pivotably supported such that it protrudes into the carrying path of the printing medium and such that it can turn only in the recording paper carrying direction. The paper detector 3063 has a configuration with which the lever 3631 turns when the tip of the lever 3631 is pushed by a printing medium, thus detecting the printing medium. The paper detector 3063 detects the leading edge position and the trailing edge position of the printing medium that has been supplied by the paper supply roller 3132. The printing region is decided and printing is executed in accordance with the detected positions.

A paper discharge driving roller 3064 and paper discharge driven rollers 3065 are provided as means for discharging printed printing media. The paper discharge driving roller 3064 is rotated by the rotation driving force of a stepping motor, for example, and rotation of the paper discharge driving roller 3064 discharges the recorded material in the paper-feed direction Y. The paper discharge driven rollers 3065 are teethed rollers that have a plurality of teeth on their circumferences, and the tips of these teeth are sharpened acutely such that they come in point contact with the recording surface of the printing medium. The paper discharge driven rollers 3065 are rotated by following when the printing medium is discharged due to the rotation of the discharge driving roller 3064.

In addition to the paper supply path (the path indicated by the arrow marked with the letter A) due to the above-described ASF, the printer 3010 is further equipped with a paper supply path for supplying printing media with little flexibility, such as thick paper in which a storage element is embedded. In the figure, this paper supply path is indicated by the arrow marked with the letter B. The printer 3010 can also print on printing media supplied from the paper supply path marked by the arrow B, just like it can print on printing media that are supplied from the ASF.

Furthermore, the printer 3010 is provided with a carry driven roller release mechanism, not shown in the drawings. When setting the printing medium in the set position, the carry driven rollers 3062 are held in a state separated from the carry driving roller 3061 (in a released stated), and after the printing medium has been inserted into the paper supply path and the positioning in the printing set position has finished, this released state is cancelled, and the carry driven rollers 3062 return to a state in which they are forced to move by the carry driving roller 3061. Here, when the printing medium is being set in the printing set position, the printer is for a while in an operation-stop state, so that for printing media equipped with a storage element, information can be read from and/or written into a storage element using this temporary stopped state.

Although it is not shown in the figure, a sending/receiving section serving as reading/writing means for the storage element of the printing medium is disposed near the point where the paper supply path of arrow B merges with the paper supply path of arrow A, that is, above the vicinity of the paper detector 3063. This sending/receiving section, is arranged at a location in which it squarely faces the storage element at a position in which the printing medium is in a temporary stopped state. Details regarding the configuration and the arrangement of the sending/receiving section are explained further below.

It should be noted that the paper supply mechanism (carrying means) for carrying the printing medium over the path indicated by the arrow marked with the letter B carries a printing medium that is set in horizontal orientation while maintaining it in that horizontal orientation, so that it is possible to effectively write information on or read information from an element that is provided on the printing medium, even in cases in which the stiffness of the printing medium is high.

===Configuration of the Printing Medium===

Figure 21:
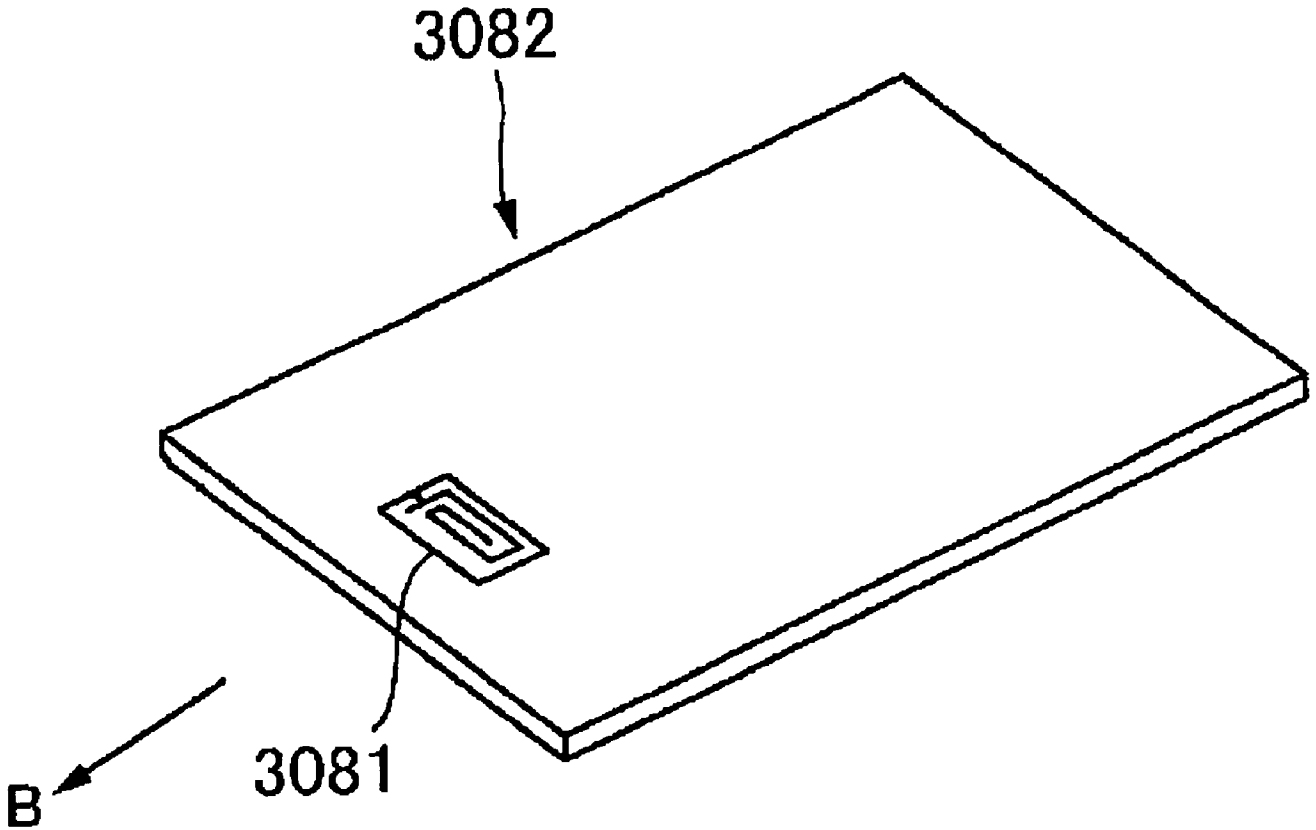
FIG. 21 relates to the third embodiment and is a perspective view of a thick paper, serving as a printing medium, in which a storage element has been embedded.

FIG. 21 is a perspective view of a printing medium according to the present embodiment. The main body of this printing medium 3082 is thick paper, and a storage element 3081 is embedded near the leading edge of the main body, taking the arrow B as the paper supply direction. As mentioned above, the storage element 3081 is positioned such that the storage element 3081 and the sending/receiving section 3080 (FIG. 22) provided on the printing apparatus face one another squarely at a position at which the printing medium is in a temporary stopped state midway in the paper supply path in Y direction. The position at which the storage element 3081 is embedded also depends on the position at which the sending/receiving section 3080 is provided, but if it is closer to the trailing edge of the thick paper, then it is necessary to perform the operation of returning the printing medium 3082 back to the above-mentioned set position after reading with the sending/receiving section 3080, so that preferably it is near the leading edge.

The storage element 3081 is a compact and thin element having a memory cell, such as a NAND flash ROM, and is made of a coil serving as an antenna and an IC chip having a controller and a storage section. If the thick paper has a thickness of about 0.5 mm, then it can be embedded easily. Moreover, the storage element 3081 is of the type allowing noncontact reading and/or writing. Consequently, there is no need for the sending/receiving section 3080 and the storage element 3081 to be in contact with one another, and there is a gap between the two. The storage element 3081 generates the necessary power by rectifying carrier waves sent from the sending/receiving section 3080.

===Configuration of the Storage Element and the Sending/Receiving Section===

Referring to FIG. 22, the following is an explanation of the configuration of the storage element 3081 and the sending/receiving section 3080.

FIG. 22(*a*) is a top transparent view illustrating the configuration of the storage element 3081. The storage element 3081 is a near-range noncontact storage element, and the distance over which it can exchange data with the sending/receiving section is about 10 mm. Overall it is very small and thin, and it may also be adhered to an object as a seal that is made sticky on one side. It is also referred to as a memory tag, and many types are commercially available.

The storage element 3081 is made by arranging a noncontact IC chip 3811, and a resonance capacitor 3812 and a planar coil 3813 formed by etching a metal thin film on a plastic film, and coating it by a transparent cover sheet. On the other hand, although not shown in the plan view, the sending/receiving section 3080 is made of coil antenna 3801 similar to that of the storage element and a sending/receiving circuit 3802, and is supplied with power from a power source unit of the printer main body 3010.

FIG. 22(*b*) is a block diagram showing the internal configuration of the storage element 3081 and the sending/receiving section 3080. The sending/receiving section 3080 is made of an antenna coil 3801 and a sending/receiving circuit 3802 that is connected to a peripheral input/output section (PIO) 3054 (FIG. 26) of a later-described printer main unit control circuit. The IC chip 3811 of the storage element 3081 is made of a rectifier 3814, a signal analyzer RF (radio frequency) 3815, a controller 3816, and a memory cell 3817. The memory cell 3817 is a memory that can be read/written electrically, such as a NAND flash ROM.

The antenna 3813 of the storage element 3081 and the antenna 3801 of the sending/receiving section 3080 are in communication with one another, and information stored in the memory cell 3817 is read or written. High-frequency signals generated with the sending/receiving circuit 3802 of the sending/receiving section 3080 are induced as a high-frequency magnetic field via the antenna 3801. This high-frequency magnetic field is absorbed via the antenna 3813 of the storage element 3081 and, rectified by the rectifier 3814, serves as a DC power source for driving the circuits inside the IC chip 3811.

===Data Stored in the Storage Element===

FIG. 23 is a diagram illustrating data strings in the memory cell 3817 of the storage element 3081. The regions of the memory cell 3817 include a read region 3817R in which attribute information about the printing medium is stored and a write region 3817W in which information relating to the printing result is stored.

The data in the read region 3817R (addresses 00H to 04H) represent the individual attributes of the thick paper in which the storage element 3081 is embedded. These data should be written when the storage element 3081 itself is manufactured at the factory or when it is embedded in the thick paper.

The data in the read region 3817R are 8 bits of information at each address, and include the type of printing medium, the thickness of the printing medium, the width of-the printing medium, the manufacturing date of the printing medium and the printing medium LUT. "Type of the printing medium" is information relating to the material ingredients (paper, plastic, leather, OHP sheet, etc.) of the printing medium 3082, and if it is paper, then also its glossiness for example. "Thickness of the printing medium" is information indicating the thickness of the printing medium 3082. Utilizing this information, the separation (released state) distance between the carry driven rollers 3062 and the carry driving roller 3061 when the printing medium 3082 is in the printing set state may be controlled when printing on a thick printing medium 3082. "Width of the printing medium" is information indicating the width of the printing medium 3082. With this information the printer can be controlled automatically without individually setting the width of the paper, such as A4 size or B5 size, with printer driver software. "Printing medium LUT" (look-up table) is a color correction table correlating an index number of index color format with numerical information of the actually displayed color. Since these differ for each printing medium, this information is important in order to achieve color image hues of high quality when printing. In addition to these data, it is also possible to include various other kinds of information relating to the attributes of the printing medium 3082 as appropriate. Furnishing the read region 3817R with these various kinds of information is advantageous, but it is also possible not to provide this read region 3817R, and to provide in the memory cell 3817 only the write region 3817W, into which information relating to the printing result is written.

The printer 3010 writes into the write region 3817W (at the addresses of 05H and below) the image-capturing conditions when the image data were generated with any kind of image-capturing device, such as digital camera or digital video. The image-capturing conditions may include information specifying the date on which the image data have been generated, information specifying the model of the digital camera, information specifying the shutter speed when taking the picture, information specifying the aperture value when taking the picture, information specifying the ISO sensitivity equivalent of the digital camera, the information specifying whether a flash was used when taking the picture, and the image data themselves that are printed on the printing medium 3082. Moreover, the pixel number of the digital camera and audio data or the like may also be written as image-capturing conditions, if appropriate.

By writing all this information and data into the write region 3817W, the image-capturing conditions can be easily verified at a later date, even if the image-capturing conditions are not printed on the printing medium when the image data are generated with an image-capturing device, such as a digital camera.

It should be noted that the information stored in the addresses of the read region 3817R and the write region 3817W may also be larger than eight bits if necessary. Furthermore, the image data are ordinarily of considerable size, so that it is preferable to ensure in advance a considerable amount of addresses as appropriate.

s===Arrangement of the Sending/Receiving Section===

In this embodiment, the sending/receiving section 3080 is disposed near the point where the paper supply path of arrow A merges with the paper supply path of arrow B, that is, above the vicinity of the paper detector 3063, however there is no limitation to this.

It is preferable that the sending/receiving section 3080 is arranged upstream from the print heads IH1 to 4 in the direction in which the printing medium is carried. The reason for this is that by arranging the sending/receiving section 3080 upstream from the sending/receiving section 3080 in the direction in which the printing medium is carried, it is possible to write information onto the element before printing is carried out by ejecting ink with the print heads IH1 to 4.

More preferably, the sending/receiving section 3080 is upstream on the paper supply side from the carrying and positioning means (carry driving roller 3061 and carry driven rollers 3062) that carry the printing medium 3082. This is because in this case the information stored in the storage element 3081 can be read at an early time when printing from the printer 3010 main unit side, so that it is possible to perform accurate settings of the printing control.

Moreover, also the process of writing onto the storage element 3081 may be performed subsequent to the reading process at the same position. That is to say, writing of information to the element is carried out when the printing medium is positioned at a predetermined position with respect to the printer 3010, and information stored in the element may be read out in that same position. With this configuration, the printing medium is positioned in a predetermined position with respect to the printer 3010, and both writing and reading of information with respect to the element are possible.

It should be noted that it is also possible to arrange the sending/receiving section 3080 below any of the print heads IH1 to 4, thus making it possible to move the sending/receiving section 3080 together with the print heads IH1 to 4. With this configuration, reliable sending and receiving regardless of the width of the printing medium 3082 becomes possible by moving the print heads IH1 to 4 to a suitable position in the scanning direction.

In any of the above cases, it is of course preferable that it is arranged at a position at which communication is possible within the range of distances over which sending and receiving with a near-range storage element 3081 is possible. Furthermore, in any case it is preferable that at the time of the reading operation, the operation of the printing medium 3082 is temporarily stopped in order to reliably perform communication.

===Configuration of the Carriage and its Surroundings===

Figure 24:
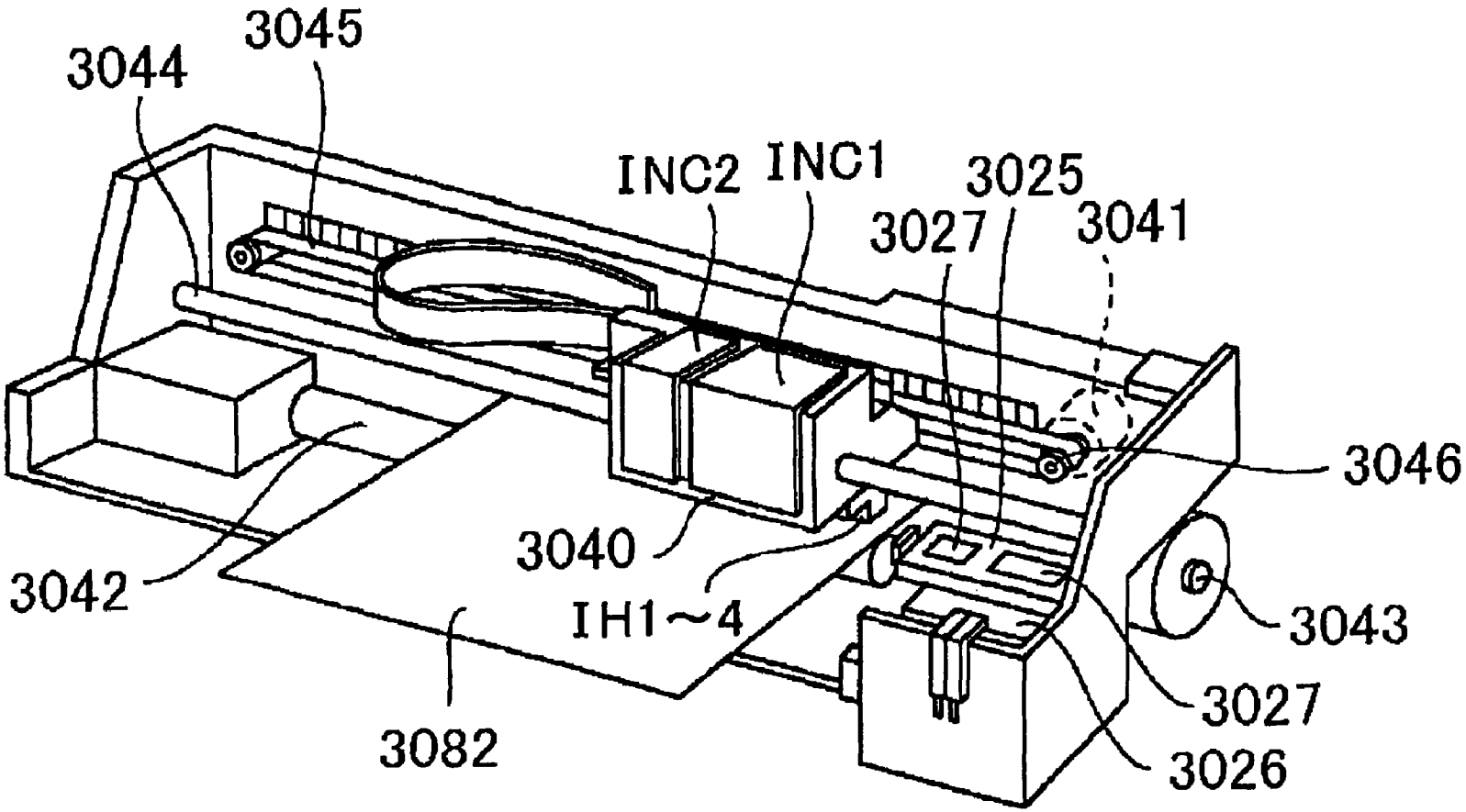
FIG. 24 relates to the third embodiment and is a perspective view showing the configuration of the surroundings of the carriage of an inkjet printer.

The following is an explanation of the configuration of the carriage 3040 and its surroundings within the inkjet printer 3010. FIG. 24 is a perspective view showing the configuration of the surroundings of the carriage 3040.

As shown in FIG. 24, the carriage 3040 is connected by a drive belt 3045 via a pulley 3046 to a carriage motor 3041, and is driven so that it moves parallel to the platen 3042, guided by the slide shaft 3044. The heads IH1 to IH4, which have a row of nozzles ejecting black ink and a row of nozzles ejecting color ink, are provided on the surface of the carriage 3040 that faces the printing paper. The nozzles receive a supply of ink from ink cartridges INC1 and INC2, and print text or images by ejecting ink drops onto the printing paper.

Furthermore, a capping device 3025 for sealing the nozzle apertures of the heads IH1 to IH4 when not printing and a pump unit 3026 including a pump motor that is not shown in the drawings are provided at a non-printing region of the carriage 3040. When the carriage 3040 is moved from the printing region to the non-printing region, the carriage 3040 abuts against a lever not shown in the drawings, whereby the capping device 3025 is shifted upward and seals the heads IH1 to IH4.

If the nozzle aperture rows of the heads IH1 to IH4 clog up, or if ink is forcibly ejected from the heads IH1 to IH4, for example when exchanging the ink cartridges INC1 and INC2, then the pump unit 3026 is operated while the heads IH1 to IH4 are in the sealed state, and the negative pressure from the pump unit 3026 sucks the ink out from the nozzle aperture rows. Thus, grime and paper dust adhering to the vicinity of the nozzle aperture rows are washed away, and moreover, air bubbles in the heads IH1 to IH4 are ejected together with the ink onto the cap 3027.

===Internal Configuration of the Inkjet Printer===

Figure 25:
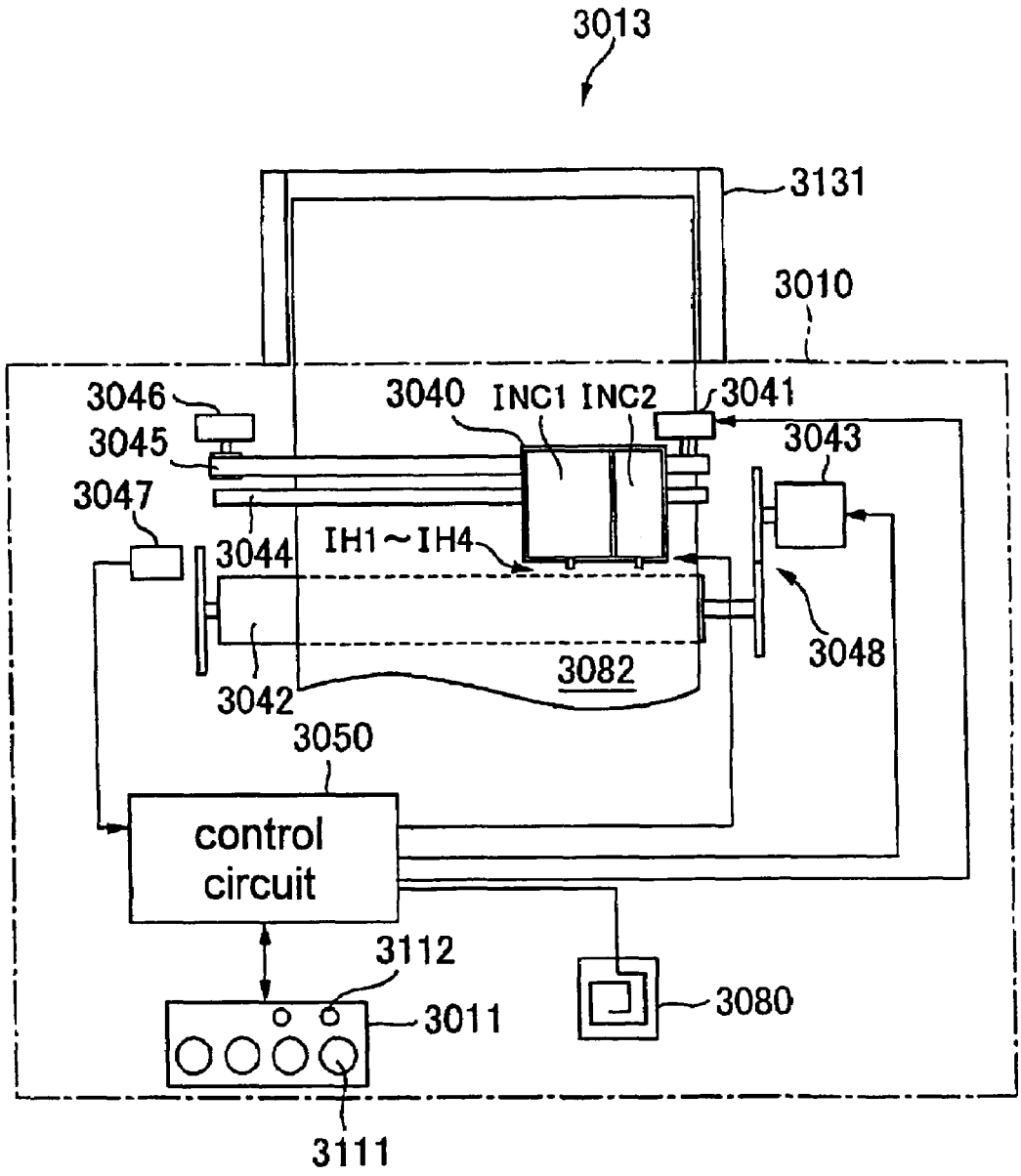
FIG. 25 relates to the third embodiment and shows the internal configuration of an inkjet printer.

Next, the internal configuration of the color inkjet printer 3010 is described with reference to FIG. 25. FIG. 25 shows the internal configuration of the printer 3010 according to this embodiment.

As shown in the figure, the printer 3010 has a mechanism for ejecting ink and forming dots by driving the print heads IH1 to IH4 mounted to the carriage 3040, a mechanism for moving the carriage 3040 back and forth in the axial direction of a platen 3042 with a carriage motor 3041, a mechanism for carrying with a paper feed motor 3043 the cut paper that is supplied from a paper supply unit 3131 and the printing medium 3082 that is supplied from the paper supply path marked by the arrow B, and a control circuit 3050.

The mechanism for moving the carriage 3040 back and forth in the axial direction of the platen 3042 includes a slide shaft 3044, which is provided parallel to the axis of the platen 3042 and which slidably holds the carriage 3040, and a pulley 3046 with an endless drive belt 3045 provided stretched between it and the carriage motor 3041.

The mechanism for carrying the printing medium includes the platen 3042, the paper-feed motor 3043 for rotating the platen 3042, the carry driving roller 3061 and the carry driven rollers 3062 (FIG. 20), a gear mechanism 3048 for transmitting the rotation of the paper-feed motor 3043 to the platen 3042 and the two rollers 3061 and 3062, an encoder 3047 for detecting the rotation angle of the platen 3042, and the paper detector 3063 (FIG. 20). Furthermore, the sending/receiving section 3080 is arranged near the paper detector 3063.

The control circuit 3050 appropriately controls the movement of the paper-feed motor 3043, the carriage motor 3041, and the print heads IH1 to IH4 while exchanging signals with an operation panel 3011 and the sending/receiving section 3080 of the printer, and a personal computer or the like connected on the outside. The printing medium supplied from the paper supply unit 3131 and the straight paper supply path marked by the arrow B is set so that it is sandwiched between the platen 3042 and the carry driven rollers 3062, and is carried by a predetermined amount corresponding to the rotation angle of the platen 3042.

An ink cartridge INC1 and an ink cartridge. INC2 are mounted on the carriage 3040. Each ink cartridge INC1 and INC2 is provided with a storage element ME (FIG. 26) for storing the amount of ink remaining, for example. The ink cartridge INC1 holds black (K) ink, and the ink cartridge INC2 holds the other inks, that is, it holds three colors of ink: cyan (C), magenta (M), and yellow (Y). As has been mentioned already, it may also contain light cyan (LC), light magenta (LM), and dark yellow (DY) ink.

===Internal Structure of the Control Circuit===

Figure 26:
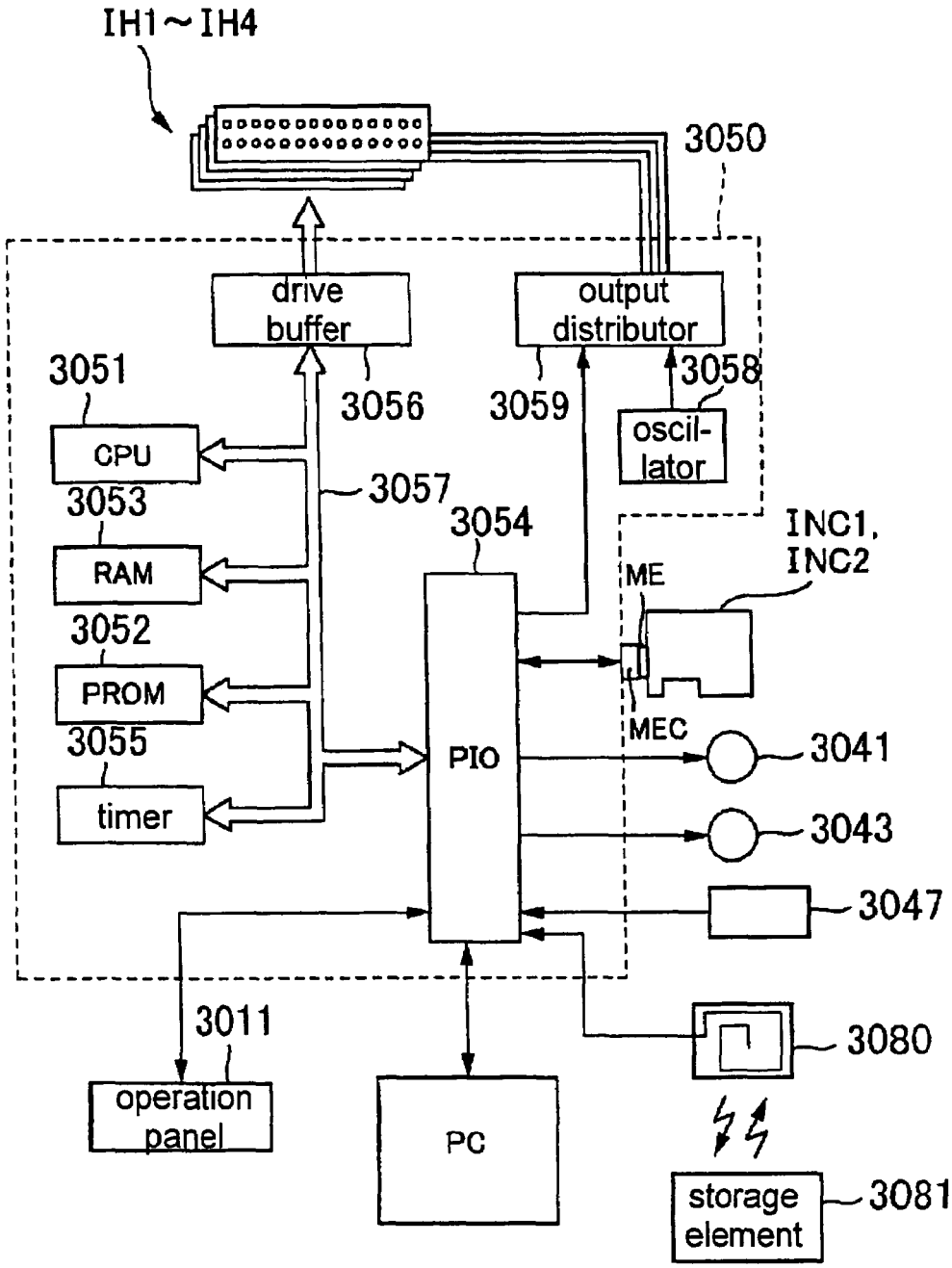
FIG. 26 relates to the third embodiment and is a block diagram showing the internal configuration of the control circuit of an inkjet printer.

Next, the internal configuration of the control circuit 3050 of the inkjet printer is described with reference to FIG. 26. FIG. 26 is a block diagram showing the internal configuration of the control circuit 3050 of the inkjet printer according to this embodiment. As shown in this figure, a CPU 3051, a PROM 3052, a RAM 3053, a peripheral device input/output section (PIO) 3054, a timer 3055, and a drive buffer 3056, for example, are provided inside the control circuit 3050.

The PIO 3054 is connected to the operation panel 3011, the personal computer PC, a connecter MEC connecting it with the memory elements ME of the ink cartridges, the carriage motor 3041, the paper-feed motor 3043, the encoder 3047, and the send/receive section 3080. The drive buffer 3056 is used as a buffer for supplying on/off signals for dot formation to the print heads IH1 to IH4. These are connected to one another by a bus 3057 and can exchange data between one another. The control circuit 3050 is also provided with an oscillator 3058 for outputting a drive waveform at a predetermined frequency, and an output distributor 3059 for distributing the output from the oscillator 3058 to the print heads IH1 to IH4 at a predetermined timing.

The control circuit 3050 accesses the storage element 3081 of the printing medium 3082 via the sending/receiving section 3080 when the printing medium 3082 is temporarily halted in the printing set position. Then, the control circuit 3050 controls the printing operation reflecting the information that has been obtained from the storage element 3081, and writes various kinds of information relating to the printing result into the storage element 3081.

While printing, the control circuit 3050 outputs dot data to the drive buffer 3056 at a predetermined timing while synchronizing with the movement of the carriage motor 3041 and the paper-feed motor 3043. The process of reading from the storage element 3081, the printing process utilizing the information obtained from the storage element 3081, and the process of writing information relating to the printing result are described in detail later.

===Operation of the Inkjet Printer===

Figure 27:
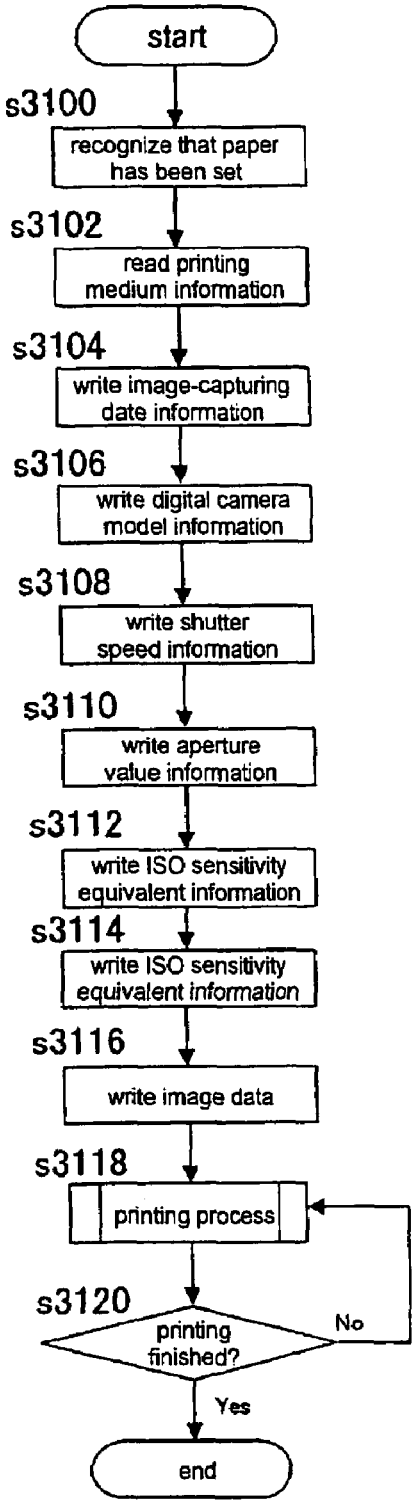
FIG. 27 relates to the third embodiment and is a flowchart of the procedure of the control circuit of the printer when printing.

Next, the operation of the inkjet printer 3010 in accordance with the present embodiment is explained with reference to FIG. 27. FIG. 27 is a flowchart of the procedure executed by the control circuit 3050 of the inkjet printer 3010 when printing image data. Here, it is assumed that the sending/receiving section 3080 is disposed above the paper supply path near the paper detector 3063.

First, the control circuit 3050 receives position information about the printing medium 3082 from the paper detector 3063, and confirms whether the printing medium 3082 has been set in the printing set position by the carrying and positioning means 3061 and 3062 (Step s3100).

The control circuit 3050 then executes a process of serially reading via the sending/receiving section 3080 the various kinds of information recorded in the read region 3817R of the memory cell 3817 of the storage element 3081, in order from the start of the addresses, and stores the obtained information temporarily in the RAM 3053 (Step s3102). "Various kinds of information" means namely, the type, thickness, width, manufacturing date and LUT of the printing medium 3082. As mentioned before, also a configuration in which the memory cell 3817 is not provided with the read region 3817R is possible, and in case of such a configuration, this step (s3102) can be omitted.

The control circuit 3050 then performs a process of writing via the sending/receiving section 3080 the image-capturing conditions used when the image data were generated with a digital camera into the write region 3817W (at the addresses of 05H and below) of the memory cell 3817. More specifically, a process of writing information for specifying the data at which the image data were generated (s3104), a process of writing information for specifying the model of the digital camera (s3106), a process of writing information for specifying the shutter speed when taking the picture (s3108), a process of writing information specifying the aperture value when taking the picture (s3110), a process of writing information specifying the ISO sensitivity equivalent of the digital camera (s3112), a process of writing the information specifying whether a flash was used when taking the picture (s3114), and a process of writing the image data themselves that are printed on the printing medium 3082 (s3116) are performed. It should be noted that the order of these writing processes (s3104 to 3116) may be changed as appropriate.

By writing all this information and data into the write region 3817W, the image-capturing conditions can be easily verified at a later date, even if the image-capturing conditions are not printed on the printing medium when the image data are generated with an image-capturing device, such as a digital camera.

Returning to the explanation of FIG. 27, the control circuit 3050 then performs a printing process (Step s3118). The printing process is basically carried out by a publicly known processing procedure. For this, the control information stored in the RAM 3053 is read out, and driving control of the carriage motor 3041, the paper feed motor 3043 and the print heads IH1 to 4 is performed.

Finally, the control circuit 3050 waits until printing is finished (Step s3120: No), and when it determines that printing has finished (Step s3120: Yes), the main routine is terminated.

It should be noted that if the image data themselves are written into the storage element 3081 of the printing medium 3082, as in the present embodiment, then they can be read by some other reading device and printed at a later date. In that case, even if the computer on which the image data were stored originally is not available, it is possible to output them in a simple manner using another computer and printing apparatus, because the printing medium itself holds the image data. For example, it is easy to compare print results for the same data without preparing the computer itself by reading the image data on the printing medium on which a certain image has been printed and outputting them on a variety of printers, to demo print a sample image at a store selling various models of printers, such as inkjet printers. For this, a reading device may be arranged midway in the paper supply path of the printing apparatus, in a similar manner as in the present embodiment, but it may also be a compact hand-held scanner with which noncontact reading is possible.

Furthermore, in addition to carrying out the process of printing on the printing medium 3082 with the inkjet printer 3010 and the process of writing image data or the like, and then reading out and reprinting the image data with a different printing apparatus at a later date, it is also possible to read the image data again from the printing medium 3082 with the inkjet printer 3010 and print them at a later date, because the inkjet printer 3010 is a printing apparatus that can both read and write from/on the storage element 3081.

===Other Considerations===

The above has been an explanation of a printing apparatus in accordance with the present invention based on an embodiment, but the above-described embodiment of the present invention is merely to facilitate the understanding of the present invention, and the present invention is not limited thereto. The present invention may be altered and modified without deviating from its general idea, and it is needless to say that equivalents are to be included within the present invention.

The present invention can be applied effectively to cut paper, but is not limited to cut paper, and can also be applied to roll paper. In this case, an element may be provided in the paper that is rolled around the core portion of a roll paper unit.

The above-described embodiment was explained for an example in which thick paper serves as the overall printing medium, but it is also possible to use a plastic board, a metal thin sheet or the like.

It is also possible to realize a computer system including not only the inkjet printer in accordance with the above-described invention, but also a computer main unit, a display device such as a CRT, an input device such as a mouse and a keyboard, a flexible disk drive and a CD-ROM drive, and as an overall system, the computer system realized in this manner will be superior to conventional systems.

Furthermore, the inkjet printer in accordance with the present embodiment may also be provided with all or some of the functions of a computer main unit, a display device, an input device, a flexible disk drive and a CD-ROM disk drive. For example, the printer may also be configured to have an image processing section performing image processing, a display section performing various sorts of display, and a recording media insertion section into which removable recording media can be inserted on which image data taken with a digital camera or the like are stored.

In the above-described embodiments, an inkjet printer 3010 was used as a printing apparatus, but as long as it is a printing apparatus that can perform a printing process on single-sheet media such as cut paper, there is no limitation to this, and it may also be applied to a monochrome printer, a laser printer, a facsimile or the like.

Moreover, in the above-described embodiments, storage elements were used that are provided with a noncontact IC chip and a resonance capacitor and a planar antenna coil formed by etching a metal thin film, but there is no limitation to this configuration, and various modifications are also conceivable, such as configurations in which the resonance capacitor may be connected outside of the storage element, or the IC chip and the antenna coil are arranged at different locations and connected to one another.

OTHER EMBODIMENTS

It is also possible that output control information controlling the output state of the image data in the printing apparatus is written by that printing apparatus into the element in the above-described embodiments. The following is an explanation regarding output control information.

Figure 28:
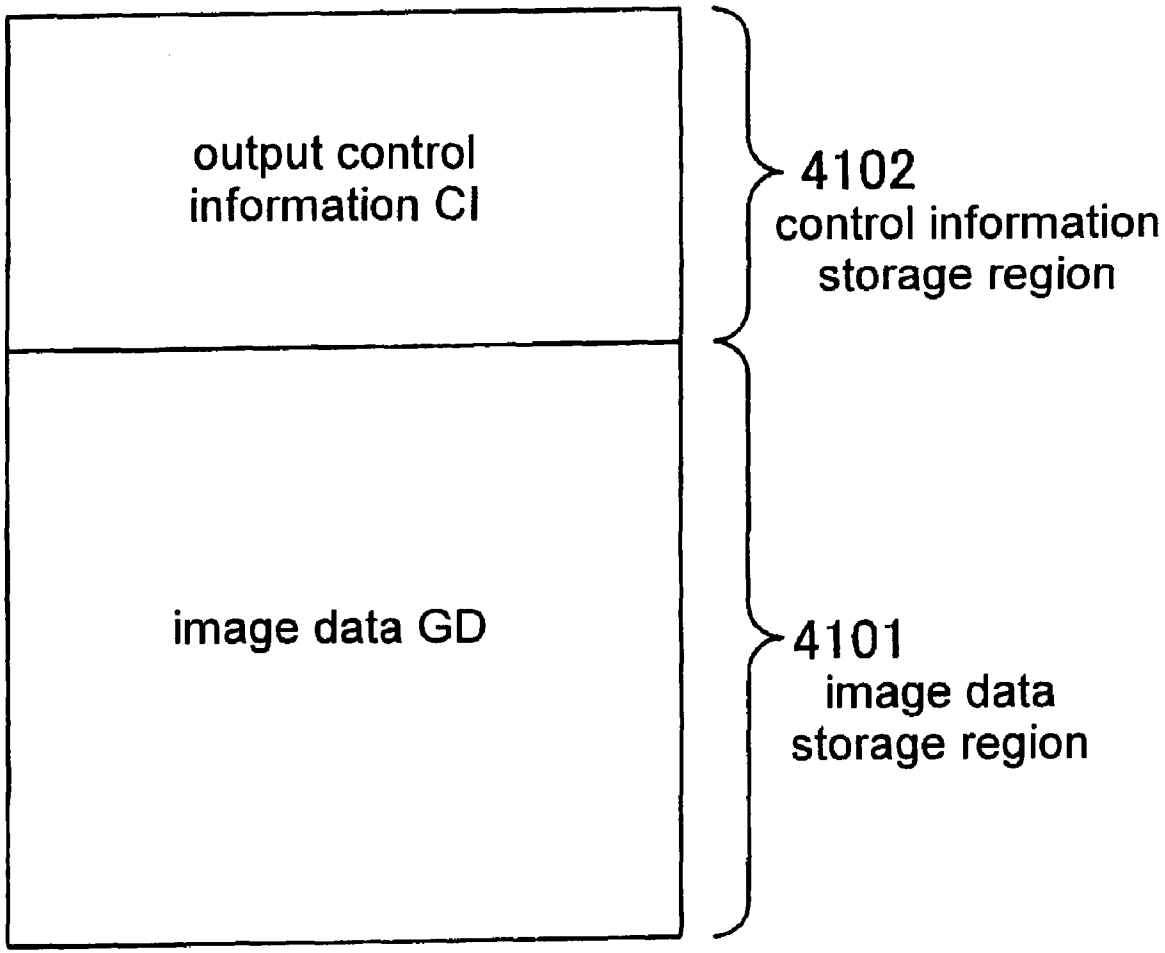
FIG. 28 is a diagram schematically illustrating the internal configuration of an image file, in accordance with another embodiment.

A. Configuration of Image Files:

First, the overall configuration of image files is explained with reference to FIG. 28. FIG. 28 is a diagram schematically illustrating the internal configuration of an image file.

The image file GF (4010) includes an image data storage region 4101 storing the image data GD, and a control information storage region 4102 storing output control information CI for the output apparatus (the printing apparatus, for example). The image data GD are stored in JPEG format for example, and the output control information CI is stored in TIFF format for example. It should be noted that the terms "structure of the file," "structure of the data," and "storage region" refer to a visualization of the file or the data in the state in which the file or the data are stored inside a storage device.

The output control information CI is information specifying the image output conditions and image output state in the output apparatus such that the optimum image output result is attained in consideration of the image output characteristics of the output apparatus. The information stored as output control information CI includes for example, as the information relating to the image characteristics, parameters relating to gamma value, the color space serving as the target, contrast, color balance adjustment, sharpness and color correction, and as the information related to the operation control of the printer, parameters relating to paper quality, resolution and the operation direction of the print heads (whether it is unidirectional printing or bidirectional printing).

The above-mentioned image file GF is generated for example by a digital still camera (DSC) or a digital video camera (DVC) serving as a digital camera, or by an input apparatus (image file generation apparatus) such as a scanner.

The image file GF should basically include the above-mentioned image data region 4101 and the control information storage region 4102, and can have a file structure in accordance with a standardized file format. The following explanations are for the case that the image file GF is compatible with a standardized file format.

Figure 29:
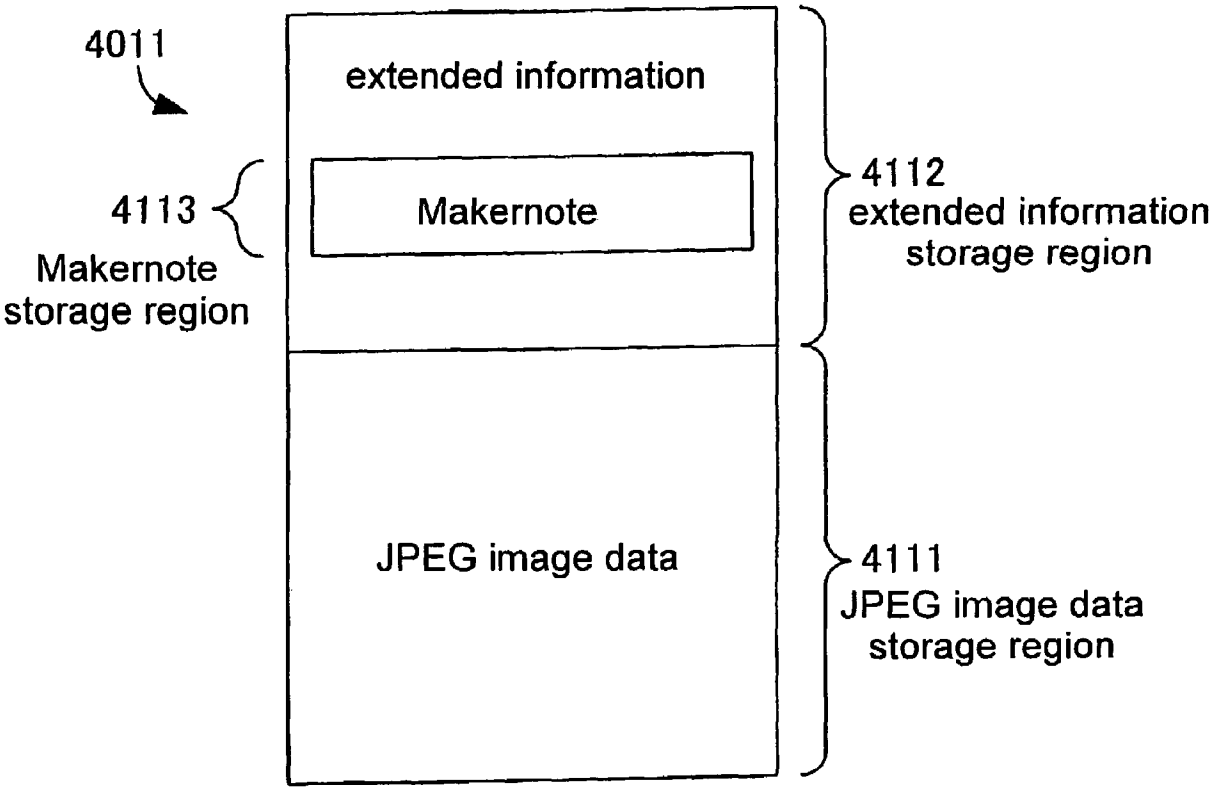
FIG. 29 relates to another embodiment, and is a diagram schematically illustrating the internal structure of an image file GF in accordance with a first working example that is stored in Exit file format.

The image file GF can have, for example, a file structure in accordance with the image file format standard for digital still cameras (Exit). The specification for Exit files is set by Japan Electronic Industry Development Association (JEIDA). The general structure of the image file GF is explained with reference to FIG. 29 for the case that its file format is in accordance with the Exit file format. FIG. 29 is a diagram schematically illustrating the internal structure of an image file GF that is stored in the Exit file format.

The image file 4011 serving as the Exit file includes a JPEG image data storage region 4111 storing image data in JPEG format and an extended information storage region 4112 storing various kinds of information relating to the stored JPEG image data. The extended information storage region 4112 stores information from the time of image capturing relating to the image-capturing conditions of the JPEG image, such as day and time the picture was taken, exposure or shutter speed, and stores thumbnail image data of the JPEG image stored in the JPEG image data storage region 4111 in TIFF format.

Furthermore, the extended information storage region 4112 is provided with a Makernote data storage region 4113 which is an undefined region that has been left open by the maker of the DSC, and the output control information CI is stored in the Makernote data storage region 4113. It should be noted that, as is well known to the person skilled in the art, in files with the Exit format, tags are used to specify the various data sets, "Makernote" is assigned as a tag name for data that are stored in the Makernote data storage region 4113, and this is called the Makernote tag.

Details of the data structure of the Makernote data storage region 4113 are explained with reference to FIG. 30. FIG. 30 is a diagram illustrating in detail the hierarchical structure of an image file GF. FIG. 30(*a*) shows the data structure of the Makernote data storage region 4113 (image output control data storage region), and FIG. 30(*b*) shows a PrintMatching data storage region (image output control parameter storage section) 4114, which is defined in the Makernote data storage region 4113.

The Makernote data storage region 4113 of the image file GF further has a configuration with which the stored data can be identified by tags, and the PrintMatching tag is assigned to the output control information CI. The tags of the Makernote data storage region 4113 are specified by a pointer with an offset value from the top address of the Makernote data storage region 4113.

In the Makernote data storage region 4113, the name of the manufacturer (6 bytes) is stored at the top address, and the stored information that follows is a reserved region (2 bytes), the entry number of local tags (2 bytes), and the local tag offsets (12 bytes). After the name of the manufacturer, a terminal code 00x0 is appended to indicate the end of the character string.

The information that is stored in the PrintMatching data storage region 4114 is a PrintMatching identifier showing that PrintMatching parameters have been stored, a parameter specification number indicating the number of parameters that are specified, parameter numbers in which the values are stored that specify (identify) the parameter numbers allotted beforehand to each parameter, and parameter setting values storing the setting value of the specified parameter number. The parameter number is, for example, information that is stored in a region of two bytes, and the parameter setting value is, for example, information that is stored in a region of four bytes. As parameter numbers, for example "1" is assigned to the gamma value parameter, "7" is assigned to the shadow point parameter, and "9" is assigned to the contrast point parameter. On the output device side, it is possible to obtain the output control information CI (the parameter values) taking these PrintMatching tags as the index.

Thus, the image file includes image data GD and output control information CI within one file, so that it is possible to specify the image output conditions, such as gamma value, target color space, contrast, sharpness and brightness for the output apparatus with only one image file. Consequently, by specifying the gamma value in the output apparatus, for example, it is possible to decrease differences of brightness and contrast between the display image that is viewed on the monitor of the digital still camera and the output image that is output with a printer or other output apparatus. It should be noted that it is also possible to provide a plurality of sets of PrintMatching data in adaptation with a plurality of output apparatuses having different output characteristics.

Furthermore, conventionally, a target color space fixed by sRGB can be specified, so that also in cases in which the digital still camera expresses the image data using a color space that is broader than NTSC or the like, a broad color space can be validly output.

Furthermore, output preferences (image characteristics) such as sharpness or brightness can be specified as output control information, so that it is possible to obtain the intended output result without employing a separate photo retouching operation. Furthermore, it is not necessary to intervene with an apparatus for photo retouching, which is in particular advantageous for an output apparatus provided with a function such that it can process image files on its own.

And furthermore, printing process conditions of the printer, such as paper quality (paper type), resolution or operation direction of the print heads, whose settings conventionally used to be made on a setting screen of a printer driver, can be specified in the file, so that it is possible to solve the problem of deficient settings of the printing process conditions, which could not be solved alone by correcting the image characteristics of the printing data. As a result, it becomes possible to print the image data with printing process conditions that are suitable for the image characteristics, and a printing result can be attained that reflects even better the intentions of the user who has generated the image file.

Figure 31:
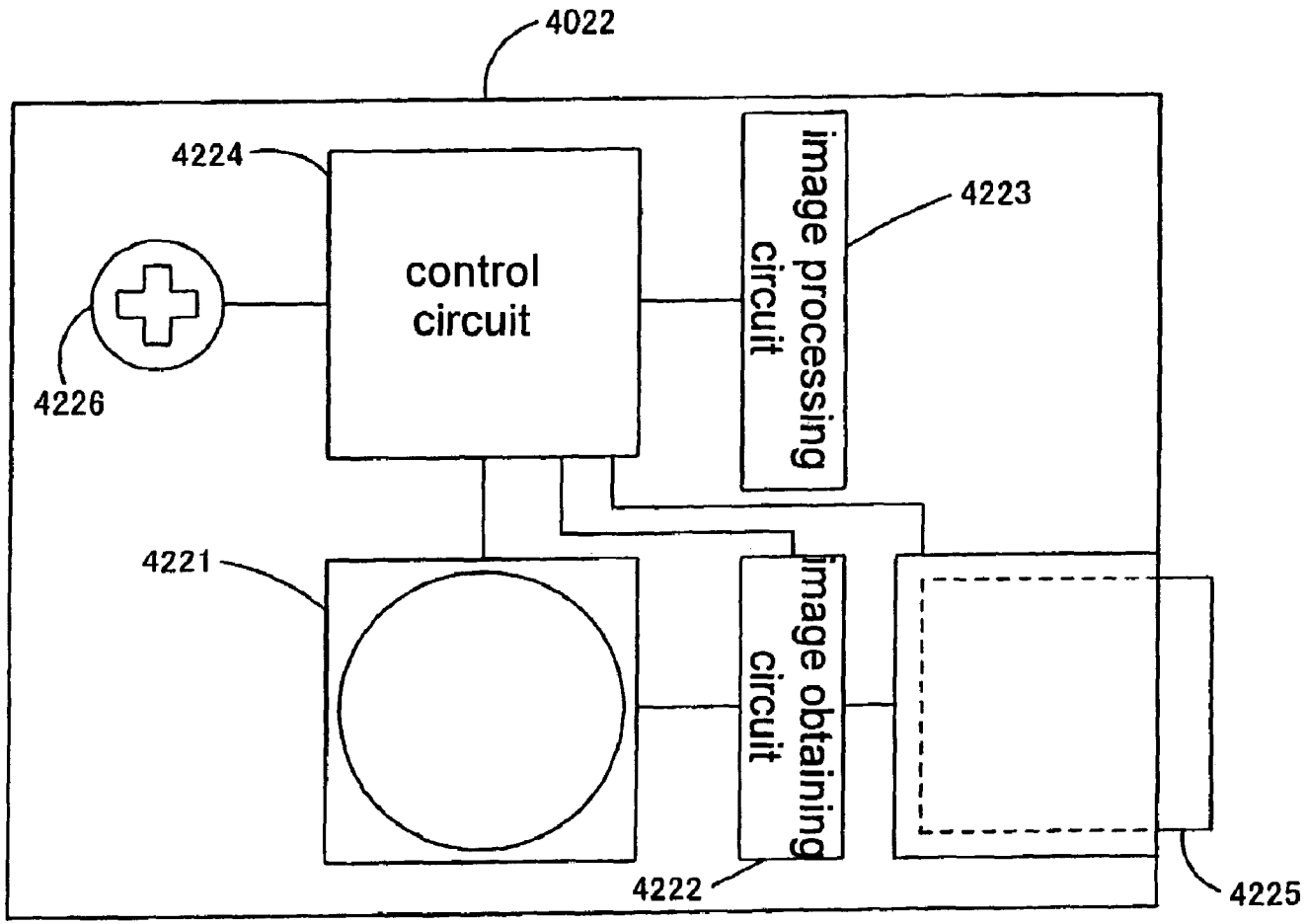
FIG. 31 is a block diagram illustrating the overall configuration of a digital still camera that can generate an image file GF according to another embodiment.

B. Generation of the Image File:

Referring to FIG. 31, the following is an explanation of the generation of an image file. FIG. 31 is a block diagram illustrating the overall configuration of a digital still camera that can generate an image file GF.

Digital still camera 4022 is a camera that obtains an image by imaging optical information onto a digital device (CCD or photomultiplier tube). As shown in FIG. 31, the digital still camera 4022 includes an optical circuit 4221 for gathering optical information, an image obtaining circuit 4222 for obtaining an image under control of a digital device, an image processing circuit 4223 for processing the obtained digital image, and a control circuit 4224 for controlling those circuits.

The digital still camera 4022 stores the obtained image as digital data in a storage device 4225. The JPEG format is common as the storage format of the image data GD in the digital still camera 4022, but other than that, it is also possible to use the TIFF format, the GIF format or the BMP format. The digital still camera 4022 further includes a selection/enter button 4226 with which output control information CI can be selected and set.

The digital still camera 4022 stores the output control information CI in addition to the image data GD as the image file GF in the storage device 4225. By setting with the digital still camera 4022 an output apparatus for planned output in advance before taking a picture, or by setting selected output conditions in advance, the output control information CI is automatically stored in the storage device 4225 together with the image data GD as the image file GF when the image data GD are obtained. Alternatively, when taking the picture, only the image data GD are temporarily stored in the storage device 4225 as the image file GF, and by specifying the desired output conditions on the digital still camera 4022 using arbitrary or preset conditions after taking the picture, the specified output conditions may be added to the image file GF as output control information CI.

Preset conditions are, for example, output conditions adapted to the output apparatus on which the image data GD in the image file GF are output, output conditions that are optimized for each printer manufacturer or for each printer model, or universal output conditions that are used comparatively often, such as brightness or sharpness. These preset conditions are stored in a memory inside the control circuit 4224 of the digital still camera 4022 as information on gamma value, target color space contrast or sharpness.

The arbitrary output conditions are output conditions that are set on the digital still camera 4022 (the image processing circuit 4223) by the user, and are the information for arbitrarily set gamma value, target color space, contrast and sharpness.

C: Reading and Writing of Output Control Information

The following is an explanation of the reading and writing of the output control information. The output control information stored in the image file GF is read by a computer or a printing apparatus or the like, and this read output control information is written by the printing apparatus (printer) into the element of the above-described embodiments.

For example, the image file GF generated with the digital still camera 4022 is sent to the printer via a cable CV and a computer PC or via a cable CV. Alternatively, if the storage device 4225 of the digital still camera 4022 is a removable storage device, then the image file GF can be sent to the printer by via a computer PC connected to the storage device 4225 or by directly connecting the storage device 4225 to the printer.

The printer receives the sent image file, reads out the output control information CI included in that image file, and, using the read output control information CI, prints the image data and writes the output control information CI into the element which is provided in or on the printing medium.

INDUSTRIAL APPLICABILITY

With the present invention as described above, it is possible to realize a printing medium with which various kinds of information relating to the printing medium can be held on the printing medium itself, an element provided in or on that printing medium, a printing apparatus for printing on that printing medium, and a computer system having such a printing apparatus and a computer main unit connected to that printing apparatus.

With the present invention, it is further possible to realize a printing medium with which image-capturing conditions and output control information or the like can be suitably held on the printing medium itself, an element provided in or on that printing medium, a printing apparatus for printing on that printing medium, and a computer system.

The invention claimed is:

1. A printing paper that is printed on without being cut by a printing apparatus, wherein:

a thickness of said printing paper is at least 0.5 mm;

an element for storing information about said printing paper is provided;

information for specifying a printing apparatus that has printed onto said printing paper, information for specifying a digital camera that has been used in a case of recording image data that are printed onto said printing paper, information for specifying a date on which printing was performed on said printing paper, and image data that are printed onto said printing paper are written into said element; and the written image data are read by a printing apparatus provided with an image data reader of a noncontact type and into that printing apparatus.

2. A printing paper that is printed on without being cut by a printing apparatus, wherein:

an element for storing information about said printing paper is provided;

said element is provided in or on a section of said printing paper that is at the front of the printing paper when the printing paper is being inserted into said printing apparatus;

a thickness of said printing paper is at least 0.5 mm;

information for specifying a type of said printing paper, information for specifying a thickness of said printing paper, information for specifying a width of said printing paper, information for specifying a date of manufacture of said printing paper, and information that is referred to when performing a color conversion in accordance with said printing paper are stored in said element; and the information stored in said element is read into said printing apparatus with a reader of a noncontact type provided on that printing apparatus.

3. A printing paper comprising:

a printing paper main body onto which printing is performed by a printing apparatus based on image data generated with an image-capturing device; and an element attached to said printing paper main body, into which information is electrically written by said printing apparatus, wherein information for identifying an image-capturing condition used when the image data were generated by said image-capturing device is written by said printing apparatus into said element.

4. A printing paper according to claim 3, wherein said image-capturing device is a digital camera.

5. A printing paper according to claim 3, wherein information for specifying a date when the image data have been generated by said image-capturing device is written by said printing apparatus into said element as said image-capturing condition.

6. A printing paper according to claim 3, wherein information for specifying a model of a digital camera serving as said image-capturing device is written by said printing apparatus into said element as said image-capturing condition.

7. A printing paper according to claim 3, wherein information for specifying a shutter speed during picture taking of a digital camera serving as said image-capturing device is written by said printing apparatus into said element as said image-capturing condition.

8. A printing paper according to claim 3, wherein information for specifying an aperture value during picture taking of a digital camera serving as said image-capturing device is written by said printing apparatus into said element as said image-capturing condition.

9. A printing paper according to claim 3, wherein information for specifying an ISO sensitivity equivalent of a digital camera serving as said image-capturing device is written by said printing apparatus into said element as said image-capturing condition.

10. A printing paper according to claim 3, wherein information for specifying whether a flash has been used or not when taking a picture with a digital camera serving as said image-capturing device is written by said printing apparatus into said element as said image-capturing condition.

11. A printing paper according to claim 3, wherein the image data printed on said printing paper are written into said element.

12. A printing paper according to claim 3, wherein said image-capturing condition used when the image data were generated with said image-capturing device is written by said printing apparatus into said element in a noncontact state.

13. A printing paper according to claim 3, wherein a thickness of the printing paper is at least 0.5 mm.

14. A printing paper according to claim 3, wherein said printing paper is printed on without being cut by said printing apparatus.

15. A printing paper according to claim 3, wherein printing is performed on the entire surface of the printing paper by said printing apparatus based on the image data that have been generated with said image-capturing device.

16. A printing paper comprising an element into which information can be written and that is printed on by a printing apparatus based on image data generated with a digital camera, wherein:

information for specifying a date when the image data have been generated by said digital camera as well as the image data are written by said printing apparatus into said element in a noncontact state;

a thickness of the printing paper is at least 0.5 mm; and the entire surface of the printing paper is printed on by said printing apparatus based on the image data that have been generated by said image-capturing device, without the printing paper being cut by said printing apparatus.

17. A printing paper comprising:

a printing paper main body onto which printing is performed; and an element attached to said printing paper main body, into which information is electrically written and that is printed on by a printing apparatus, wherein output control information for controlling an output state of an image data in said printing apparatus is written by said printing apparatus into said element, wherein said printing apparatus reads said output control information from an image file in which the image data are stored, and writes the read output control information into said element, and wherein said image file is an image file that has been generated with a digital camera.

18. A printing paper according to claim 17, wherein said output control information is data for controlling image processing with said printing apparatus by specifying gamma value, color space, contrast, color balance, sharpness, color correction, and accent color.

19. A printing paper according claim 17, wherein said output control information is data for controlling image output processing with said printing apparatus by specifying print media, resolution, and operative direction of a print head.

20. A method of printing an image, the method comprising:

reading first image information from a first image, the first image information having been previously stored in a memory element of the first image during a printing process of the first image;

formatting a printing device in accordance with the first image information;

printing a second image in accordance with the first image information, the second image being substantially identical to the first image, wherein the first image information comprises at least on of:

a date at which the image data were generated, a model of the digital camera, a shutter speed used when the image was taken, an aperture value used when taking the image, an ISO sensitivity equivalent of the digital camera, whether a flash was used when taking the image, and the image data, and reading printing paper attribute information from a storage paper attached to the printing paper on which the second paper is printed;

formatting a printing device in accordance with the read printing paper attribute information, wherein the printing paper attribute information includes at least one of:

a printing paper type, a printing paper thickness, a printing paper width, a printing paper manufacturing date, and a printing paper look up table (LUT).

* * * * *